US006183068B1

(12) United States Patent
Kashino et al.

(10) Patent No.: US 6,183,068 B1
(45) **Date of Patent: *Feb. 6, 2001**

(54) LIQUID DISCHARGING HEAD, HEAD CARTRIDGE, LIQUID DISCHARGING DEVICE, RECORDING SYSTEM, HEAD KIT, AND FABRICATION PROCESS OF LIQUID DISCHARGING HEAD

(75) Inventors: Toshio Kashino, Chigasaki; Hiroyuki Ishinaga, Tokyo; Takeshi Okazaki, Sagamihara; Yoshie Asakawa, Hotaka-machi, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/891,326

(22) Filed: Jul. 10, 1997

(30) Foreign Application Priority Data

Jul. 12, 1996 (JP) ..... 8-183036

(51) Int. Cl.[7] ..... B41J 2/05

(52) U.S. Cl. ..... 347/65

(58) Field of Search ..... 347/63, 65, 67, 347/68, 56, 57

(56) References Cited

U.S. PATENT DOCUMENTS

| | | | |
|---|---|---|---|
| 4,480,259 | 10/1984 | Kruger et al. | 347/63 |
| 4,496,960 | 1/1985 | Fischbeck | 347/68 |
| 4,509,063 | 4/1985 | Sugitani et al. | 347/65 |
| 4,558,333 | 12/1985 | Sugitani et al. | 347/65 |
| 4,568,953 | 2/1986 | Aoki et al. | 347/65 |
| 4,611,219 | 9/1986 | Sugitani et al. | 347/40 |
| 4,698,645 | 10/1987 | Inamoto | 347/65 |
| 4,723,129 | 2/1988 | Endo et al. | 347/56 |
| 4,723,136 | 2/1988 | Suzumura | 347/65 |
| 4,994,825 | 2/1991 | Saito et al. | 347/63 |
| 5,175,565 | 12/1992 | Ishinaga et al. | 347/67 |
| 5,208,604 | 5/1993 | Watanabe et al. | 347/47 |
| 5,262,802 | 11/1993 | Karita et al. | 347/87 |
| 5,278,585 | 1/1994 | Karz et al. | 347/65 |
| 5,296,875 | 3/1994 | Suda | 347/93 |
| 5,389,957 | 2/1995 | Kimura et al. | 347/20 |
| 5,485,184 | 1/1996 | Nakagomi et al. | 347/63 |
| 5,602,576 | 2/1997 | Murooka et al. | 347/59 |
| 5,821,962 * | 10/1998 | Kudo et al. | 347/65 |

FOREIGN PATENT DOCUMENTS

| | | | |
|---|---|---|---|
| 0 436 047 | 7/1991 | (EP) . | |
| 0443798 | 8/1991 | (EP) . | |
| 0496533 | 7/1992 | (EP) . | |
| 0538147 | 4/1993 | (EP) . | |
| 61-59914 | 2/1980 | (JP) . | |
| 55-81172 | 6/1980 | (JP) . | |
| 61-69467 | 4/1986 | (JP) . | |
| 61-110557 | 5/1986 | (JP) . | |
| 62-156969 | 7/1987 | (JP) . | |
| 62-196154 * | 8/1987 | (JP) | 347/65 |

(List continued on next page.)

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A liquid discharging head comprises a discharge opening for discharging a liquid, a bubble generation region for generating a bubble in a liquid, and a movable member disposed so as to face the bubble generation region and arranged as displaceable between a first position and a second position more distant from the bubble generation region than the first position, wherein the movable member has the narrowest space in the bubble generation region and is displaced from the first position to the second position by pressure based on generation of the bubble in the bubble generation region, and wherein the bubble is made to expand greater downstream than upstream with respect to a direction toward the discharge opening, by displacement of the movable member.

68 Claims, 25 Drawing Sheets

FOREIGN PATENT DOCUMENTS

| | | | | |
|---|---|---|---|---|
| 62-48585 | | 10/1987 | (JP) . | |
| 63-197652 | | 8/1988 | (JP) . | |
| 63-199972 | | 8/1988 | (JP) . | |
| 2-113950 | | 4/1990 | (JP) . | |
| 2-151446 | * | 6/1990 | (JP) | 347/65 |
| 3-81155 | | 4/1991 | (JP) . | |
| 4292949 | * | 10/1992 | (JP) | 347/65 |
| 5-124189 | | 5/1993 | (JP) . | |
| 6-31918 | | 2/1994 | (JP) . | |
| 6-87214 | | 3/1994 | (JP) . | |

* cited by examiner

LIQUID DISCHARGING HEAD, HEAD CARTRIDGE, LIQUID DISCHARGING DEVICE, RECORDING SYSTEM, HEAD KIT, AND FABRICATION PROCESS OF LIQUID DISCHARGING HEAD

BACKGROUND OF THE INVENTION

1. Field of the Invention

The present invention relates to a liquid discharging head for discharging a desired liquid by generation of bubble with application of thermal energy to the liquid, and to a head cartridge and a liquid discharging device incorporating the liquid discharging head. More particularly, the present invention relates to a liquid discharging head having movable members arranged to be displaced by utilizing generation of bubble, and to a head cartridge and a liquid discharging device incorporating the liquid discharging head.

The present invention is the invention applicable to equipment such as a printer, a copying machine, a facsimile machine having a communication system, a word processor having a printer portion or the like, and an industrial recording device combined with one or more of various processing devices, with which recording is effected on a recording medium such as paper, thread, fiber, textile, leather, metal, plastic material, glass, wood, ceramic material, and so on.

It is noted here that "recording" in the present invention means not only provision of an image having meaning, such as characters or graphics, on a recorded medium, but also provision of an image having no meaning, such as patterns, on the medium.

2. Related Background Art

One of the conventionally known recording methods is an ink jet recording method for imparting energy of heat or the like to ink so as to cause a state change accompanied by a quick volume change of ink (generation of bubble), thereby discharging the ink through a discharge opening by acting force based on this state change, and depositing the ink on a recorded medium, thereby forming an image, which is so called as a bubble jet recording method. A recording apparatus using this bubble jet recording method is normally provided, as disclosed in the bulletin of U.S. Pat. No. 4,723,129 etc., with discharge openings for discharging the ink, ink flow paths in communication with the respective discharge openings, and electrothermal transducers as energy generating means for discharging the ink located in the ink flow path.

The above recording method permits high-quality images to be recorded at high speed and with low noise and in addition, because a head for carrying out this recording method can have the discharge openings for discharging the ink as disposed in high density, it has many advantages; for example, high-resolution recorded images or even color images can be obtained readily by compact apparatus. Therefore, this bubble jet recording method is used in many office devices including printers, copiers, facsimile machines, and so on in recent years and further is becoming to be used for industrial systems such as textile printing apparatus.

With spread of use of the bubble jet technology in products in wide fields, a variety of demands described below are increasing these years.

For example, an example of investigation to meet the demand to improve the energy use efficiency is optimization of the heat generating member such as adjustment of the thickness of a protecting film. This technique is effective to an improvement in transfer efficiency of generated heat into the liquid.

In order to provide high-quality images, proposed were driving conditions for realizing the liquid discharge method or the like capable of performing good ink discharge based on high-speed discharge of ink and stable generation of bubble. From the standpoint of high-speed recording, proposed was an improvement in a configuration of flow path in order to obtain a liquid discharging head with high filling (refilling) speed into the liquid flow path of the liquid discharged.

Among this configuration of liquid path, Japanese Patent Application Laid-open No. 63-199972, for example, describes the flow path structure as shown in FIGS. 38A and 38B. The flow path structure and the head producing method described in the application are of the invention accomplished noting the back wave occurring with generation of bubble (i.e., the pressure directed in the opposite direction to the direction toward the discharge opening, which is the pressure directed to a liquid chamber 1012). This back wave is known as loss energy, because it is not energy directed in the discharge direction.

The invention shown in FIGS. 38A and 38B discloses a valve 1010 located apart from a generation region of a bubble formed by a heat generating element 1002 and on the opposite side to the discharge opening 1011 with respect to the heat generating element 1002.

In FIG. 38B, this valve 1010 is illustrated as being produced by the producing method making use of a plate material or the like, having an initial position where it is stuck to the ceiling of the flow path 1003, and dropping into the flow path 1003 with generation of bubble. This invention is disclosed as the one for suppressing the energy losses by controlling a part of the aforementioned back wave by the valve 1010.

However, as apparent from investigation on the case where a bubble is generated inside the flow path 1003 as retaining the liquid to be discharged in this structure, it is seen that to regulate the part of the back wave by the valve 1010 is not practical for discharge of liquid.

The back wave itself originally has no direct relation with discharge, as discussed previously. At the point when the back wave appears in the flow path 1003, as shown in FIG. 38B, the pressure directly related to discharge out of the bubble is already ready to discharge the liquid from the flow path 1003. It is thus clear that to regulate the back wave, more accurately, to regulate the part thereof, cannot give a great effect on discharge.

In the bubble jet recording method, on the other hand, heating is repeated while the heat generating member is in contact with the ink, which forms deposits due to scorching of ink on the surface of the heat generating member. A large amount of the deposits could be formed depending upon the type of ink, which could result in unstable generation of bubble and which could make it difficult to discharge the ink in good order. It has been desired to achieve a method for well discharging the liquid without changing the property of the liquid to be discharged even if the liquid to be discharged is the one easily deteriorated by heat or even if the liquid is the one not easy to achieve adequate generation of bubble.

From this viewpoint, another proposal was made to provide a method to employ different types of liquids, a liquid (bubble generation liquid) for generating a bubble by heat and a liquid (discharge liquid) to be discharged, arranged to transmit the pressure upon generation of bubble to the discharge liquid and to discharge the discharge liquid thereby, for example as disclosed in Japanese Patent Application Laid-open No. 61-69467 and No. 55-81172, U.S. Pat. No. 4,480,259, and so on. In these publications, the ink as the discharge liquid is perfectly separated from the bubble generation liquid by a flexible film of silicone rubber or the like so as to keep the discharge liquid from directly contacting the heat generating member, and the pressure upon generation of bubble in the bubble generation liquid is transferred to the discharge liquid through deformation of the flexible film. By this structure, the method achieved prevention of the deposits on the surface of the heat generating member, an improvement in freedom of selection of the discharge liquid, and so on.

In the case of the head having the valve mechanism for preventing the back wave upon formation of bubble as in the conventional example shown in FIGS. 38A and 38B, however, while the discharge efficiency of liquid can be increased by the degree of prevention of the back wave transmitted to the upstream side, this structure prevents only escape of upstream-escaping components of the discharge force generated upon generation of bubble to the utmost, so that it is not always sufficient to achieve still larger increases of the discharge efficiency and the discharge force.

Further, in the case of the head of the structure in which the discharge liquid and the bubble generation liquid are completely separated from each other as described above, since the pressure upon bubble generation is transferred to the discharge liquid through the expansion/contraction deformation of the flexible film, the pressure by generation of bubble is absorbed to a quite high degree by the flexible film. In addition, since the deformation of the flexible film is not so large, the energy use efficiency and the discharge force could be degraded, though it is possible to achieve the effect by the separation of the discharge liquid from the bubble generation liquid.

As described above, spread of the bubble jet technology is under way in various fields these years, with which demands are increasing for a liquid discharging head etc. capable of broadening the freedom of selection as to the characteristics of discharge liquid including viscosity and thermal properties and capable of performing good discharge.

Returning to the principle of discharge of liquid droplet, some of the inventors thus have conducted extensive and intensive research to provide a novel liquid discharging method utilizing a bubble that has never been obtained heretofore, and a head used therein, and the like.

As a result, we established the utterly novel technology for positively controlling the bubble by arranging the fulcrum and free end of the movable member in the flow path in such a positional relation that the free end is located on the discharge opening side, that is, on the downstream side and by so arranging the movable member as to face the heat generating member or the bubble generation region.

Next, it was found that, considering the energy given to the discharge liquid by the bubble itself, a maximum factor to considerably improve the discharge properties was to take account of downstream growing components of the bubble. Namely, it was also clarified that the discharge efficiency and discharge rate were improved just by efficiently directing the downstream growing components of the bubble along the discharge direction. This led the present inventors to an extremely high technical level, as compared with the conventional technical level, that the downstream growing components of the bubble are positively moved to the free end side of the movable member.

Further, it was found that it was also preferred to take account of the structural elements such as the movable member, the liquid flow path, and so on related to the growth of bubble on the downstream side in the heating region for forming the bubble, for example, on the downstream side of the center line passing the center of the area of the electrothermal transducer in the direction of flow of liquid or on the downstream side of the center of the area of the surface contributing to the bubble generation.

It was further found that the refilling rate was able to be greatly improved taking account of the location of the movable member and the structure of the liquid supply paths.

SUMMARY OF THE INVENTION

As discussed above, the applicant and some of the inventors filed applications of the breakthrough invention described above, and the inventors came to have a more preferred idea based on this invention.

Namely, the point recognized by the inventors is that when the bubble, having given the discharge force to the liquid, is collapsed in the space between the substrate with the heat generating member formed therein and the movable member facing the heat generating member, a new liquid needs to be supplied and that if the space between the substrate and the movable member is narrowed uniformly from the upstream liquid chamber side to the bubble generation region in order to enhance the discharge force, the flow resistance will increase, which posed a problem of incapability of higher-speed supply of liquid.

The main objects of the present invention are as follows.

A first object of the present invention is to provide a liquid discharging head capable of being driven at high speed with high discharge force and high discharge efficiency and a liquid discharging device incorporating the liquid discharging head, by focusing attention on the spacing between the movable member and the substrate, making an improvement therein, and making more effective use of the prior art having the movable member.

In addition to the above first object, a second object of the present invention is to provide a liquid discharging head and a liquid discharging device using it that can largely decrease accumulation of heat in the liquid above the heat generating member as improving the discharge efficiency and discharge pressure and that can perform good liquid discharge by decreasing residual bubbles above the heat generating member.

A third object of the present invention is to provide a liquid discharging head and a liquid discharging device using it enhanced in refilling frequency and improved in print speed or the like by suppressing the action of inertial force in the opposite direction to the liquid supply direction due to the back wave and decreasing a meniscus retraction amount by a valve function of the movable member.

For achieving the above objects, the present invention provides a liquid discharging head comprising a discharge opening for discharging a liquid, a bubble generation region for generating a bubble in a liquid, and a movable member disposed so as to face the bubble generation region and arranged as displaceable between a first position and a second position more distant from the bubble generation region than the first position, wherein the movable member has the narrowest space in the bubble generation region and is displaced from the first position to the second position by pressure based on generation of the bubble in the bubble generation region, and wherein the bubble is made to expand greater downstream than upstream with respect to a direction toward the discharge opening, by displacement of the movable member.

Further, the present invention also provides a liquid discharging head comprising a discharge opening for discharging a liquid, a liquid flow path having a heat generating member for generating a bubble in a liquid by applying heat to the liquid and a supply path for supplying the liquid to above the heat generating member from upstream of the heat generating member along the heat generating member, and a movable member disposed so as to face the heat generating member, having a free end on the discharge opening side, and arranged to displace the free end, based on pressure resulting from generation of the bubble, thereby guiding the pressure to the discharge opening side, wherein the movable member is supported so as to have varying spaces to a plane including the heat generating member and the movable member has the narrowest space in a generation region of the bubble generated by the heat generating member;

a liquid discharging head comprising a discharge opening for discharging a liquid, a heat generating member for generating a bubble in a liquid by applying heat to the liquid, a movable member disposed so as to face the heat generating member, having a free end on the discharge opening side, and arranged to displace the free end, based on pressure resulting from generation of the bubble, thereby guiding the pressure to the discharge opening side, and a supply path for supplying the liquid to above the heat generating member from upstream along a surface of the movable member closer to the heat generating member, wherein the movable member is supported so as to have varying spaces to a plane including the heat generating member and the movable member has the narrowest space in a generation region of the bubble generated by the heat generating member; and a liquid discharging head comprising: a first liquid flow path in fluid communication with a discharge opening; a second liquid flow path having a bubble generation region for generating a bubble in a liquid by applying heat to the liquid; and a movable member disposed between the first liquid flow path and the bubble generation region, having a free end on the discharge opening side, and arranged to displace the free end into the first liquid flow path side, based on pressure resulting from generation of the bubble in the bubble generation region, thereby guiding the pressure to the discharge opening side of the first liquid flow path, wherein the movable member is supported so as to have varying spaces to a plane including a heat generating member and the movable member has the narrowest space in the generation region of the bubble generated by the heat generating member.

The heat generating member is located at a position to face the movable member and the bubble generation region is defined between the movable member and the heat generating member.

The present invention is characterized in that the fulcrum of the movable member is located at a position offset from immediately above the heat generating member; in that a portion of the movable member becoming the fulcrum is higher than a portion thereof facing the bubble generation region; in that a slant portion is defined between the portion of the movable member facing the bubble generation region and the portion of the movable member becoming the fulcrum; and in that the movable member is supported so that an upstream side thereof is higher than a flow path area including the bubble generation region.

In addition, the present invention also involves a liquid discharging head comprising: a grooved member integrally having a plurality of discharge openings for discharging a liquid, a plurality of grooves for forming a plurality of first liquid flow paths in direct communication with and in correspondence to the respective discharge openings, and a recess portion for forming a first common liquid chamber for supplying the liquid to the plurality of first liquid flow paths; a smooth element substrate in which a plurality of heat generating members for generating a bubble in a liquid by applying heat to the liquid are provided; and a partition wall disposed between the grooved member and the element substrate, forming parts of walls of second liquid flow paths corresponding to the heat generating members, and having movable members at positions to face the respective heat generating members, each movable member being displaced into the first liquid flow path side by pressure based on generation of the bubble; wherein the partition wall is supported so as to have varying spaces to the element substrate and the partition wall has the narrowest space in generation regions of bubbles generated by the heat generating members.

Further, the present invention also involves a head cartridge having any of the above liquid discharging heads and a liquid container for reserving a liquid to be supplied to the liquid discharging head; and a head cartridge wherein the liquid discharging head and the liquid container can be separated from each other.

Additionally, the present invention also involves a liquid discharging device having any of the above liquid discharging heads, and driving signal supply means for supplying a driving signal for discharging the liquid from the liquid discharging head or recorded medium conveying means for conveying a recorded medium for receiving the liquid discharged from the liquid discharging head.

Also, the present invention involves a recording system having any of the above liquid discharging devices, and a post-process device for promoting fixation of the liquid to the recorded medium after recording or a pre-process device for enhancing fixation of the liquid.

The present invention also involves a head kit comprising any of the above liquid discharging heads and a liquid container for reserving a liquid to be supplied to the liquid discharging head.

Further, the present invention also involves a fabrication process of a liquid discharging head comprising a first recess portion for forming a first liquid flow path in fluid communication with a discharge opening, a movable member arranged as displaceable relative to the first recess portion, a second recess portion for forming a second liquid flow path for displacing the movable member, and discharge energy generating means disposed corresponding to the second recess portion, the fabrication process comprising steps of forming walls for forming the second recess portion on an element substrate having the discharge energy generating means and thereafter successively joining members respectively comprising the movable member and the first recess portion with the second recess portion so that at least a space between the movable member and the discharge energy generating means becomes narrowest by providing the movable member with a bent portion or a slant portion; and a fabrication process of a liquid discharging head comprising a first recess portion for forming a first liquid flow path in fluid communication with a discharge opening, a partition wall having a movable member arranged as displaceable relative to the first recess portion, a second recess portion for forming a second liquid flow path for reserving a liquid for displacing the movable member of the partition wall, and discharge energy generating means disposed corresponding to the second recess portion, the fabrication process comprising steps of forming walls for forming the second recess portion on an element substrate having the discharge energy generating means and thereafter successively joining members respectively comprising the movable member and the first recess portion with the second recess portion so that at least a space between the partition wall and the discharge energy generating means becomes narrowest by providing the partition wall with a bent portion or a slant portion.

In the invention thus constituted as described above, wherein the spaces between the element substrate and the movable member or the partition wall having the movable member vary relative to the plane including the heat generating member and wherein the narrowest space is in the bubble generation region, the flow resistance becomes small without decrease of the discharge force when the liquid flows into the bubble generation region upon collapse of bubble; and, in the case of high-speed drive, the liquid is supplied quickly to the bubble generation region so as not to cause insufficient refilling, thus enabling high-speed driving. Also, in the case wherein it is difficult to provide a plurality of supply sources of the bubble generation liquid in one head in the structure of so-called full line head with many nozzles of the two-liquid-path type, a sufficient volume can be secured by keeping the higher space to the substrate in the common liquid chamber section of the bubble generation liquid and in addition, the flow of liquid is not impeded, which enables to perform stable discharge continuously.

In addition, the liquid discharging head etc. according to the present invention, based on the very novel discharge principle, can attain the synergistic effect of the bubble generated and the movable member displaced thereby, so that the liquid near the discharge opening can be discharged efficiently, thereby improving the discharge efficiency as compared with the conventional discharge methods, heads, and so on of the bubble jet type. For example, the most preferable form of the present invention achieved the breakthrough discharge efficiency two or more times improved.

With the characteristic structure of the present invention, discharge failure can be prevented even after long-term storage at low temperature or at low humidity, or, even if discharge failure occurs, the head can be advantageously returned instantaneously into the normal condition only with a recovery process such as preliminary discharge or suction recovery.

Specifically, under the long-term storage condition to cause discharge failure of almost all of discharge openings in the head of the conventional bubble jet type having sixty four discharge openings, the head of the present invention showed discharge failure only in approximately half or less of the discharge openings. For recovering these heads by preliminary discharge, several thousand preliminary discharges were required for each discharge outlet in the conventional head, whereas a hundred or so preliminary discharges were sufficient to recover the head of the present invention. This means that the present invention can shorten the recovery period, can decrease losses of the liquid due to recovery, and can greatly lower the running cost.

Particularly, the structure for improving the refilling characteristics according to the present invention achieved high responsivity upon continuous discharge, stable growth of bubble, and stabilization of liquid droplet and enabled high-speed recording or high-quality recording based on the high-speed liquid discharge.

The other effects of the present invention will be understood from the description of the embodiments.

The terms "upstream" and "downstream" used in the description of the invention are defined with respect to the direction of general liquid flow from a liquid supply source through the bubble generation region (or the movable member) to the discharge opening or are expressed as expressions as to this structural direction.

Further, the "downstream side" of the bubble itself represents a discharge opening side portion of the bubble which directly functions mainly to discharge a liquid droplet. More particularly, it means a downstream portion of the bubble in the above flow direction or in the above structural direction with respect to the center of the bubble, or a bubble appearing in the downstream region from the center of the region of the heat generating member.

A "substantially sealed" state used in the description of the invention generally means a sealed state in such a degree that while a bubble grows, the bubble is kept from escaping through a gap (slit) around the movable member before displacement of the movable member.

The "partition wall" stated in the invention may mean a wall (which may include the movable member) interposed to separate the region in direct fluid communication with the discharge opening from the bubble generation region in a wide sense and, more specifically, means a wall for separating the liquid flow path including the bubble generation region from the liquid flow path in direct fluid communication with the discharge opening, thereby preventing mixture of the liquids in the respective liquid flow paths, in a narrow sense.

DESCRIPTION OF THE PREFERRED EMBODIMENTS

Embodiments of the present invention will be described with reference to the drawings.

(First Embodiment)

First described in the present embodiment is an example where the discharge force and discharge efficiency are improved by controlling propagation directions of pressure based on the bubble and growing directions of the bubble, for discharging the liquid.

Figure 1A:
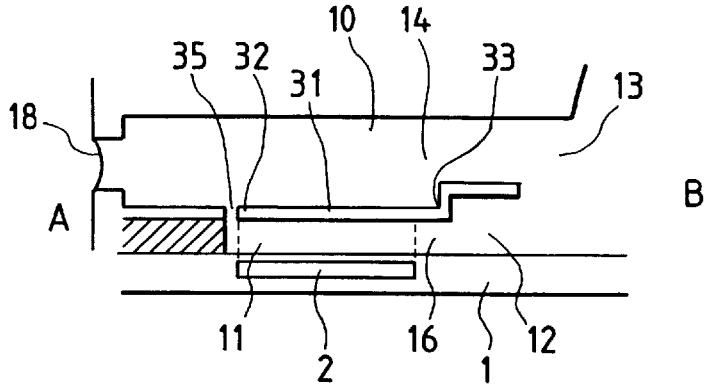
FIGS. 1A, 1B, 1C and 1D are schematic, cross-sectional views to show an example of the liquid discharging head according to the present invention.
Figure 1B:
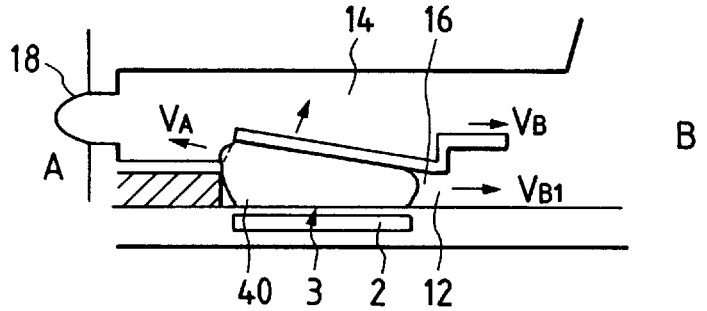
Figure 1C:
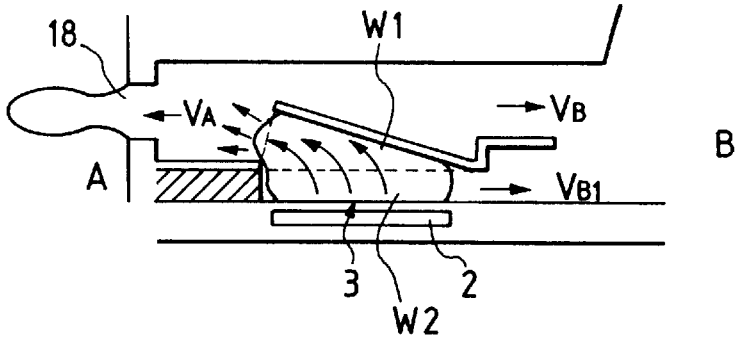
Figure 1D:
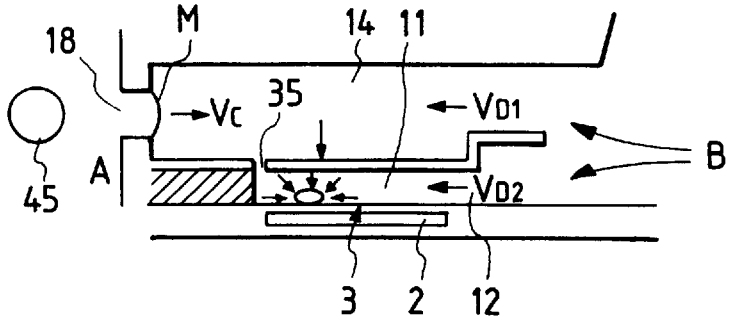
Figure 2:
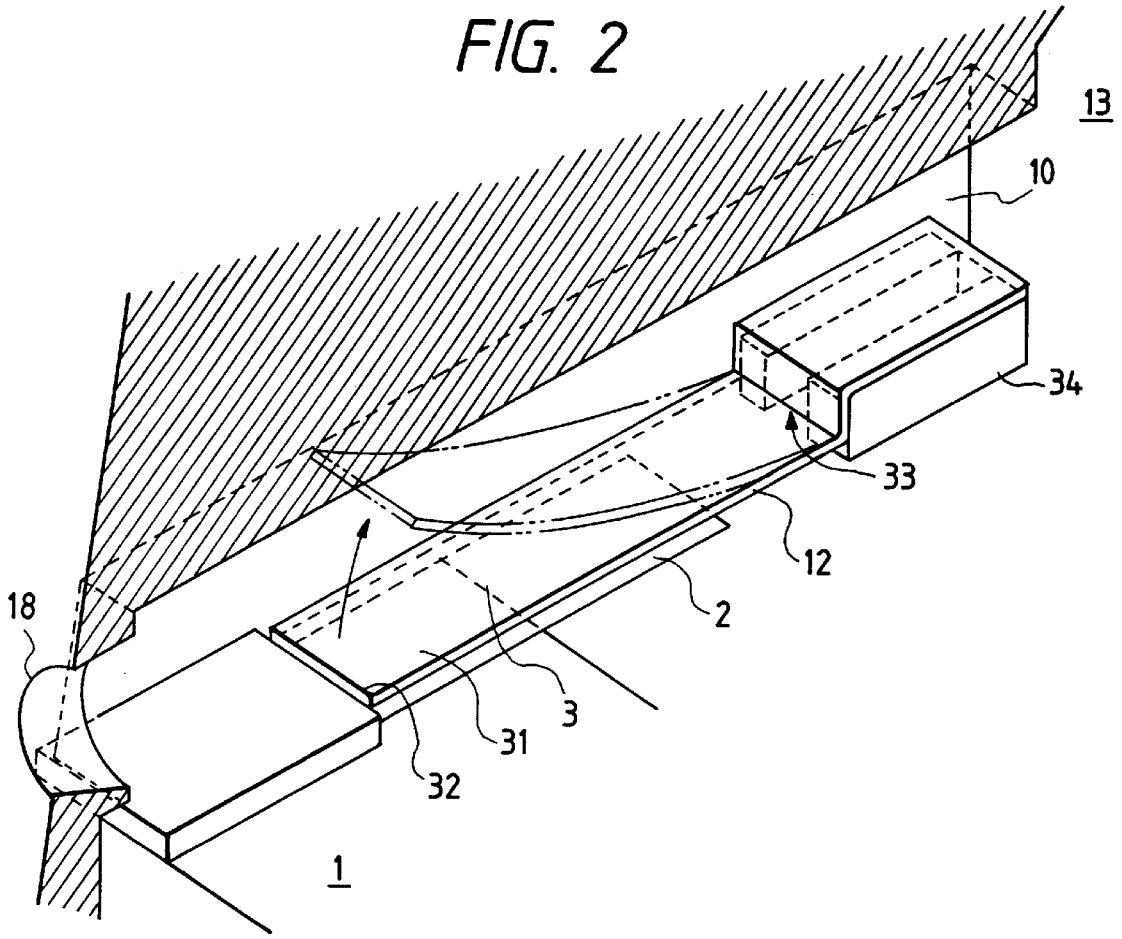
FIG. 2 is a perspective view, partly broken, of the liquid discharging head according to the present invention.

FIGS. 1A–1D are schematic, sectional views to show an example of the liquid discharging head of the present invention, and FIG. 2 is a perspective view, partly broken, of the liquid discharging head of the present invention.

The liquid discharging head of the present embodiment comprises a smooth element substrate 1, heat generating members 2 (heating resistor members in the configuration of 40 $\mu$m×105 $\mu$m in the present embodiment) as discharge energy generating elements for supplying thermal energy to the liquid to discharge the liquid, mounted on the element substrate 1, and liquid flow paths 10 formed above the element substrate 1 in correspondence to the heat generating members 2. The liquid flow paths 10 are in fluid communication with associated discharge openings 18 and with a common liquid chamber 13 for supplying the liquid to the plurality of liquid flow paths 10, so that each liquid flow path 10 can receive the liquid from the common liquid chamber 13 in an amount equivalent to the liquid having been discharged through the discharge opening 18.

Above the element substrate 1 and in each liquid flow path 10 a movable member 31 of a plate shape is formed in a cantilever form and of a material having elasticity, such as metal, so as to face the heat generating member 2. One end of the movable member 31 is fixed to foundations (support member) 34 or the like provided by patterning of a photosensitive resin on the wall of the liquid flow path 10 or on the element substrate 1. This structure supports the movable member 31 and constitutes a fulcrum (fulcrum portion) 33. Further, the spacing of the movable member 31 changes relative to the element substrate 1, and the spacing is narrowest in the bubble generation region 11.

The movable member 31 has the fulcrum (fulcrum portion: fixed end) 33 on the upstream side of a large flow of the liquid from the common liquid chamber 13 via the movable member 31 toward the discharge opening 18, caused by the discharge operation of the liquid, and has a free end (free end portion) 32, the height of which is lower than that of fulcrum 33, on the downstream side with respect to this fulcrum 33. The movable member 31 is so positioned that it is opposed to the heat generating member 2 with a space of approximately 15 $\mu$m therefrom so as to cover the heat generating member 2 and that it has an inflection point to make the space on the common liquid chamber side greater than the space of 15 $\mu$m. A bubble generation region 11 is defined between the heat generating member 2 and the movable member 31, and the common liquid chamber 13 side is higher than the flow path region including the bubble generation region 11. The type, configuration, and position of the heat generating member 2 or the movable member 31 are not limited to those described above, but may be arbitrarily determined as long as the configuration and position are suitable for controlling the growth of bubble and the propagation of pressure as discussed below. For the convenience' sake of description of the flow of the liquid discussed hereinafter, the liquid flow path 10 as described is divided by the movable member 31 into two regions, i.e., a first liquid flow path 14 in direct communication with the discharge opening 18 and a second liquid flow path 16 having the bubble generation region 11 and the liquid supply path 12.

By heating the heat generating member 2, heat is applied to the liquid in the bubble generation region 11 between the movable member 31 and the heat generating member 2, whereby a bubble 40 is generated in the liquid by the film boiling phenomenon as described in U.S. Pat. No. 4,723,129. The bubble 40 and the pressure based on the generation of bubble 40 preferentially act on the movable member 31, so that the movable member 31 is displaced to widely open on the discharge opening 18 side about the fulcrum 33, as shown in FIGS. 1B and 1C or FIG. 2. The displacement or the displaced state of the movable member 31 guides the growth of the bubble 40 itself and the propagation of the pressure raised with generation of the bubble 40 toward the discharge opening 18.

Here, one of the fundamental discharge principles adopted in the present invention will be explained.

One of the important principles in the present invention is that with the pressure of the bubble 40 or the bubble 40 itself the movable member 31 disposed to face the bubble 40 is displaced from a first position in a stationary state to a second position in a state after displaced and that the movable member 31 thus displaced guides the bubble 40 itself or the pressure caused by the generation of bubble 40 toward the downstream side where the discharge opening 18 is positioned.

This principle will be described in further detail in comparison with the conventional liquid flow path structure.

Figure 3:
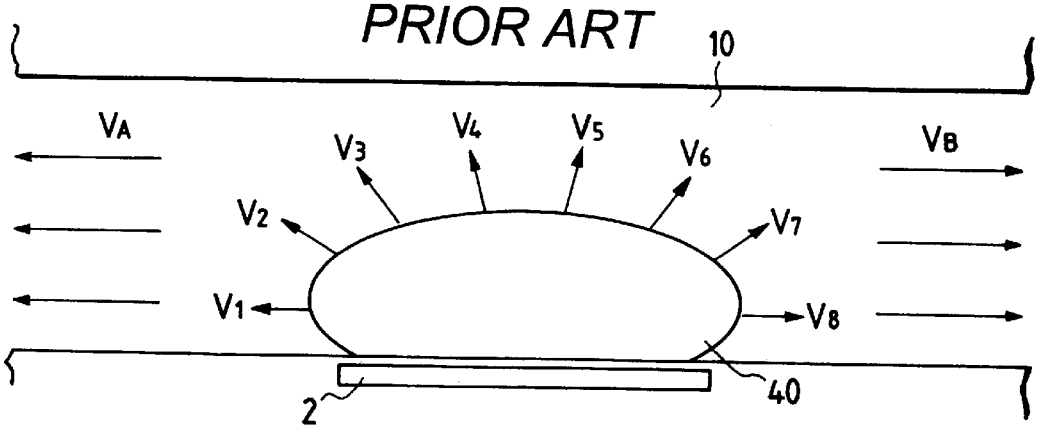
FIG. 3 PRIOR ART
FIG. 3 is a schematic view to show propagation of pressure from the bubble in the conventional head.
Figure 4:
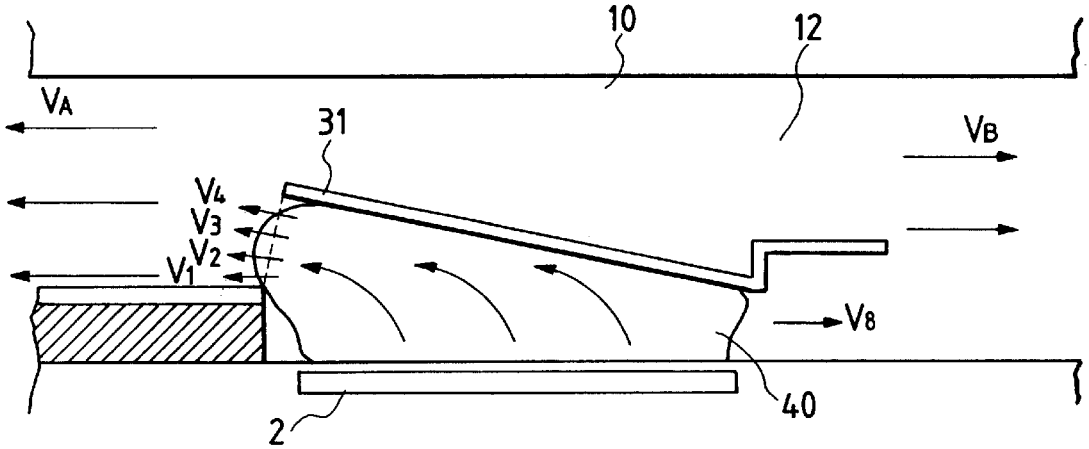
FIG. 4 is a schematic view to show propagation of pressure from the bubble in the head according to the present invention.

FIG. 3 is a schematic diagram to show propagation of pressure from the bubble in the conventional head and FIG. 4 is a schematic diagram to show propagation of pressure from the bubble in the head according to the present invention. In these figures, a propagation direction of the pressure toward the discharge opening is indicated by $V_A$ and a propagation direction of the pressure toward upstream by $V_B$.

The conventional head shown in FIG. 3 has no structure for regulating directions of propagation of the pressure raised by the bubble 40 generated. Thus, the pressure of the bubble 40 propagates in various directions normal to the surface of the bubble as shown by $V_1$–$V_8$. Among these, components having the pressure propagation directions along the direction $V_A$ most effective to the liquid discharge are those having the directions of propagation of the pressure in the portion of the bubble closer to the discharge opening than the nearly half point, i.e., $V_1$–$V_4$, which is an important portion directly contributing to the liquid discharge efficiency, the liquid discharge force, the discharge speed, and so on. Further, $V_1$ effectively acts because it is closest to the discharge direction $V_A$, and on the other hand, $V_4$ involves a relatively small component directed in the direction of $V_A$.

In contrast with it, in the case of the present invention shown in FIG. 4, the movable member 31 works to guide the pressure propagation directions $V_1$–$V_4$ of bubble, which would be otherwise directed in the various directions as in the case of FIG. 3, toward the downstream side (the discharge opening side) so as to change them into the pressure propagation direction of $V_A$, thereby making the pressure of bubble 40 contribute directly and effectively to discharge. The growing directions per se of the bubble are guided to the downstream in the same manner as the pressure propagation directions $V_1$–$V_4$ are, so that the bubble grows more on the downstream side than on the upstream side. In this manner, the discharge efficiency, the discharge force, the discharge speed, and so on can be fundamentally improved by controlling the growing directions per se of bubble by the movable member and thereby controlling the pressure propagation directions of bubble.

Now returning to FIGS. 1A to 1D, the discharge operation of the liquid discharging head of the present embodiment will be described in detail.

FIG. 1A shows a state seen before the energy such as electric energy is applied to the heat generating member 2, which is, therefore, a state seen before the heat generating member 2 generates the heat.

An important point herein is that the movable member 31 is positioned relative to the bubble generated by heat of the heat generating member 2 so as to be opposed to at least the downstream side portion of the bubble. Namely, in order to let the downstream portion of the bubble act on the movable member 31, the liquid flow path structure is arranged in such a way that the movable member 31 extends at least up to a position downstream of the center 3 of the area of the heat generating member 2 (or downstream of a line passing through the center 3 of the area of the heat generating member and being perpendicular to the lengthwise direction of the flow path).

FIG. 1B shows a state in which the electric energy or the like is applied to the heat generating member 2 to heat the heat generating member 2 and the heat thus generated heats a part of the liquid filling inside of the bubble generation region 11 to generate a bubble 40 in accordance with film boiling.

At this time the movable member 31 is displaced from the first position to the second position by the pressure raised by generation of bubble 40 so as to guide the propagation directions of the pressure of the bubble 40 into the direction toward the discharge opening 18. An important point here is, as described above, that the free end 32 of the movable member 31 is located on the downstream side (or on the discharge opening side) with the fulcrum 33 on the upstream side (or on the common liquid chamber side) so that at least a part of the movable member 31 may be opposed to the downstream portion of the heat generating member 2, that is, to the downstream portion of the bubble 40.

FIG. 1C shows a state in which the bubble 40 has further grown and the movable member 31 is further displaced according to the pressure raised by generation of bubble 40. The bubble 40 generated grows more downstream than upstream to expand largely beyond the first position (the position of the dotted line) of the movable member 31. It is thus understood that the gradual displacement of the movable member 31 in response to the growth of bubble 40 allows the pressure propagation directions of bubble 40 and easily volume-changing directions, i.e., the growing directions of bubble 40 to the free end side, to be uniformly directed toward the discharge opening 18, which also increases the discharge efficiency. While the movable member 31 guides the bubble 40 and the bubble generation pressure toward the discharge opening 18, it rarely obstructs the propagation and growth and it can efficiently control the propagation directions of the pressure and the growth directions of the bubble 40 in accordance with the magnitude of the pressure propagating.

FIG. 1D shows a state in which the bubble 40 contracts and extincts because of a decrease of the pressure inside the bubble after the film boiling stated previously.

The movable member 31 having been displaced to the second position returns to the initial position (the first position) of FIG. 1A by restoring force resulting from the spring property of the movable member 31 itself and the negative pressure due to the contraction of the bubble 40. Upon collapse of the bubble the liquid flows into the bubble generation region 11 in order to compensate for the volume reduction of the bubble and in order to compensate for the volume of the liquid discharged, as indicated by the flows $V_{D1}$, $V_{D2}$ from the upstream side (B) or the common liquid chamber 13 side and by the flow $V_C$ from the discharge opening 18 side.

The foregoing explained the operation of the movable member with generation of the bubble and the discharging operation of the liquid, and then the following explains refilling of the liquid in the liquid discharging head of the present invention.

The liquid supply mechanism in the present invention will be described in further detail with reference to FIGS. 1A to 1D.

After FIG. 1C, the bubble 40 experiences a state of the maximum volume and then enters a bubble collapsing process. In the bubble collapsing process, the volume of the liquid enough to compensate for the volume of the bubble having collapsed flows into the bubble generation region 11 from the discharge opening 18 side of the first liquid flow path 14 and from the side of the common liquid chamber 13 of the second liquid flow path 16. In the case of the conventional liquid flow path structure having no movable member 31, amounts of the liquid flowing from the discharge opening side and from the common liquid chamber into the bubble collapsing position depend upon magnitudes of flow resistances in the portions closer to the discharge opening and closer to the common liquid chamber than the bubble generation region (which are based on resistances of flow paths and inertia of the liquid).

If the flow resistance is smaller on the side near the discharge opening, the liquid flows more into the bubble collapsing position from the discharge opening side so as to increase an amount of retraction of meniscus. Particularly, as the flow resistance near the discharge opening is decreased so as to raise the discharge efficiency, the retraction of meniscus M becomes greater upon collapse of bubble and the period of refilling time becomes longer, thus becoming a hindrance against high-speed printing.

In contrast with it, because the structure of this embodiment includes the movable member 31, the retraction of meniscus stops when the movable member 31 returns to the initial position upon collapse of bubble; and thereafter the supply of the liquid for the remaining volume of W2 mainly relies on the liquid supply from the flow $V_{D2}$ through the second flow path 16, where the volume W of the bubble is split into the upper volume W1 beyond the first position of the movable member 31 and the lower volume W2 on the side of the bubble generation region 11. The retraction of meniscus appeared in the volume equivalent to approximately a half of the volume W of bubble in the conventional structure, whereas the above structure enabled to reduce the retraction of meniscus to a smaller volume, specifically, to approximately a half of W1.

Additionally, the liquid supply for the volume W2 can be forced, using the pressure upon collapse of bubble, along the surface of the movable member 31 on the heat generating member side and mainly from the upstream side ($V_{D2}$) of the second liquid flow path, thus realizing faster refilling.

A characteristic point here is as follows: if refilling is carried out using the pressure upon collapse of bubble in the conventional head, vibration of meniscus will be so great as to result in deteriorating the quality of image; whereas, refilling in the structure of this embodiment can decrease the vibration of meniscus to an extremely low level, because the movable member 31 restricts the flow of the liquid in the region of the first liquid flow path 14 on the discharge opening 18 side and in the region on the discharge opening 18 side of the bubble generation region 11.

In this way the present invention achieves the forced refilling of the liquid into the bubble generation region through the liquid supply path 12 of the second flow path 16 and the suppression of the retraction and vibration of meniscus as discussed above, so as to perform high-speed refilling, whereby it can realize stable discharge and high-speed repetitive discharges and it can also realize an improvement in quality of image and high-speed recording when employed in applications in the field of recording.

The structure of the present invention is also provided with a further effective function as follows.

It is to suppress propagation of the pressure raised by generation of bubble to the upstream side (the back wave). The most of the pressure of the bubble on the side of the common liquid chamber 13 (or on the upstream side) in the bubble generated above the heat generating member 2 conventionally became the force to push the liquid back to the upstream side (which is the back wave). This back wave raised the upstream pressure and the liquid moving amount thereby and caused inertial force due to movement of the liquid, which degraded the refilling of the liquid into the liquid flow path and also hindered high-speed driving.

In the present invention, first, the movable member 31 is provided and then in the movable member 31 the space to the element substrate 1 is higher on the common liquid chamber 13 side than in the bubble generation region 11, whereby the aforementioned actions to the upstream side can be suppressed, which further improves the refilling performance.

Next explained are further characteristic structures and effects of the present embodiment.

The second liquid flow path 16 of the present embodiment has the liquid supply path 12 having an internal wall, which is substantially flatly continuous from the heat generating member 2 (which means that the surface of the heat generating member is not stepped down too much), on the upstream side of the heat generating member 2. In this case, the liquid is supplied to the bubble generation region 11 and the surface of the heat generating member 2 along the surface of the movable member 31 near the bubble generation region 11, as indicated by $V_{D2}$. This suppresses stagnation of the liquid above the surface of the heat generating member 2 and easily removes the so-called residual bubbles which are separated out from the gas dissolved in the liquid or which remain without being collapsed. Further, the heat is prevented from accumulating in the liquid. Accordingly, stabler generation of bubble can be repeated at high speed. Although the present embodiment was explained with the liquid supply path 12 having the substantially flat internal wall, without having to be limited to this, the liquid supply path may be any path with a gently sloping internal wall smoothly connected to the surface of the heat generating member 2 as long as it is shaped so as not to cause stagnation of the liquid above the heat generating member 2 or great turbulent flow in the supply of liquid.

There occurs some supply of the liquid into the bubble generation region 11 in $V_{D1}$ through the side of the movable member 31 (through the slit 35). In order to guide the pressure upon generation of bubble more effectively to the discharge opening 18, such a movable member 31 as to cover the whole of the bubble generation region 11 (as to cover the surface of the heat generating member), as shown in FIGS. 1A to 1D, may be employed. If the arrangement in that case is such that when the movable member 31 returns to the first position, the flow resistance of the liquid is greater in the bubble generation region 11 and in the region near the discharge opening 18 of the first liquid flow path 14, the liquid will be restricted from flowing in $V_{D1}$ toward the bubble generation region 11 as described above. Since the head structure of the present invention secures the flow $V_{D2}$ for supplying the liquid to the bubble generation region 11, it has very high supply performance of the liquid. Thus, the supply performance of the liquid can be maintained even in the structure with improved discharge efficiency in which the movable member 31 covers the bubble generation region 11.

Figure 5:
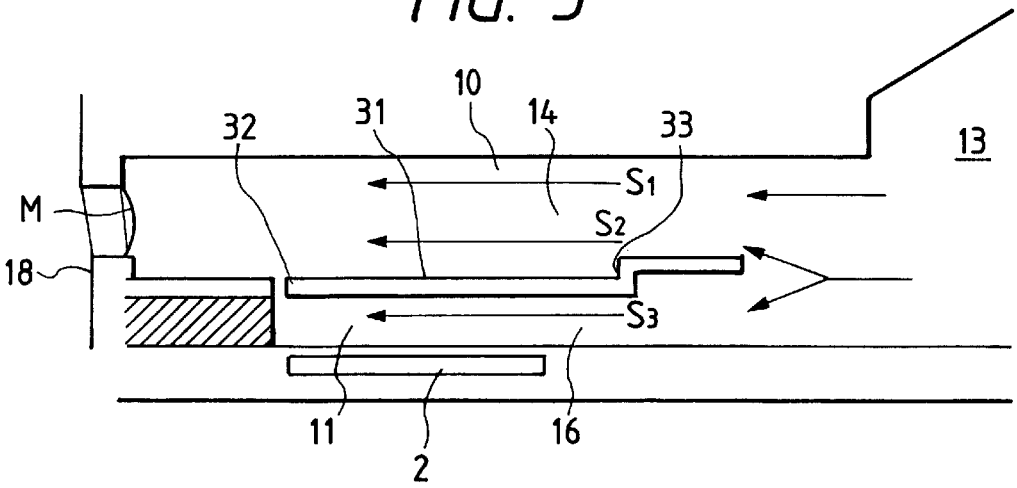
FIG. 5 is a schematic diagram for explaining the flow of liquid in the present invention.

FIG. 5 is a schematic view for explaining the flow of the liquid in the present invention.

The positional relation between the free end 32 and the fulcrum 33 of the movable member 31 is defined in such a manner that the free end 32 is located downstream relative to the fulcrum, for example as shown in FIG. 5. This structure can efficiently realize the function and effect to guide the pressure propagation directions and the growing directions of the bubble to the discharge opening 18 upon generation of bubble, as discussed previously. Further, this positional relation achieves not only the function and effect for discharge, but also the effect of high-speed refilling as decreasing the flow resistance against the liquid flowing in the liquid flow path 10 upon supply of liquid. This is because, as shown in FIG. 5, the free end 32 and fulcrum 33 are positioned so as not to resist the flows S1, S2, S3 in the liquid flow path 10 (including the first liquid flow path 14 and the second liquid flow path 16) when the meniscus M at a retracted position after discharge returns to the discharge opening 18 because of the capillary force or when the liquid is supplied to compensate for the collapse of bubble.

Explaining in further detail, in FIGS. 1A to 1D of the present embodiment the movable member 31 extends relative to the heat generating member 2 so that the free end 32 thereof is opposed thereto at a downstream position with respect to the area center 3 (the line passing through the center of the area of the heat generating member (through the central portion) and being perpendicular to the lengthwise direction of the liquid flow path), which separates the heat generating member 2 into the upstream region and the downstream region, as described previously. This arrangement causes the movable member 31 to receive the pressure or the bubble 40 occurring downstream of the area center position 3 of the heat generating member and greatly contributing to the discharge of liquid and to guide the pressure and bubble toward the discharge opening 18, thus fundamentally improving the discharge efficiency and the discharge force.

Further, many effects are attained by also utilizing the above-stated upstream portion of the bubble 40 in addition.

It is presumed that effective contribution to the discharge of liquid also results from instantaneous mechanical displacement of the free end of the movable member 31 in the structure of the present embodiment.

Since the present embodiment is arranged so that the space between the movable member and the element substrate is larger on the common liquid chamber side than in the bubble generation region, the flow resistance becomes small when the liquid flows into the bubble generation region upon collapse of bubble, so that the present embodiment can realize high-speed supply of liquid.

(Second Embodiment)

Figure 6:
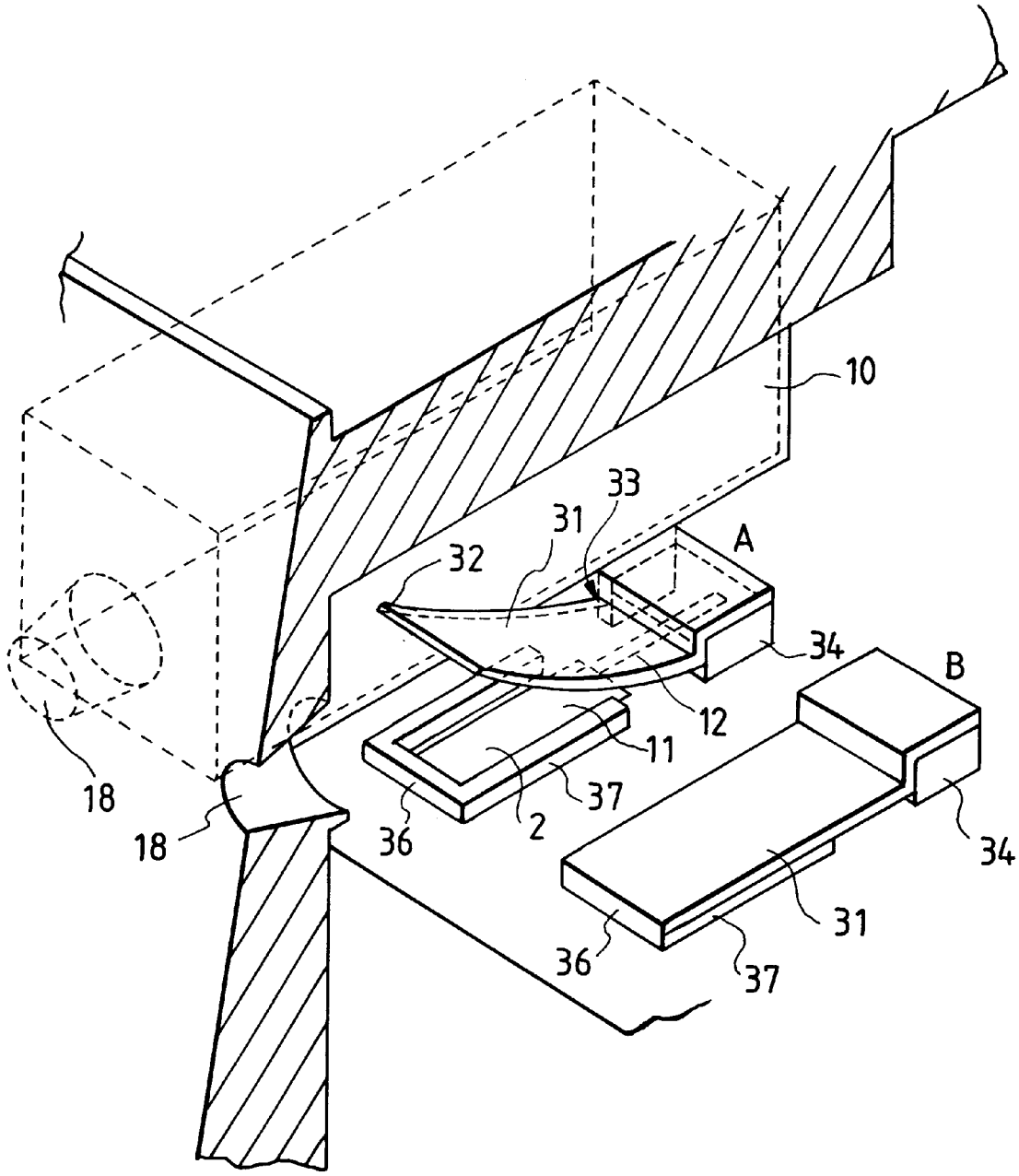
FIG. 6 is a perspective view, partly broken, of a liquid discharging head in the second embodiment of the present invention.

FIG. 6 is a perspective view, partly broken, of a liquid discharging head in the second embodiment of the present invention.

In FIG. 6, letter A indicates a displaced state of the movable member 31 (without illustration of the bubble) and letter B a state wherein the movable member 31 is at the initial position (the first position). This state of B is defined as the substantially sealed state of the bubble generation region 11 with respect to the discharge opening 18 (in this example, there is a flow path wall between A and B to separate the flow paths from each other, though not illustrated).

In FIG. 6 the movable member 31 is provided with two bases 34 on its sides and a liquid supply path 12 is defined between them. This allows the liquid to be supplied along the heat-generating-member-2-side surface of the movable member 31 and through the liquid supply path having a surface substantially flatly or gently connected with the surface of the heat generating member 2.

Here, when the movable member 31 is at the initial position (the first position), the movable member 31 is located in the proximity of or in contact with heat-generating-member downstream wall 36 and heat-generating-member side walls 37 disposed downstream and beside of the heat generating member 2, thereby substantially being closed hermetically on the discharge opening 18 side of the bubble generation region 11. This prevents the pressure of the bubble upon generation of bubble, especially, the downstream pressure of the bubble from escaping, whereby the pressure can act as concentrated on the free end side of the movable member 31.

Upon collapse of bubble the movable member 31 returns to the first position to achieve the substantially sealed state of the bubble generation region 11 on the discharge opening 18 side during the liquid supply upon collapse of bubble to above the heat generating member 2, which achieves the various effects including the suppression of retraction of meniscus, etc. as described in the previous embodiment. As for the effect concerning refilling, the same function and effect as in the previous embodiment can be achieved. Especially, by the arrangement wherein the space between the movable member 31 and the element substrate 1 is larger on the common liquid chamber side than in the bubble generation region, the flow resistance can be made small when the liquid flows into the bubble generation region upon collapse of bubble, thereby realizing high-speed supply of liquid.

In the present embodiment, as shown in FIG. 2 and FIG. 6, the aforementioned supply of the liquid to the liquid supply path 12 is achieved by providing the bases 34 for stationarily supporting the movable member 31 upstream away from the heat generating member 2 and by making the width of the bases 34 smaller than the width of the liquid flow path 10. The shape of the bases 34 does not have to be limited to this, but may be any shape that can permit smooth refilling.

The present embodiment is arranged so that the space between the movable member 31 and the heat generating member 2 is approximately 15 $\mu$m, but the space may be determined within the range wherein the pressure based on the generation of bubble can be transferred sufficiently to the movable member.

(Third Embodiment)

Figure 7:
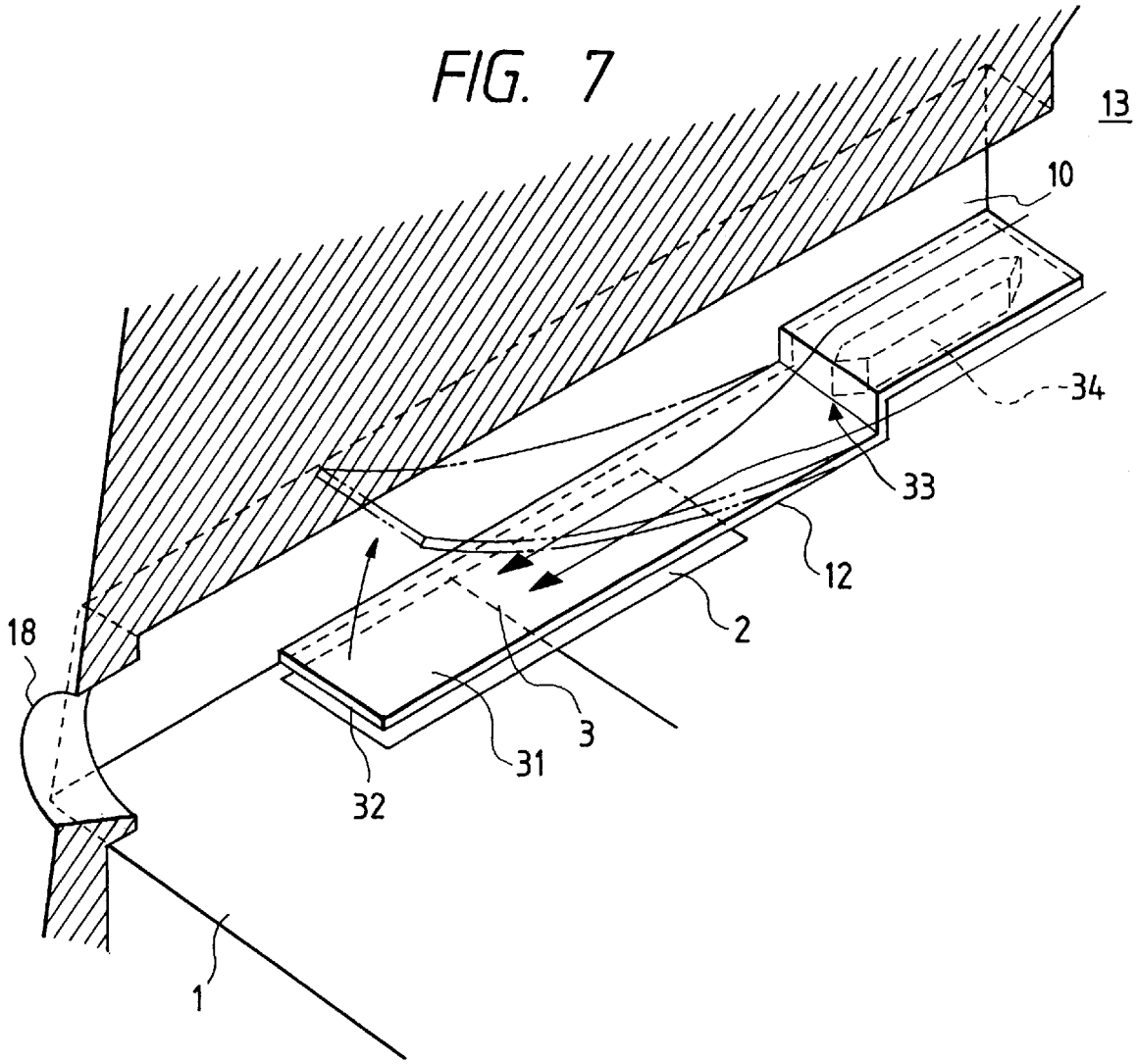
FIG. 7 is a perspective view, partly broken, of a liquid discharging head in the third embodiment of the present invention.

FIG. 7 is a perspective view, partly broken, of a liquid discharging head in the third embodiment of the present invention.

FIG. 7 is a drawing to show a positional relation among the bubble generation region in one liquid flow path, the bubble generated therein, and the movable member 31, which is an illustration for easier understanding of the liquid discharging method and the refilling method of the present invention.

Many of the foregoing embodiments achieved the movement of bubble as concentrated on the discharge opening 18 side at the same time as the quick movement of the movable member 31, by concentrating the pressure of the bubble generated, on the free end of the movable member 31.

In contrast with it, the present embodiment is arranged to regulate the downstream portion of the bubble, which is the discharge-opening-18-side portion of the bubble directly acting on discharge of droplet, by the free end side of the movable member 31, while giving the generated bubble freedom.

Describing it by the structure, in FIG. 7, when compared with foregoing FIG. 2 (the first embodiment), the present embodiment does not have the projection (the hatched portion in the figure) as a barrier located at the downstream end of the bubble generation region defined above the element substrate 1 of FIG. 2. Namely, the free end region and the both-side edge regions of the movable member 31 are open without substantially sealing the bubble generation region with respect to the discharge opening region, which is the structure of the present embodiment.

In the present embodiment growth of bubble is permitted at the downstream tip portion in the downstream portion directly acting on the discharge of droplet of bubble, and the pressure components thereat are effectively utilized for discharge accordingly. In addition, the free-end-side portion of the movable member 31 acts so as to add at least the pressure components of the downstream portion (the fractions of $V_2$, $V_3$, $V_4$ of FIG. 3) propagating upward to the growth of bubble in this downstream tip portion, which increases the discharge efficiency as in the above-stated embodiments. When compared with the foregoing embodiments, the present embodiment is excellent in responsivity to drive of heat generating member 2.

In addition, the present embodiment has advantages in fabrication because of its structural simplicity.

In the present embodiment the fulcrum portion of the movable member 31 is fixed to one base 34 having a width smaller than that of the surface portion of the movable member 31. Accordingly, the liquid is supplied through the both sides of this base to the bubble generation region 11 upon collapse of bubble (see the arrows in the figure). This base may be of any structure that can assure the liquid supply performance.

By the arrangement wherein the space between the movable member 31 and the element substrate 1 is greater on the common liquid chamber side than in the bubble generation region, the flow resistance becomes small when the liquid flows into the bubble generation region upon collapse of bubble, thereby realizing the high-speed supply of liquid.

Since in the case of the present embodiment presence of the movable member 31 controls the flow of liquid into the bubble generation region from upstream with collapse of bubble, refilling upon supply of liquid in the present embodiment is more excellent than in the conventional bubble generation structure of only the heat generating member. Of course, this can also reduce an amount of retraction of meniscus.

A preferred modification of the present embodiment is arranged to keep only the both side edges (or either one thereof) against the free end of the movable member 31, in the substantially sealed state with respect to the bubble generation region 11. With this structure, the discharge efficiency is improved furthermore, because the pressure directed to the sides of the movable member 31 can also be utilized as converted to the growth of the discharge-opening-18-side edge portion of the bubble described previously.

(Fourth Embodiment)

The present embodiment describes an example with further increased discharge force of liquid by the mechanical displacement described above.

Figure 8:
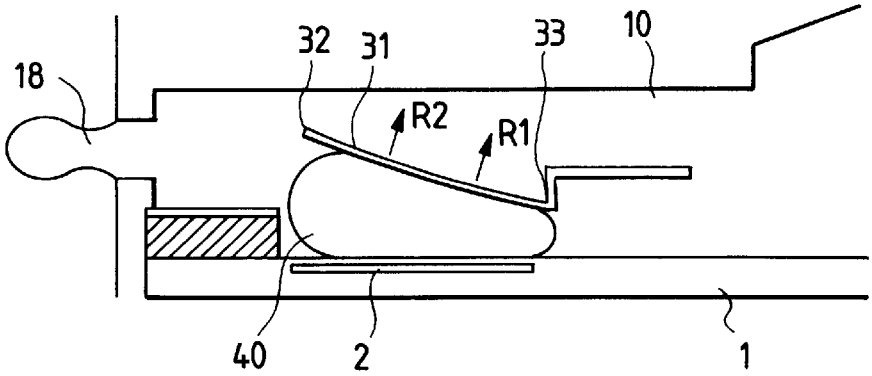
FIG. 8 is a cross-sectional view of a liquid discharging head in the fourth embodiment of the present invention.

FIG. 8 is a cross-sectional view of a liquid discharging head in the fourth embodiment of the present invention.

In FIG. 8, the movable member 31 extends so that the position of the free end 32 of the movable member 31 is located further downstream of the heat generating member 2. This can increase the displacement speed of the movable member 31 at the position of the free end 32, thereby further enhancing the generation of discharge force by the displacement of the movable member 31.

Since the free end 32 becomes closer to the discharge opening 18 than in the preceding embodiments, the growth of bubble 40 can be concentrated to grow stabler direction components, thereby permitting more excellent discharge.

The movable member 31 is displaced at displacement speed R1 in accordance with the bubble growth speed of the pressure center portion of bubble 40, but the free end 32 more distant from the fulcrum 33 than this position is displaced at faster speed R2. This makes the free end 32 mechanically act on the liquid at the higher speed to cause movement of the liquid, thereby enhancing the discharge efficiency.

The shape of the free end is perpendicular to the flow of liquid in the same manner as in FIG. 7, which can make the pressure of bubble 40 and the mechanical action of movable member 31 contribute to the discharge more efficiently.

By the arrangement wherein the space between the movable member 31 and the element substrate 1 is greater on the common liquid chamber side than in the bubble generation region, the flow resistance becomes small when the liquid flows into the bubble generation region upon collapse of bubble, thereby realizing the high-speed supply of liquid.

(Fifth Embodiment)

In the present embodiment the principal discharge principle of liquid is also the same as in the foregoing embodiments, but the present embodiment employs the double-flow-path structure of liquid flow path, thereby enabling to separate the liquid (bubble generation liquid) for forming the bubble by application of heat thereto, from the liquid (discharge liquid) to be discharged mainly.

Figure 9:
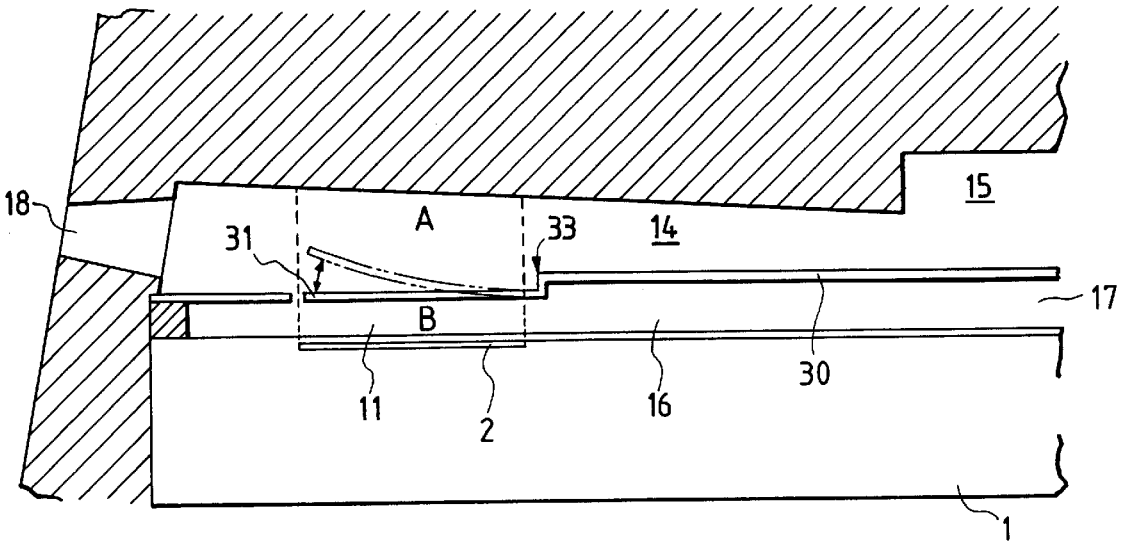
FIG. 9 is a cross-sectional view of a liquid discharging head (of the two-flow-path type) in the fifth embodiment of the present invention.
Figure 10:
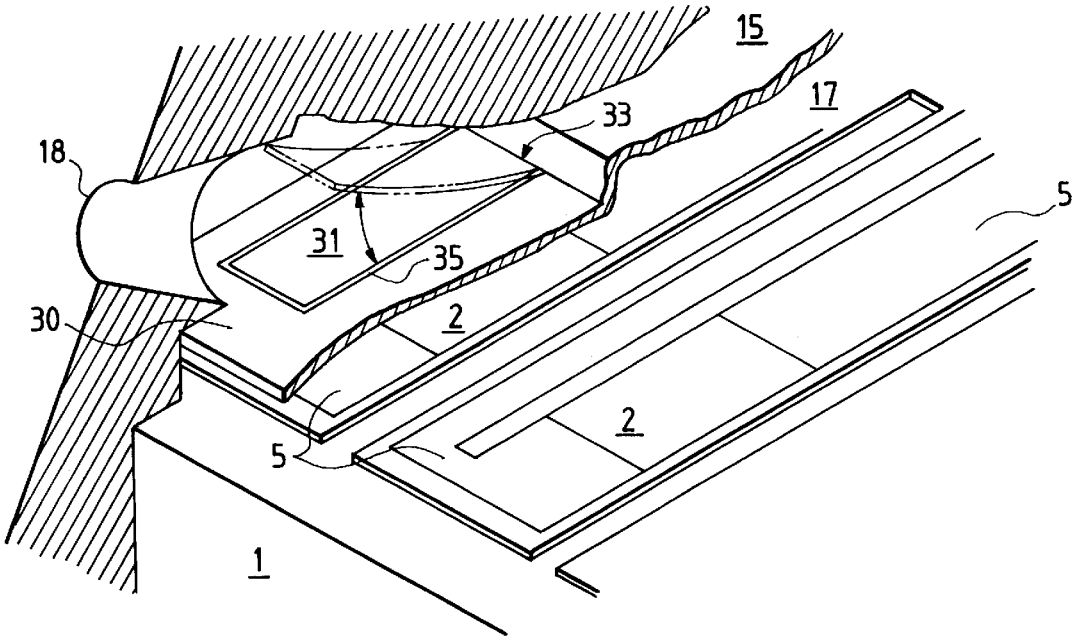
FIG. 10 is a perspective view, partly broken, of the liquid discharging head in the fifth embodiment of the present invention.

FIG. 9 is a cross-sectional view of a liquid discharging head in the fifth embodiment of the present invention and FIG. 10 is a perspective view, partly broken, of the liquid discharging head in the fifth embodiment of the present invention.

The liquid discharging head of the present embodiment has second liquid flow paths 16 for generation of bubble above the element substrate 1 in which heat generating members 2 for supplying thermal energy for generating the bubble in the liquid are provided, and first liquid flow paths 14 for discharge liquid in direct communication with associated discharge openings 18 above the second liquid flow paths.

The upstream side of the first liquid flow paths 14 is in communication with first common liquid chamber 15 for supplying the discharge liquid to the plural first liquid flow paths 14 and the upstream side of the second liquid flow paths 16 is in communication with second common liquid chamber 17 for supplying the bubble generation liquid to the plural second liquid flow paths 16.

However, if the bubble generation liquid and the discharge liquid are a same liquid, one common liquid chamber can be shared.

Partition wall 30 made of a material having elasticity, such as metal, is disposed between the first and second liquid flow paths, thereby separating the first liquid flow paths 14 from the second liquid flow paths 16. In the case of the bubble generation liquid and the discharge liquid being liquids that are preferably kept from mixing with each other as much as possible, it is better to avoid mutual communication of the liquids in the first liquid flow paths 14 and in the second liquid flow paths 16 as completely as possible by the partition wall 30; in the case of the bubble generation liquid and the discharge liquid being liquids that raise no problem even with some mixture thereof, the partition wall 30 does not have to be provided with the function of complete separation.

The partition wall 30 in the portion located in the upward projection space of the surface of heat generating member 2 (which will be referred to as a discharge pressure generating region; the region of A and the bubble generation region 11 of B in FIG. 9) constitutes the movable member 31 of a cantilever shape defined by slit 35 and having the free end on the discharge opening 18 side (on the downstream side of the flow of liquid) and the fulcrum 33 on the common liquid chamber (15, 17) side. The fulcrum 33 is at the root of slit 35. Since this movable member 31 is positioned so as to face the bubble generation region 11 (B), it operates to open toward the discharge opening 18 on the first liquid flow path 14 side with generation of bubble in the bubble generation liquid (as indicated by the arrow in the figure). Also in FIG. 10, the partition wall 30 is located, with intervention of the spaces constituting the second liquid flow paths 16, above the element substrate 1 in which heating resistor portions as heat generating members 2 and wiring electrodes 5 for applying an electric signal to the heating resistor portions are provided.

The relation between the locations of the fulcrum 33 and the free end 32 of the movable member 31 and the location of the heat generating member 2 is the same as in the previous embodiments. Particularly, by the arrangement wherein the height of the movable member is greater on the second common liquid chamber 17 side than that facing the flow path area including the bubble generation region, the flow resistance becomes small when the liquid flows into the bubble generation region upon collapse of bubble, thereby realizing the high-speed supply of liquid.

The structural relation between the liquid supply path 12 and the heat generating member 2 was described in the previous embodiment, and the present embodiment is also arranged so that the structural relation between the second liquid flow path 16 and the heat generating member 2 is the same.

Next described is the operation of the liquid discharging head according to the present embodiment.

Figure 11A:
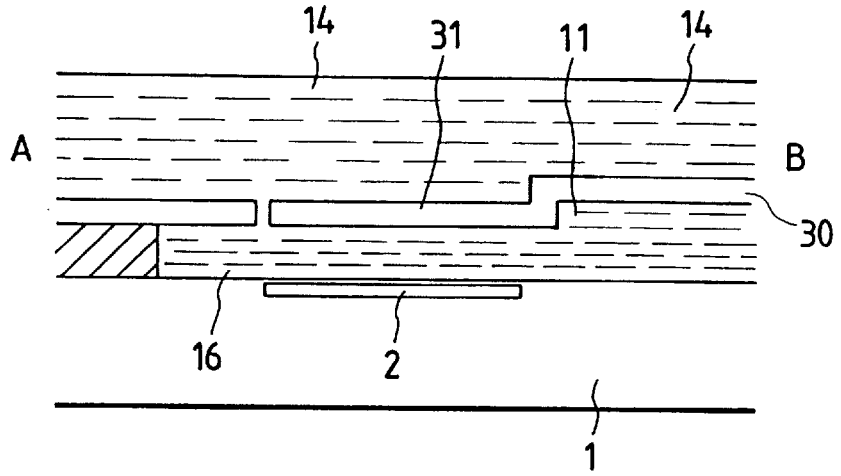
FIGS. 11A and 11B are drawings for explaining the operation of the movable member.
Figure 11B:
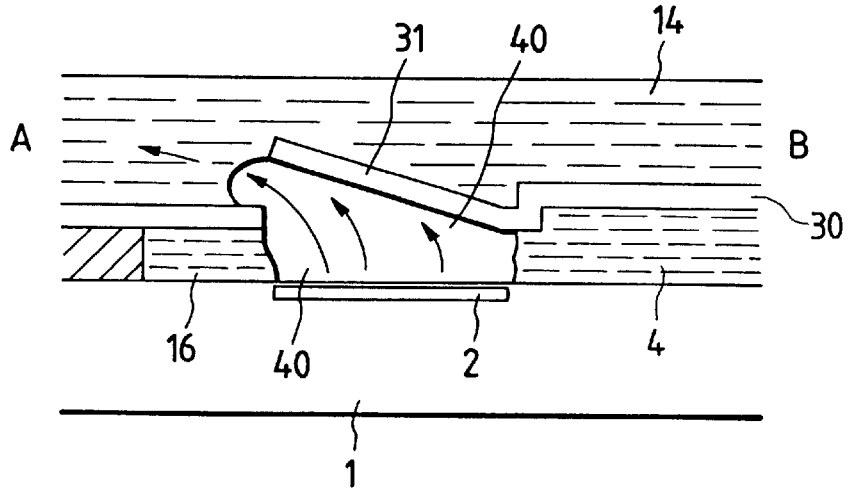

FIGS. 11A and 11B are drawings for explaining the operation of the movable member.

For driving the head, it was operated using identical water-based ink as the discharge liquid to be supplied to the first liquid flow paths 14 and as the bubble generation liquid to be supplied to the second liquid flow paths 16.

Heat generated by the heat generating member 2 acts on the bubble generation liquid in the bubble generation region of the second liquid flow path 16, whereby bubble 40 is generated in the bubble generation liquid in the same way as described in the previous embodiment, based on the film boiling phenomenon as described in U.S. Pat. No. 4,723,129.

Since the present embodiment is arranged to prevent the bubble generation pressure from escaping in the three directions except toward the upstream side of the bubble generation region 11, the pressure with generation of this bubble propagates as concentrated on the movable member 31 located in the discharge pressure generating region, so that with growth of bubble 40 the movable member 31 is displaced into the first liquid flow path 14 side from the state of FIG. 11A and FIG. 11B. This operation of the movable member 31 makes the first liquid flow path 14 go into wide communication with the second liquid flow path 16, whereby the pressure based on the generation of bubble 40 is transferred mainly in the direction toward the discharge opening (toward A). This propagation of pressure and the aforementioned mechanical displacement of the movable member 31 cause the liquid to be discharged through the discharge opening.

Next, with contraction of the bubble the movable member 31 returns to the position of FIG. 11A and the discharge liquid is supplied from upstream by an amount equivalent to a discharged amount of the discharge liquid in the first liquid flow path 14. Also in the present embodiment, since this supply of the discharge liquid is effected with the movable member 31 closing in the same manner as in the foregoing embodiments, the refilling of the discharge liquid is not impeded by the movable member 31. By the arrangement wherein the space between the movable member 31 and the element substrate 1 is greater on the common liquid chamber side than in the bubble generation region, the flow resistance becomes small when the liquid flows into the bubble generation region upon collapse of bubble, thereby realizing the high-speed supply of liquid.

The present embodiment achieves the same actions and effects of the main components as to the propagation of the bubble generation pressure with displacement of the movable member 31, the growing directions of bubble, the prevention of the back wave, and so on as the foregoing first embodiment etc. did, but the present embodiment further has the following advantages because of the two-flow-path structure thereof.

Specifically, the above-stated structure of the embodiment permits different liquids to be used as the discharge liquid and as the bubble generation liquid, whereby the discharge liquid can be discharged by the pressure caused by the generation of bubble in the bubble generation liquid. Therefore, even a high-viscosity liquid, for example, polyethylene glycol that was insufficient in generation of bubble with application of heat and insufficient in discharge force heretofore, can be discharged well by supplying a well-bubbling liquid (a mixture of ethanol:water=4:6 having the viscosity of 1 to 2 cP or the like) or a low-boiling-point liquid as the bubble generation liquid to the second liquid flow path 16.

When a liquid not forming the deposits of scorching or the like on the surface of the heat generating member with reception of heat is selected as the bubble generation liquid, the generation of bubble can be stabilized and good discharge can be achieved.

Further, the structure of the head of the present invention also has the effects as described in the previous embodiments, whereby the liquid such as the high-viscosity liquid can be discharged at higher discharge efficiency and higher discharge force.

Even in the case of a liquid weak against heat, the liquid weak against heat can be discharged without thermal damage and at high discharge efficiency and high discharge force as described above, by supplying the liquid weak against heat as the discharge liquid to the first liquid flow path 14 and supplying a well-bubbling liquid resistant against thermal modification to the second liquid flow path 16.

(Other Embodiments)

In the foregoing, the description has been made as to the embodiments of the major parts of the liquid discharging head and the liquid discharging method according to the present invention, and specific examples preferably applicable to these embodiments will be explained with reference to the drawings. Although each of the following examples will be explained as either an embodiment of the single-flow-path type or an embodiment of the two-flow-path type described previously, it should be noted that they can be applied to the both types unless otherwise stated.

<Ceiling configuration of liquid flow path>

Figure 12:
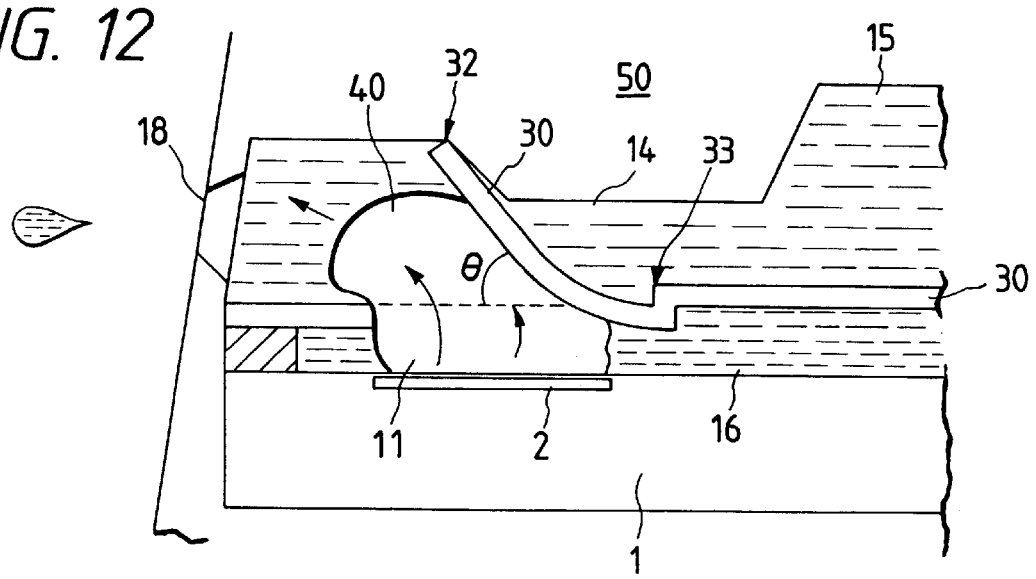
FIG. 12 is a drawing for explaining the structure of the movable member and the first liquid flow path.

FIG. 12 is a drawing for explaining the structure of the movable member and the first liquid flow path.

As shown in FIG. 12, a grooved member 50 provided with grooves for constituting the first liquid flow paths 13 (or the liquid flow paths 10 in FIGS. 1A to 1D) is provided on a partition wall 30. In the present embodiment, the height of the flow path ceiling near the position of the free end 32 of the movable member is increased so as to secure a greater operation angle θ of the movable member. The moving range of this movable member may be determined in consideration of the structure of the liquid flow path, the durability of the movable member, and the bubble generating power, or the like, and the movable member is considered to desirably move up to an angle including an axial angle of the discharge opening.

As shown in this figure, the height of displacement of the free end of the movable member is made higher than the diameter of the discharge opening, whereby transmission of more sufficient discharge force can be achieved. Since the height of the ceiling of the liquid flow path at the position of fulcrum 33 of the movable member is lower than the height of the ceiling of liquid flow path at the position of the free end 32 of the movable member as shown in this figure, the pressure wave can be prevented more effectively from escaping to the upstream side with displacement of the movable member.

<Positional relation between second liquid flow path and movable member>

Figure 13A:
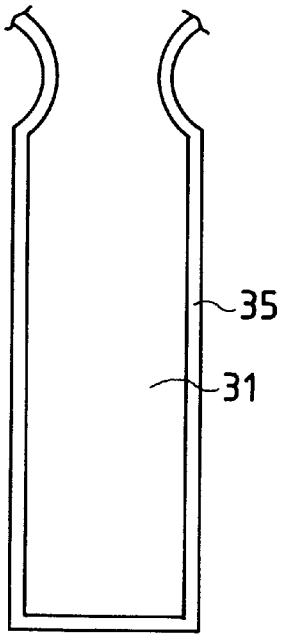
FIGS. 13A, 13B and 13C are drawings for explaining the structure of the movable member and the liquid flow path.
Figure 13B:
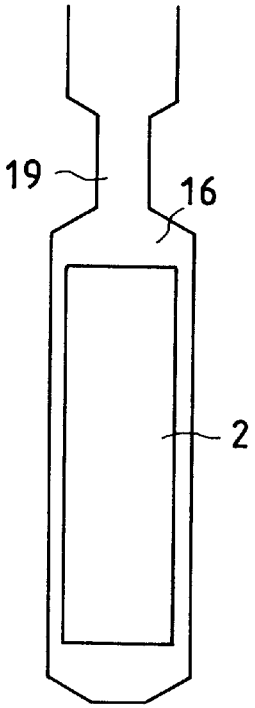
Figure 13C:
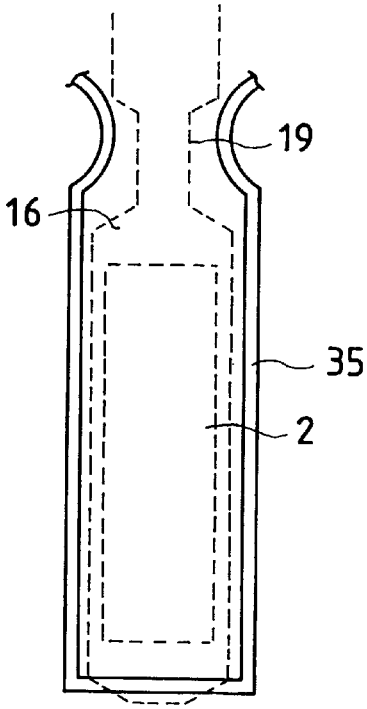

FIGS. 13A to 13C are drawings for explaining the structure of the movable member and the liquid flow path, wherein FIG. 13A is a top plan view of the partition wall 30, the movable member 31, and their neighborings, FIG. 13B a top plan view of the second liquid flow path 16 when the partition wall 30 is taken away, and FIG. 13C a drawing to schematically show the positional relation between the movable member 31 and the second liquid flow path 16 as overlaid. In either drawing, the bottom side is the front side where the discharge opening is positioned.

The second liquid flow path 16 of the present embodiment has throat portion 19 on the upstream side of the heat generating member 2 (the upstream side herein means the upstream side in the large flow from the second common liquid chamber via the position of the heat generating member, the movable member, and the first flow path to the discharge opening), thereby forming such a chamber (bubble generation chamber) structure that the pressure upon generation of bubble can be prevented from readily escaping to the upstream side of the second liquid flow path 16.

In the case of the convention head wherein the flow path for the bubble generation and the flow path for discharge of the liquid were common, when a throat portion was provided so as to prevent the pressure occurring on the liquid chamber side of the heat generating member from escaping into the common liquid chamber, the head was needed to employ such a structure as the cross-sectional area of flow path in the throat portion was not too small, taking sufficient refilling of the liquid into consideration.

However, in the case of this embodiment, much or most of the discharged liquid is the discharge liquid in the first liquid flow path, and the bubble generation liquid in the second liquid flow path having the heat generating member is not consumed much, so that the filling amount of the bubble generation liquid to the bubble generation region 11 of the second liquid flow path may be small. Therefore, the clearance at the above-stated throat portion 19 can be made very small, for example, as small as several μm to ten and several μm, so that the release of the pressure produced in the second liquid flow path upon generation of bubble can be further suppressed and the pressure may be concentrated onto the movable member. The pressure can thus be used as the discharge force through the movable member 31, and therefore, the higher discharge efficiency and discharge force can be accomplished. The configuration of the second liquid flow path 16 is not limited to the one described above, but may be any configuration if the pressure produced by the bubble generation is effectively transmitted to the movable member side.

As shown in FIG. 13C, the sides of the movable member 31 cover respective parts of the walls constituting the second liquid flow path, which can prevent the movable member 31 from falling into the second liquid flow path. This can further enhance the separation between the discharge liquid and the bubble generation liquid described previously. In addition, this arrangement can suppress escape of the bubble through the slit, thereby further increasing the discharge pressure and discharge efficiency. Further, it can enhance the aforementioned refilling effect from the upstream side by the pressure upon collapse of bubble.

In FIG. 11B and FIG. 12, a part of the bubble generated in the bubble generation region of the second liquid flow path 16 with displacement of the movable member 31 into the first liquid flow path 14 extends in the first liquid flow path 14, and by determining the height of the second liquid flow path so as to permit the bubble to extend in this way, the discharge force can be improved furthermore than in the case of the bubble not extending in such a way. In order to permit the bubble to extend in the first liquid flow path 14 as described, the height of the second liquid flow path 16 is determined to be preferably lower than the height of the maximum bubble and, specifically, the height of the second liquid flow path 16 is determined preferably in the range of several μm to 30 μm. In the present embodiment this height is 15 μm.

<Movable member and partition wall>

Figure 14A:
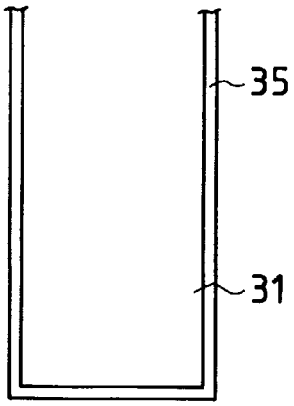
FIGS. 14A, 14B and 14C are drawings for explaining other shapes of the movable member.
Figure 14B:
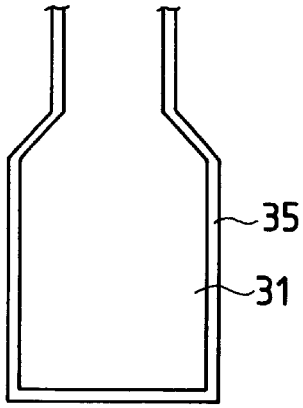
Figure 14C:
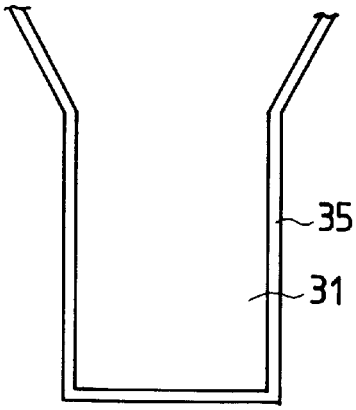

FIGS. 14A, 14B, and 14C are drawings to show other configurations of the movable member, wherein FIG. 14A is a drawing to illustrate a rectangular configuration, FIG. 14B a drawing to illustrate a configuration narrowed on the fulcrum side to facilitate the operation of the movable member, and FIG. 14C a drawing to illustrate a configuration widened on the fulcrum side to enhance the durability of the movable member.

In FIGS. 14A to 14C, reference numeral 35 designates the slit formed in the partition wall and this slit forms the movable member 31. A shape with ease to operate and high durability is desirably a configuration the fulcrum-side width of which is narrowed in an arcuate shape as shown in FIG. 13A, but the configuration of the movable member may be any configuration if it is kept from entering the second liquid flow path and if it is readily operable and excellent in the durability.

In the foregoing embodiment, the plate movable member 31 and the partition wall 30 having this movable member were made of nickel in the thickness of 5 μm, but, without having to be limited to this, the materials for the movable member and the partition wall may be selected from those having an anti-solvent property against the bubble generation liquid and the discharge liquid, having elasticity for assuring the satisfactory operation of the movable member, and permitting formation of fine slit.

Preferable examples of the material for the movable member include durable materials, for example, metals such as silver, nickel, gold, iron, titanium, aluminum, platinum, tantalum, stainless steel, or phosphor bronze, alloys thereof, resin materials, for example, those having the nitryl group such as acrylonitrile, butadiene, or styrene, those having the amide group such as polyamide, those having the carboxyl group such as polycarbonate, those having the aldehyde group such as polyacetal, those having the sulfone group such as polysulfone, those such as liquid crystal polymers, and chemical compounds thereof; and materials having durability against ink, for example, metals such as gold, tungsten, tantalum, nickel, stainless steel, titanium, alloys thereof, materials coated with such a metal, resin materials having the amide group such as polyamide, resin materials having the aldehyde group such as polyacetal, resin materials having the ketone group such as polyetheretherketone, resin materials having the imide group such as polyimide, resin materials having the hydroxyl group such as phenolic resins, resin materials having the ethyl group such as polyethylene, resin materials having the alkyl group such as polypropylene, resin materials having the epoxy group such as epoxy resins, resin materials having the amino group such as melamine resins, resin materials having the methylol group such as xylene resins, chemical compounds thereof, ceramic materials such as silicon dioxide, and chemical compounds thereof.

Preferable examples of the material for the partition wall include resin materials having high heat-resistance, a high anti-solvent property, and good moldability, typified by recent engineering plastics, such as polyethylene, polypropylene, polyamide, polyethylene terephthalate, melamine resins, phenolic resins, epoxy resins, polybutadiene, polyurethane, polyetheretherketone, polyether sulfone, polyallylate, polyimide, polysulfone, liquid crystal polymers (LCPs), chemical compounds thereof, silicon dioxide, silicon nitride, metals such as nickel, gold, or stainless steel, alloys thereof, chemical compounds thereof, or materials coated with titanium or gold.

The thickness of the partition wall may be determined depending upon the material and configuration from such standpoints as to achieve the strength as a partition wall and to well operate as a movable member, and a desirable range thereof is approximately between 0.5 μm and 10 μm.

The width of the slit 35 for forming the movable member 31 is determined to be 2 μm in the present embodiment. In the cases where the bubble generation liquid and the discharge liquid are mutually different liquids and mixture is desirably prevented between the two liquids, the slit width may be determined to be such a clearance as to form a meniscus between the two liquids so as to avoid communication between the two liquids. For example, when the bubble generation liquid is a liquid having the viscosity of about 2 cP (centipoises) and the discharge liquid is a liquid having the viscosity of 100 or more cP, a slit of approximately 5 μm is enough to prevent the mixture of the liquids, but a desirable slit is 3 or less μm.

In the present invention the movable member is intended to have a thickness of the μm order (t μm), but is not intended to have a thickness of the cm order. For the movable member in the thickness of the μm order, it is desirable to take account of the variations in fabrication to some extent when the slit width of the μm order (W μm) is targeted.

When the thickness of the member opposed to the free end or/and the side edges of the movable member forming the slit is equivalent to the thickness of the movable member (FIGS. 11A, 11B, FIG. 12, and so on), mixture of the bubble generation liquid and the discharge liquid can be suppressed stably by determining the relation between the slit width and thickness in the following range in consideration of manufacturing variations. As a designing viewpoint, in the case of high-viscosity ink (5 cP, 10 cP, or the like) being used against the bubble generation liquid with a viscosity of not more than 3 cP, though being a limited condition, when the condition of $W/t \leqq 1$ is satisfied, the mixture of the two liquids can be suppressed for a long term.

The slit of such several μm order makes it surer to accomplish the "substantially sealed state" in the present invention.

When the bubble generation liquid and the discharge liquid are separated functionally as described above, the movable member is a substantially separating member for separating them. When this movable member moves with generation of bubble, a small amount of the bubble generation liquid appears mixing into the discharge liquid. Considering that the discharge liquid for forming an image is usually one having the concentration of coloring material ranging approximately 3% to 5% in the case of the ink jet recording, a great change in the concentration will not be resulted even if the bubble generation liquid is contained in the range of 20 or less % in a droplet of the discharge liquid. Therefore, the present invention is intended to involve the mixture of the bubble generation liquid and the discharge liquid as long as the mixture is limited within 20% in the droplet of the discharge liquid.

In carrying out the above structural examples, the mixture was of the bubble generation liquid of at most 15% even with changes of viscosity, and in the case of the bubble generation liquids of 5 or less cP, the mixture rates were at most approximately 10%, though depending upon the driving frequency.

Particularly, as the viscosity of the discharge liquid is decreased below 20 cP, the mixture of the liquids can be decreased more (for example, down to 5% or less).

Next, the positional relation between the heat generating member and the movable member in this head will be described with reference to the drawing. It is, however, noted that the configuration, the size, and the number of the movable member and heat generating member are not limited to those described below. When the heat generating member and the movable member are arranged in the optimum arrangement, it becomes possible to effectively utilize the pressure upon bubble generation by the heat generating member, as the discharge pressure.

Figure 15:
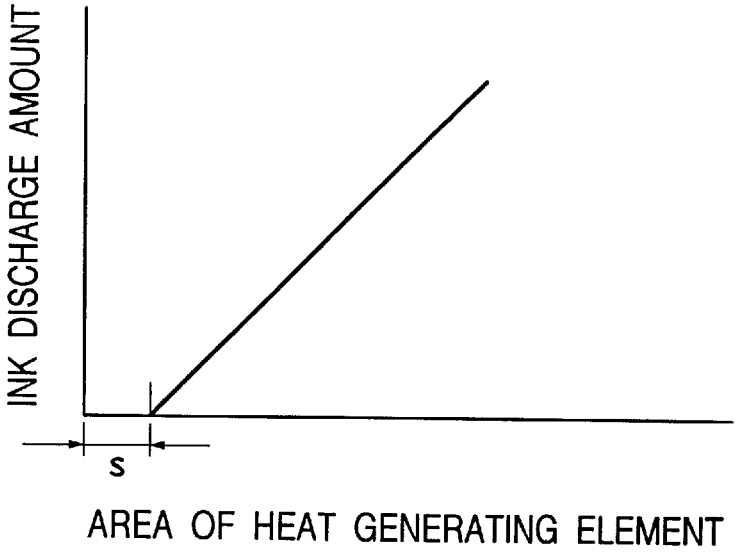
FIG. 15 is a diagram to show the relationship between area of heat generating member and ink discharge amount.

FIG. 15 is a drawing to show the relation between the area of the heat generating member and the discharge amount of ink.

In the conventional technology of the ink jet recording method, so called the bubble jet recording method, for applying energy of heat or the like to the ink to cause a state change accompanied by a quick volume change (generation of bubble) in the ink, discharging the ink through the discharge opening by the acting force based on this state change, and depositing the ink on the recorded medium, thereby forming an image thereon, the area of the heat generating member and the discharge amount of ink are in a proportional relation, but there exists a non-effective bubbling region S that does not contribute to discharge of ink, as shown in FIG. 15. It is also seen from the state of scorching on the heat generating member that this non-effective bubbling region S exists around the heat generating member. From these results, it is considered that the width of about 4 μm around the heat generating member is not involved in generation of bubble.

It can be, therefore, said that in order to effectively utilize the bubble generation pressure, an effective arrangement is such that the movable member is located so that the movable area of the movable member covers the area immediately above the effective bubbling region about 4 μm or more inside from the periphery of the heat generating member. In the present example the effective bubbling region is defined more than about 4 μm inside from the periphery of the heat generating member, but it is not limited to this, depending upon the type or a forming method of the heat generating member.

Figure 16A:
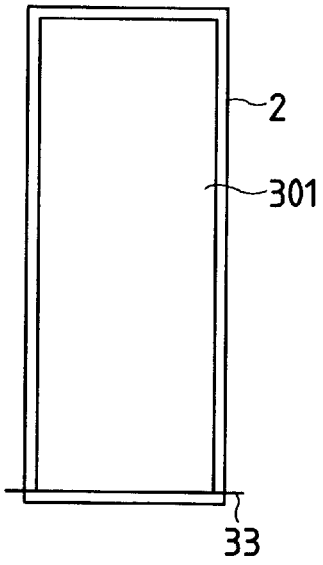
FIGS. 16A and 16B are drawings to show a positional relation between the movable member and the heat generating member.
Figure 16B:
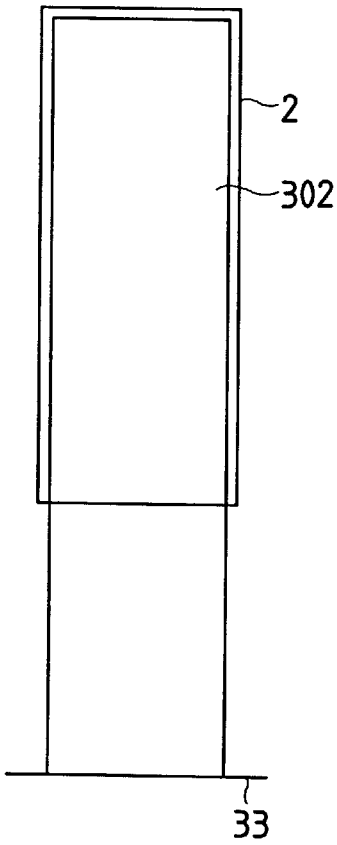

FIGS. 16A and 16B are drawings to show a positional relation between the movable member and heat generating member, which are schematic views as top plan views where the movable member 301 (FIG. 16A) or the movable member 302 (FIG. 16B), different in the total area of the movable region, is positioned relative to the heat generating member 2 of 58×150 μm.

The size of the movable member 301 is 53×145 μm, which is smaller than the area of the heat generating member 2 and which is the size almost equivalent to the effective bubbling region of the heat generating member 2. The movable member 301 is positioned so as to cover the effective bubbling region. On the other hand, the size of the movable member 302 is 53×220 μm, which is larger than the area of the heat generating member 2 (if the width is equal, the length between the fulcrum and the movable tip is longer than the length of the heat generating member), and the movable member 302 is positioned so as to cover the effective bubbling region as the movable member 301 was. With the above two types of movable members 301, 302, measurements were conducted as to the durability and discharge efficiency thereof. The measurement conditions were as follows.

Bubble generation liquid: 40% ethanol solution

Ink for discharge: dye ink

Voltage: 20.2 V

Frequency: 3 kHz

The results of experiments conducted under the above conditions showed that, as to the durability of movable member, (a) the movable member 301 had a damage at the fulcrum portion of the movable member 301 with application of $1\times10^7$ pulses and that (b) the movable member 302 had no damage even with application of $3\times10^8$ pulses. The experiment results also confirmed that the kinetic energy determined by the discharge amount and the discharge speed against the input energy was increased approximately 1.5 to 2.5 times.

It is seen from the above results that in view of the both durability and discharge efficiency the more excellent effect is achieved by the arrangement wherein the movable member is positioned so as to cover the area immediately above the effective bubbling region and wherein the area of the movable member is larger than the area of the bubble generating element.

Figure 17:
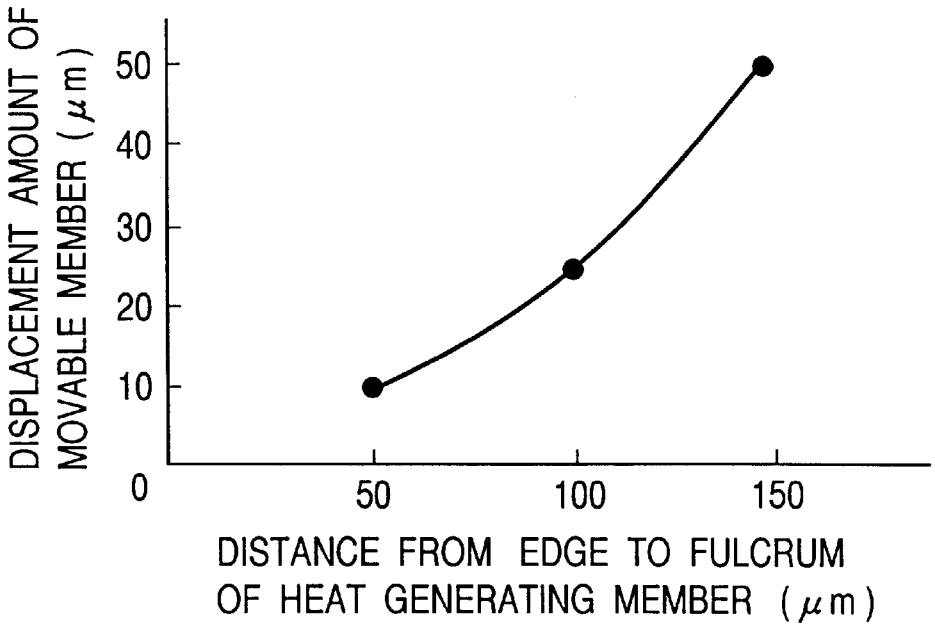
FIG. 17 is a diagram to show the relationship between distance from the edge to the fulcrum of the heat generating member and displacement amount of the movable member.
Figure 18:
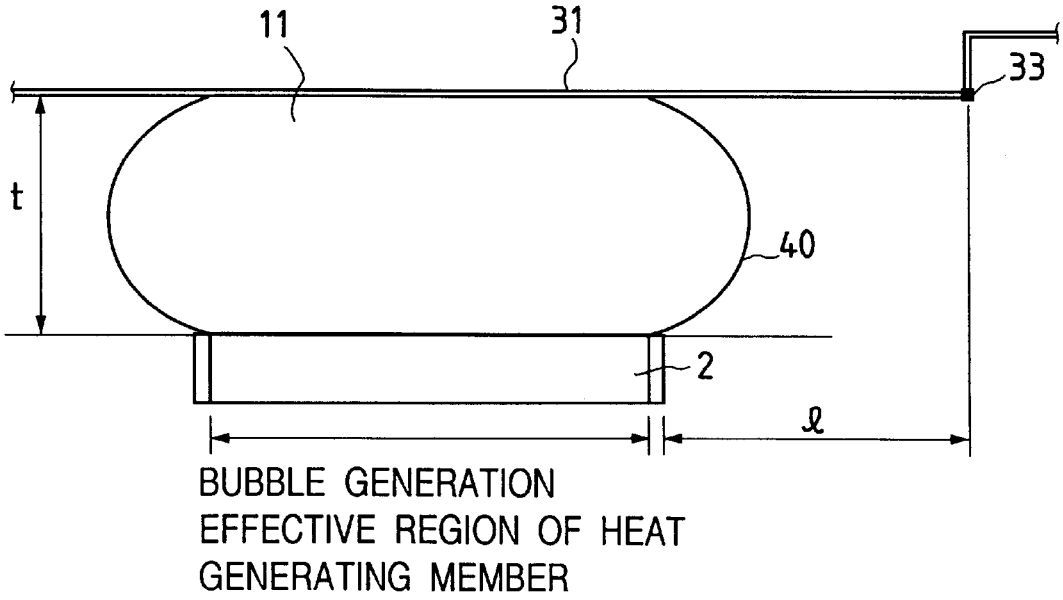
FIG. 18 is a drawing for explaining a positional relation between the heat generating member and the movable member.

FIG. 17 shows the relationship between distance from the edge of the heat generating member to the fulcrum of the movable member and displacement amount of the movable member, and FIG. 18 is a cross-sectional, structural drawing as a side view of the positional relation between the heat generating member 2 and the movable member 31.

The heat generating member 2 is of the size of 40×105 μm. It is seen that the greater the distance l from the edge of the heat generating member 2 to the fulcrum 33 of the movable member 31, the larger the displacement amount. It is thus desirable to obtain an optimum displacement amount and to determine the position of the fulcrum of the movable member, based on an discharge amount of ink desired, the structure of flow path of the discharge liquid, and the configuration of the heat generating member, or the like.

If the fulcrum of the movable member is located immediately above the effective bubbling region of the heat generating member, the bubble generation pressure, in addition to the stress due to the displacement of the movable member, will be applied directly to the fulcrum, which will degrade the durability of the movable member. The experiments conducted by the inventors found that when the fulcrum was disposed immediately above the effective bubbling region, the movable wall was damaged with application of approximately $1\times10^6$ pulses, thus degrading the durability. Therefore, when the fulcrum of the movable member is positioned in the region except for the area immediately above the effective bubbling region of the heat generating member, possibilities of practical use can be increased even in the case of movable members of shapes and materials having not so high durability. However, even if the fulcrum is located immediately above the effective bubbling region, the movable member can be used well by selecting the configuration and the material thereof suitably. In the structures described above, it is possible to obtain the liquid discharging head with the high discharge efficiency and the excellent durability.

Further, a part of the bubble generated in the bubble generation region of the second liquid flow path 16 with displacement of the movable member 31 into the first liquid flow path 14 extends in the first liquid flow path 14, and by determining the height of the movable member 31 so as to permit the bubble to extend in this way, the discharge force can be improved furthermore than in the case of the bubble not extending in such a way. In order to permit the bubble to extend in the first liquid flow path 14 as described, the height of the movable member 31 is determined to be preferably lower than the height of the maximum bubble. For example, when the size of the heat generating member 2 is determined to be 23×140 μm from the necessary volume of the liquid for generating the bubble, the sufficient space t between the movable member 31 and the heat generating member 2 shown in FIG. 18 is approximately 0.8 μm. However, if the space between the element substrate and the movable member or the partition wall having the movable member is simply narrowed, the height of the supply path will also be narrowed from the common liquid chamber to the bubble generation region. This increases the discharge force on one hand, but also increases the flow resistance on the other hand when the liquid flows into the bubble generation region upon collapse of bubble, which impedes the supply of liquid to the bubble generation region and thus lowers the refilling speed.

In the present invention, therefore, the space between the element substrate and the movable member or the partition wall having the movable member is greater on the common liquid chamber side than in the portion facing the flow path including the bubble generation region. As a result, without lowering the discharge force, the flow resistance becomes small when the liquid flows into the bubble generation region upon collapse of bubble; in the case of high-speed drive, the liquid can be supplied quickly to the bubble generation region, and the high-speed drive can thus be performed without causing insufficient refilling. In the case wherein it is difficult to provide a plurality of supply sources of the bubble generation liquid in one head in the structure of so-called full line head with many nozzles of the two-liquid-path type, a larger volume can also be assured by making greater the space to the substrate in the common liquid chamber portion of the bubble generation liquid and, in addition, the flow of the liquid is not impeded, whereby stable discharge can be carried out continuously.

Figure 19A:
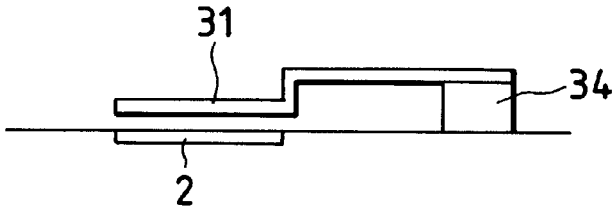
FIGS. 19A, 19B and 19C are schematic, cross-sectional views to show examples of the movable member of the single-liquid-path structure with different spaces to the element substrate having the heat generating member.
Figure 19B:
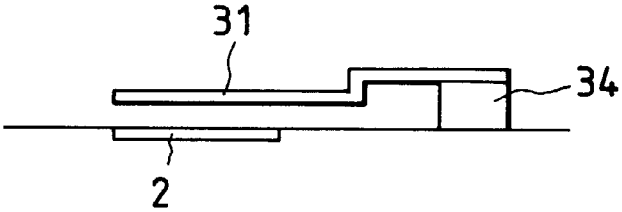
Figure 19C:
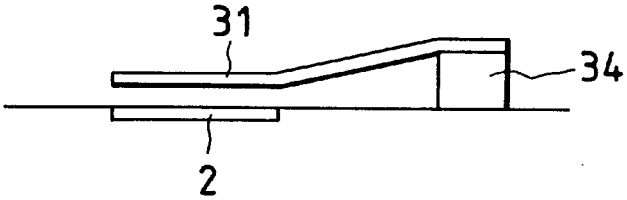

FIGS. 19A to 19C and FIGS. 20A to 20C respectively show examples of movable members of the single-liquid-path structure and partition walls having the movable member of the two-liquid-path structure with different spaces to the element substrate having the heat generating member. In the case of the single-liquid-path structure shown in FIGS. 1A to 1D and FIG. 2, the movable member 31 has the bent portion and the portion thereof supported by the support member 34 on the common liquid chamber side is higher than the portion facing the bubble generation region above the heat generating member 2, as shown in FIG. 19A. The movable member 31 may also have the bent portion and be supported by the support member 34 so that the portion thereof on the common liquid chamber side is higher than the portion facing the liquid flow area including the bubble generation region, as shown in FIG. 19B. Further, the movable member 31 may have a slant portion and be supported by the support member 34 so that the portion thereof on the common liquid chamber side is higher than the portion facing the bubble generation region, as shown in FIG. 19C.

Figure 20A:
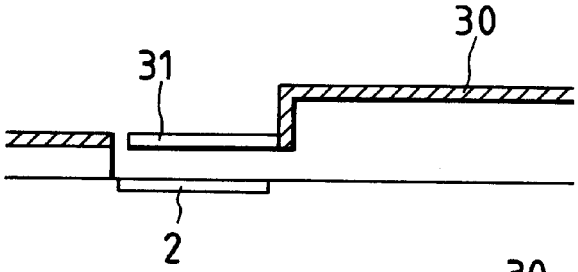
FIGS. 20A, 20B and 20C are schematic, cross-sectional views to show examples of the partition wall having the movable member of the two-liquid-path structure.
Figure 20B:
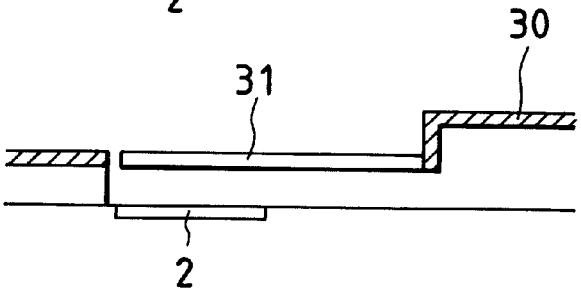
Figure 20C:
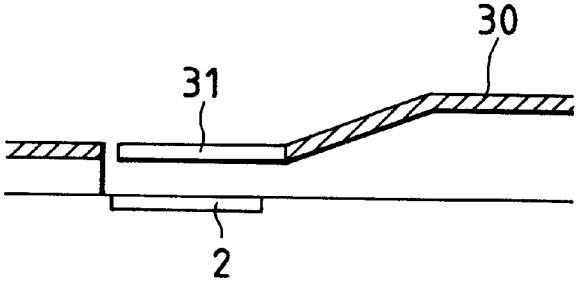

In the case of the two-liquid-path structure shown in FIG. 9 and FIG. 10, the partition wall 30 has the bent portion and the portion thereof on the common liquid chamber side is higher than the portion of the movable member 31 facing the bubble generation region above the heat generating member 2, as shown in FIG. 20A. The partition wall 30 may also have the bent portion and be supported so that the portion thereof on the common liquid chamber side is higher than the portion of the movable member 31 facing the flow path area including the bubble generation region, as shown in FIG. 20B. Further, the partition wall 30 may have the slant portion and be supported so that the portion thereof on the common liquid chamber side is higher than the portion facing the bubble generation region, as shown in FIG. 20C.

Figure 21:
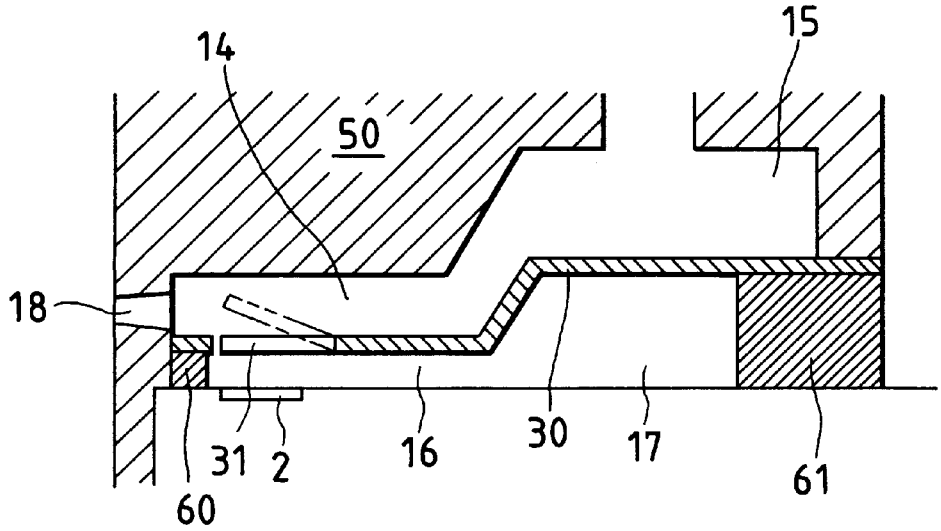
FIG. 21 is a schematic, cross-sectional view to show an example of the support structure for making greater the space to the element substrate on the common liquid chamber side in the partition wall of the two-liquid-path structure.

In this partition wall of the two-liquid-path structure, in order to make greater the space to the element substrate on the common liquid chamber side, one partition wall 31 with the bent portion or the slant portion formed at a predetermined portion is supported, as shown in FIG. 21, by first support member 60, which becomes a downstream wall constituting the second liquid flow path groove and by second support member 61 higher than the first support member 60, the second support member 61 becoming a wall of the groove for constituting the second common liquid chamber communicating with the second liquid flow path on the upstream side. It is also possible to employ such an arrangement as described in FIG. 22 wherein partition wall 30*a* of only a flat portion having the movable member 31 and partition wall 30*b* having the bent portion or the slant portion are joined with each other on third support member 62 becoming an upstream wall constituting the second liquid flow path groove and wherein the two partition walls thus joined are supported by first support member 60 having the same height as the third support member 62 and second support member 61 higher than the first support member 60.

The movable members or the partition walls having the movable member in the above structures may be fabricated by bending one Ni plate or may also be fabricated by either one of fabrication processes as shown in FIGS. 23A to 23D to FIGS. 25A to 25F. Specifically, the movable member or the partition wall having the movable member is fabricated, for example, by etching a metal substrate of SUS or the like to form a step or a slant surface and effecting electroforming of nickel or the like thereon, as shown in FIGS. 23A to 23D and FIGS. 24A to 24D. For forming the slant surface in the SUS substrate, etching is carried out while ashing a resist.

Figure 22:
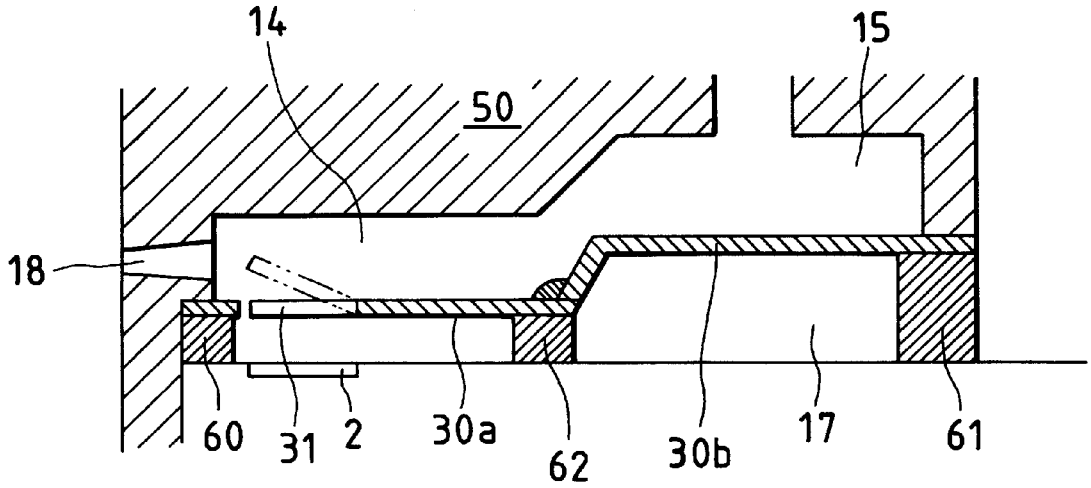
FIG. 22 is a schematic, cross-sectional view to show another example of the support structure for making greater the space to the element substrate on the common liquid chamber side in the partition wall of the two-liquid-path structure.
Figure 23A:
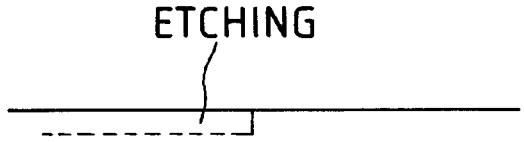
FIGS. 23A, 23B, 23C and 23D are drawings for explaining an example of the fabrication process of the movable member or the partition wall having the movable member.
Figure 23B:
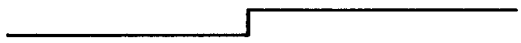
Figure 23C:
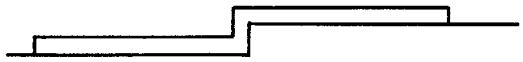
Figure 23D:
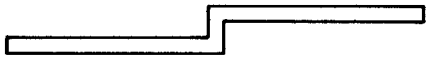
Figure 24A:
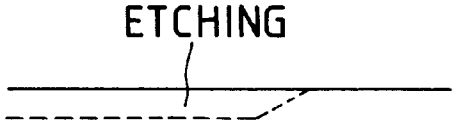
FIGS. 24A, 24B, 24C and 24D are drawings for explaining an example of the fabrication process of the movable member or the partition wall having the movable member.
Figure 24B:
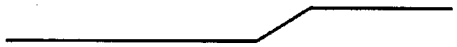
Figure 24C:
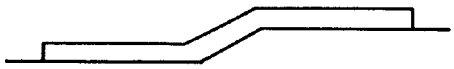
Figure 24D:
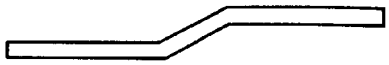
Figure 25A:
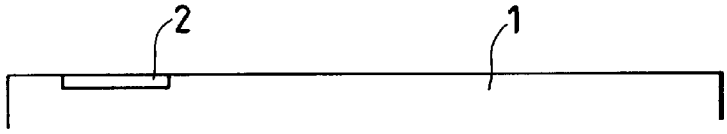
FIGS. 25A, 25B, 25C, 25D, 25E and 25F are drawings for explaining an example of the fabrication process of the movable member or the partition wall having the movable member.
Figure 25B:
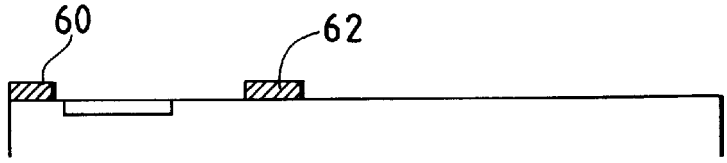
Figure 25C:
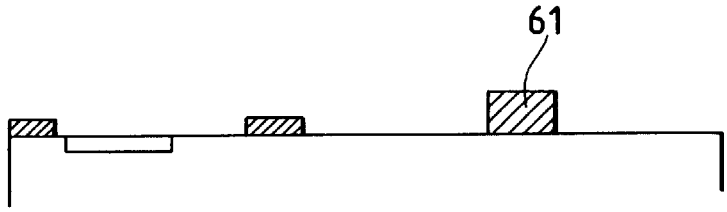
Figure 25D:
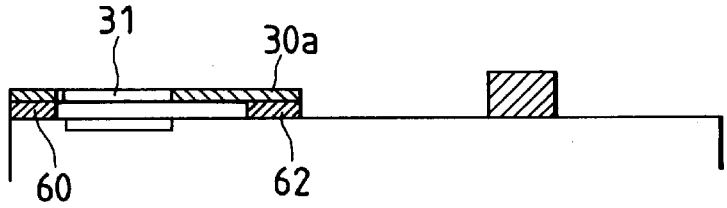
Figure 25E:
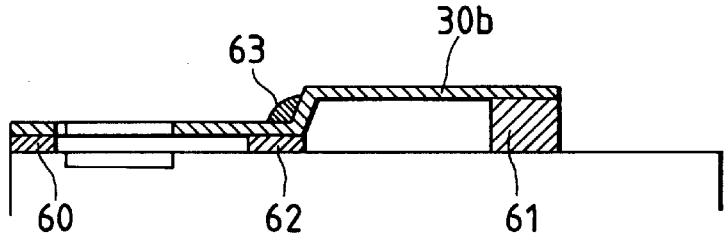
Figure 25F:
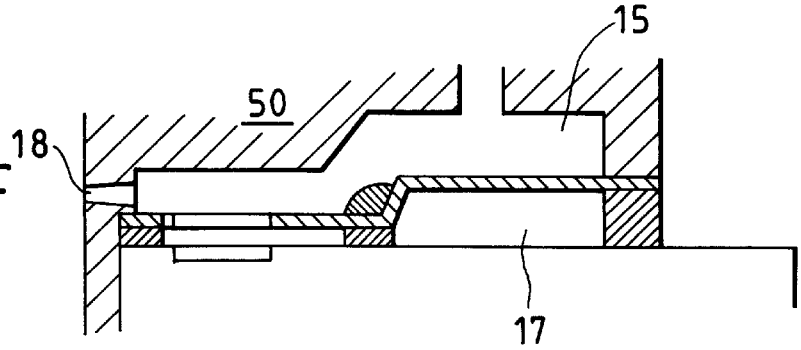

FIGS. 25A to 25F are fabrication step diagrams where the partition wall is made of the separate members, the partition wall on the bubble generation region side and the partition wall on the common liquid chamber side, as shown in FIG. 22. In this case, first, the first support member 60 and the third support member 62 having the same height and the second support member 61 higher than those are fabricated on the element substrate 1. Then the flat-plate-shape partition wall 30*a* having the movable member 31 is supported by the first support member 60 and the third support member 62 so as to cover the bubble generation region formed by the heat generating member 2 on the element substrate 1. After that, the flat-plate-shape partition wall 30*a* is bonded to the bent portion or the slant portion of the partition wall 30*b* on the third support member 62 with adhesive 63 and the other end of the partition wall 30*b* is supported by the second support member 61. This completes the partition wall in which the portion on the common liquid chamber side is higher than the portion of the movable member 31 facing the bubble generation region above the heat generating member 2.

<Element substrate>

Next explained is the structure of the element substrate in which the heat generating members for supplying heat to the liquid are mounted.

Figure 26A:
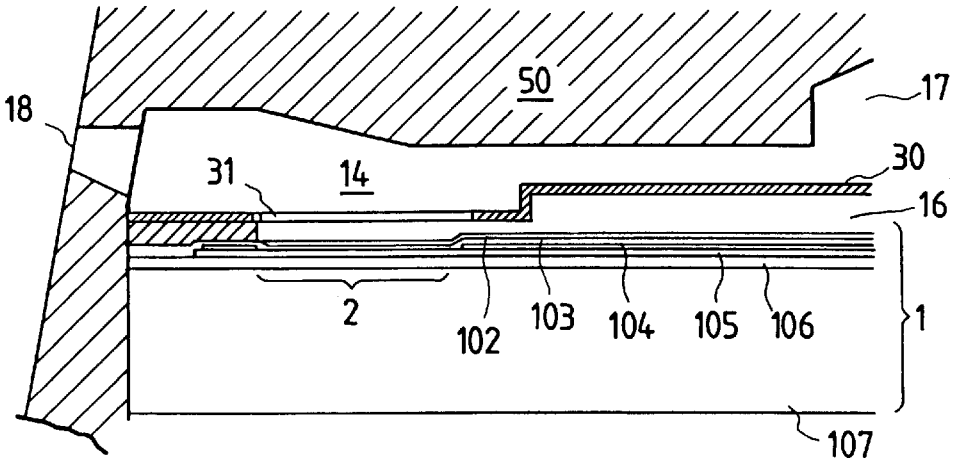
FIGS. 26A and 26B are longitudinal, cross-sectional views of a liquid discharging head according to the present invention.
Figure 26B:
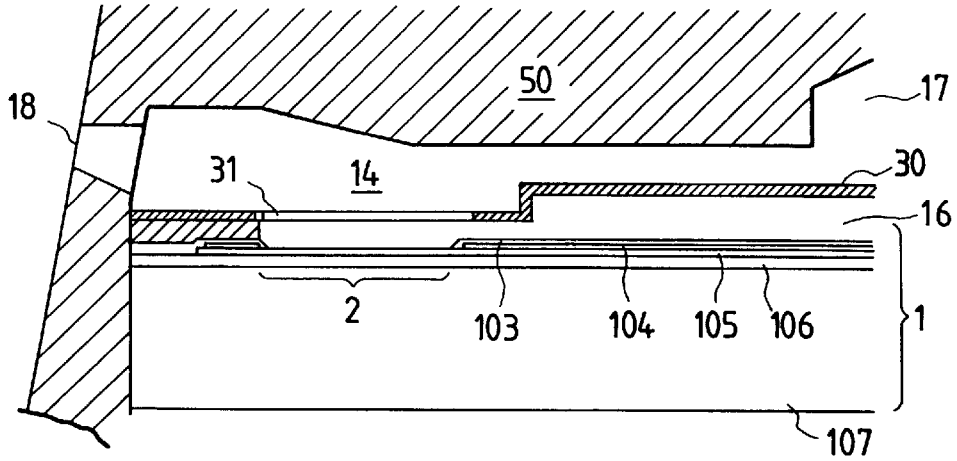

FIGS. 26A and 26B show longitudinal, sectional views of liquid discharging heads according to the present invention, wherein FIG. 26A is a drawing to show the head with a protecting film as detailed hereinafter and FIG. 26B a drawing to show the head without a protecting film.

Above the element substrate 1 there are provided second liquid flow paths 16, partition wall 30, first liquid flow paths 14, and grooved member 50 having grooves for forming the first liquid flow paths.

The element substrate 1 has patterned wiring electrodes (0.2–1.0 $\mu$m thick) of aluminum or the like and patterned electric resistance layer 105 (0.01–0.2 $\mu$m thick) of hafnium boride ($HfB_2$), tantalum nitride (TaN), tantalum aluminum (TaAl) or the like constituting the heat generating members on silicon oxide film or silicon nitride film 106 for electric insulation and thermal accumulation formed on the substrate 107 of silicon or the like, as shown in FIG. 10. The resistance layer generates heat when a voltage is applied to the resistance layer 105 through the two wiring electrodes 104 so as to let an electric current flow in the resistance layer. A protecting layer of silicon dioxide, silicon nitride, or the like 0.1–2.0 $\mu$m thick is provided on the resistance layer between the wiring electrodes, and in addition, an anti-cavitation layer of tantalum or the like (0.1–0.6 $\mu$m thick) is formed thereon to protect the resistance layer 105 from various liquids such as ink.

Particularly, the pressure and shock wave generated upon generation or collapse of bubble is so strong that the durability of the oxide film being hard and relatively fragile is considerably deteriorated. Therefore, a metal material such as tantalum (Ta) or the like is used as a material for the anti-cavitation layer.

The protecting layer stated above may be omitted depending upon the combination of liquid, liquid flow path structure, and resistance material, an example of which is shown in FIG. 26B. The material for the resistance layer not requiring the protecting layer may be, for example, an iridium-tantalum-aluminum alloy or the like.

Thus, the structure of the heat generating member in each of the foregoing embodiments may include only the resistance layer (heat generating portion) between the electrodes as described, or may also include the protecting layer for protecting the resistance layer.

In this embodiment, the heat generating member has a heat generation portion having the resistance layer which generates heat in response to an electric signal. Without having to be limited to this, any means may be employed if it creates a bubble enough to discharge the discharge liquid, in the bubble generation liquid. For example, the heat generating member may be one having such a heat generation portion as a photothermal transducer which generates heat upon receiving light such as laser or as a heat generation portion which generates heat upon receiving high frequency wave.

Functional elements such as a transistor, a diode, a latch, a shift register, and so on for selectively driving the electrothermal transducers may also be integrally built in the aforementioned element substrate 1 by the semiconductor fabrication process, in addition to the electrothermal transducers comprised of the resistance layer 105 for constituting the heat generating members and the wiring electrodes 104 for supplying the electric signal to the resistance layer.

Figure 27:
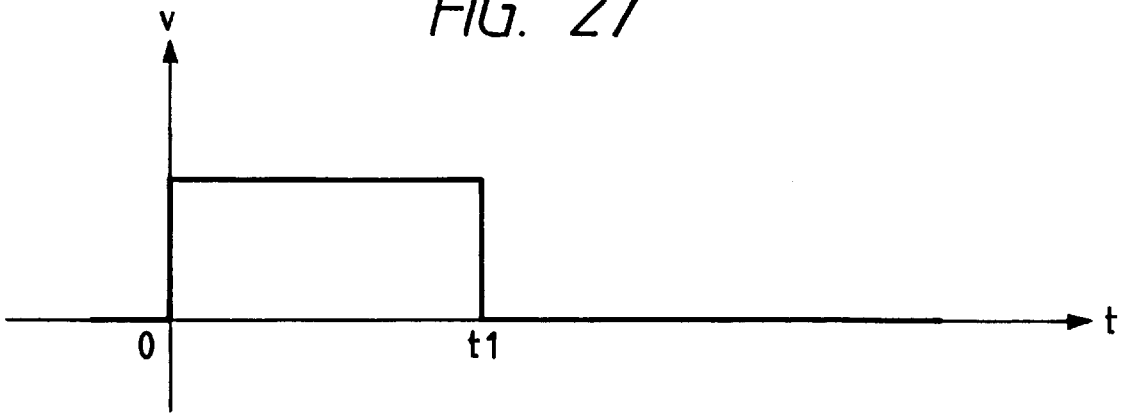
FIG. 27 is a schematic diagram to show a waveform of a driving pulse.

In order to drive the heat generation portion of each electrothermal transducer on the above-described element substrate 1 so as to discharge the liquid, a rectangular pulse as shown in FIG. 27 is applied through the wiring electrodes 104 to the aforementioned resistance layer 105 to quickly heat the resistance layer 105 between the wiring electrodes.

FIG. 27 is a schematic diagram to show the waveform of a driving pulse.

With the heads of the foregoing embodiments, the electric signal was applied to the layer at the voltage 24 V, the pulse width 7 $\mu$sec, the electric current 150 mA, and the frequency 6 kHz to drive each heat generating member, whereby the ink as a liquid was discharged through the discharge opening, based on the operation described above. However, the conditions of the driving signal are not limited to the above, but any driving signal may be used if it can properly generate a bubble in the bubble generation liquid.

<Head structure consisting of two flow paths>

Described in the following is a structural example of the liquid discharging head that is arranged as capable of separately introducing different liquids to the first and second common liquid chambers and that allows reduction in the number of parts and in the cost.

Figure 28:
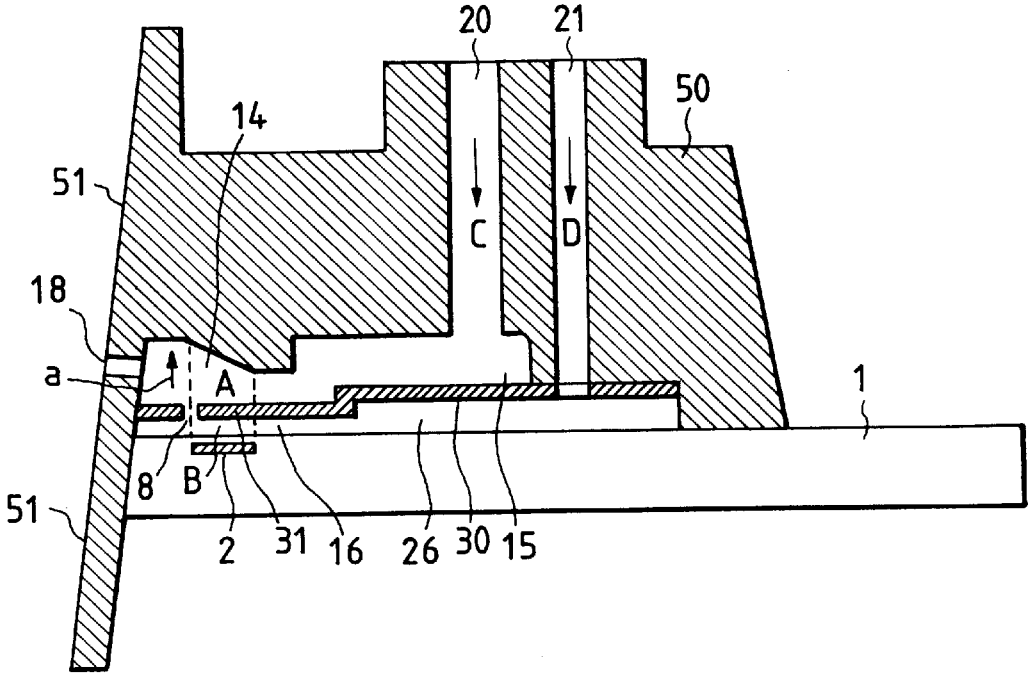
FIG. 28 is a cross-sectional view for explaining supply paths in a liquid discharging head according to the present invention.

FIG. 28 is a sectional view for explaining the supply path of the liquid discharging head of the present invention, wherein the same reference numerals denote the same constituent elements as in the previous embodiments, and the detailed description thereof will be omitted herein.

In the present embodiment, the grooved member 50 is composed mainly of orifice plate 51 having discharge openings 18, a plurality of grooves for forming a plurality of first liquid flow paths 14, and a recess portion for forming a first common liquid chamber 15, in communication with a plurality of liquid flow paths 14, for supplying the liquid (discharge liquid) to each first liquid flow path 14.

The plurality of first liquid flow paths 14 can be formed by joining the partition wall 30 to the bottom part of this grooved member 50. This grooved member 50 has first liquid supply path 20 running from the top part thereof into the first common liquid chamber 15. The grooved member 50 also has second liquid supply path 21 running from the top part thereof through the partition wall 30 into the second common liquid chamber 17.

The first liquid (discharge liquid) is supplied, as shown by arrow C of FIG. 28, through the first liquid supply path 20 and through the first common liquid chamber 15 then to the first liquid flow paths 14, while the second liquid (bubble generation liquid) is supplied, as shown by arrow D of FIG. 28, through the second liquid supply path 21 and through the second common liquid chamber 17 then to the second liquid flow paths 16.

The present embodiment is arranged to have the second liquid supply path 21 disposed in parallel to the first liquid supply path 20, but, without having to be limited to this, the second liquid supply path 21 may be positioned at any position as long as it is formed so as to pierce the partition wall 30 outside the first common liquid chamber 15 and to communicate with the second common liquid chamber 17.

The size (the diameter) of the second liquid supply path 21 is determined in consideration of the supply amount of the second liquid. The shape of the second liquid supply path 21 does not have to be circular, but may be rectangular or the like.

The second common liquid chamber 17 can be formed by partitioning the grooved member 50 by the partition wall 30. A method for forming the structure is as follows. As shown in the exploded, perspective view of the present embodiment shown in FIG. 29, a frame of the common liquid chamber and walls of the second liquid flow paths are made of a dry film on an element substrate and a combination of the partition wall 30 with the grooved member 50 fixed with each other is bonded to the element substrate 1, thereby forming the second common liquid chamber 17 and the second liquid flow paths 16.

In the present embodiment the substrate element 1 is placed on a support member 70 made of metal such as aluminum and the element substrate 1 is provided with electrothermal transducers as heat generating members for generating heat for producing a bubble by film boiling in the bubble generation liquid, as described previously.

On this element substrate 1 there are provided a plurality of grooves for forming the liquid flow paths 16 constructed of the second liquid path walls, a recess portion for forming the second common liquid chamber (common bubble generation liquid chamber) 17, arranged in communication with the plurality of bubble generation liquid flow paths, for supplying the bubble generation liquid to each bubble generation liquid path, and the partition wall 30 provided with the movable walls 31 described previously.

Reference numeral 50 designates the grooved member. This grooved member has the grooves for forming the discharge liquid flow paths (first liquid flow paths) 14 by joining the grooved member with the partition wall 30, the recess portion for forming the first common liquid chamber (common discharge liquid chamber) 15 for supplying the discharge liquid to each discharge liquid flow path, the first supply path (discharge liquid supply path) 20 for supplying the discharge liquid to the first common liquid chamber, and the second supply path (bubble generation liquid supply path) 21 for supplying the bubble generation liquid to the second common liquid chamber 17. The second supply path 21 is connected to a communication path running through the partition wall 30 located outside the first common liquid chamber 15 and being in communication with the second common liquid chamber 17, whereby the bubble generation liquid can be supplied to the second common liquid chamber 15 through this communication path without mixing with the discharge liquid.

The positional relation among the element substrate 1, the partition wall 30, and the grooved top plate 50 is such that the movable members 31 are positioned corresponding to the heat generating members of the element substrate 1 and the discharge liquid flow paths 14 are positioned corresponding to the movable members 31. The present embodiment showed the example wherein one second supply path was formed in the grooved member, but a plurality of second supply paths may be provided depending upon the supply amount. Further, cross-sectional areas of flow path of the discharge liquid supply path 20 and the bubble generation liquid supply path 21 may be determined in proportion to the supply amount. The components constituting the grooved member 50 etc. can be further compactified by optimizing such cross-sectional areas of flow path.

As described above, since the present embodiment is arranged so that the second supply path for supplying the second liquid to the second liquid flow paths and the first supply path for supplying the first liquid to the first liquid flow paths are formed in the grooved top plate as a single grooved member, the number of parts can be decreased, whereby the reduction in the manufacturing steps and costs can be achieved.

Since the structure is such that supply of the second liquid to the second common liquid chamber in communication with the second liquid flow paths is achieved through the second supply path in the direction to penetrate the partition wall for separating the first liquid from the second liquid, the bonding step of the partition wall, the grooved member, and the heat-generating-member-formed substrate can be a single step, which enhances ease to fabricate and the bonding accuracy, thereby permitting good discharge.

Since the second liquid is supplied to the second liquid common liquid chamber through the partition wall, this arrangement assures supply of the second liquid to the second liquid flow paths and also assures the sufficient supply amount, thus permitting stable discharge.

<Discharge liquid and bubble generation liquid>

Since the present invention employs the structure having the aforementioned movable members as discussed in the previous embodiments, the liquid discharging heads according to the present invention can discharge the liquid under higher discharge force, at higher discharge efficiency, and at higher speed than the conventional liquid discharging heads can. In the case of the same liquid being used for the bubble generation liquid and the discharge liquid in the present embodiment, the liquid may be selected from various liquids that are unlikely to be deteriorated by the heat applied by the heat generating member, that are unlikely to form the deposits on the heat generating member with application of heat, that are capable of undergoing reversible state changes between gasification and condensation with application of heat, and that are unlikely to deteriorate the liquid flow paths, the movable member, the partition wall, and so on.

Among such liquids, the liquid used for recording (recording liquid) may be one of the ink liquids of compositions used in the conventional bubble jet devices.

On the other hand, when the two-flow-path structure of the present invention is used with the discharge liquid and the bubble generation liquid of different liquids, the bubble generation liquid may be one having the above-mentioned properties; specifically, it may be selected from methanol, ethanol, n-propanol, isopropanol, n-hexane, n-heptane, n-octane, toluene, xylene, methylene dichloride, trichlene, Freon TF, Freon BF, ethyl ether, dioxane, cyclohexane, methyl acetate, ethyl acetate, acetone, methyl ethyl ketone, water, and mixtures thereof.

The discharge liquid may be selected from various liquids, regardless of possession of the bubble generation property and thermal property thereof. Further, the discharge liquid may be selected from liquids with a low bubble generation property, discharge of which was difficult by the conventional heads, liquids likely to be modified or deteriorated by heat, and liquids with high viscosity.

However, the discharge liquid is preferably a liquid not to hinder the discharge of liquid, the generation of bubble, the operation of the movable member, and so on because of the discharge liquid itself or because of a reaction thereof with the bubble generation liquid.

For example, high-viscosity ink may be used as the discharge liquid for recording. Other discharge liquids applicable include liquids weak against heat such as pharmaceutical products and perfumes.

In the present invention recording was carried out by use of the ink liquid in the following composition as a recording liquid usable for the both discharge liquid and bubble generation liquid. Since the discharge speed of ink was increased by an improvement in the discharge force, the shot accuracy of liquid droplet was improved, which enabled to obtain very good recording images.

| Dye ink (viscosity 2 cP) | |
|---|---|
| (C.I. hood black 2) dye | 3 wt % |
| Diethylene glycol | 10 wt % |
| Thio diglycol | 5 wt % |
| Ethanol | 3 wt % |
| Water | 77 wt % |

Further, recording was also carried out with combinations of liquids in the following compositions for the bubble generation liquid and the discharge liquid. As a result, the head of the present invention was able to well discharge not only a liquid with a viscosity of ten and several cP, which was not easy to discharge by the conventional heads, but also even a liquid with a very high viscosity of 150 cP, thus obtaining high-quality recorded objects.

| | |
|---|---|
| Bubble generation liquid 1: | |
| Ethanol | 40 wt % |
| Water | 60 wt % |
| Bubble generation liquid 2: | |
| Water | 100 wt % |
| Bubble generation liquid 3: | |
| Isopropyl alcohol | 10 wt % |
| Water | 90 wt % |
| Discharge liquid 1: | |
| Pigment ink (viscosity approximately 15 cP) | |

-continued

| | |
|---|---|
| Carbon black 5 | 5 wt % |
| Styrene-acrylic acid-ethyl acrylate copolymer (acid value 140 and weight average molecular weight 8000) | 1 wt % |
| Monoethanol amine | 0.25 wt % |
| Glycerine | 69 wt % |
| Thio diglycol | 5 wt % |
| Ethanol | 3 wt % |
| Water | 16.75 wt % |
| Discharge liquid 2 (viscosity 55 cP): | |
| Polyethylene glycol 200 | 100 wt % |
| Discharge liquid 3 (viscosity 150 cP): | |
| Polyethylene glycol 600 | 100 wt % |

Incidentally, with the liquids conventionally considered as not readily being discharged as described above, the shot accuracy of dot was poor conventionally on the recording sheet because of the low discharge speed and increased variations in the discharge directionality, and unstable discharge caused variations of discharge amounts, which made it difficult to obtain high-quality images. Against it, the structures of the above embodiments realized the satisfactory and stable generation of bubble using the bubble generation liquid. This resulted in an improvement in the shot accuracy of droplet and stabilization of ink discharge amount, thereby remarkably improving the quality of recording image.

<Fabrication of liquid discharging head>

Next, the fabrication process of the liquid discharging head according to the present invention will be described.

In the case of the liquid discharging head as shown in FIG. 2, the bases 34, by which the movable member 31 would be set above the element substrate 1, were formed by patterning of dry film or the like, and the movable member 31 having the bent portion or the slant portion was bonded or welded to the bases 34 so that the space to the element substrate was greater on the common liquid chamber side. After that, the grooved member, which had the plurality of grooves for forming the respective liquid flow paths 10, the discharge openings 18, and the recess portion for forming the common liquid chamber 13, was joined with the element substrate 1 as matching the grooves with the movable members, thus forming the liquid discharging head.

Figure 29:
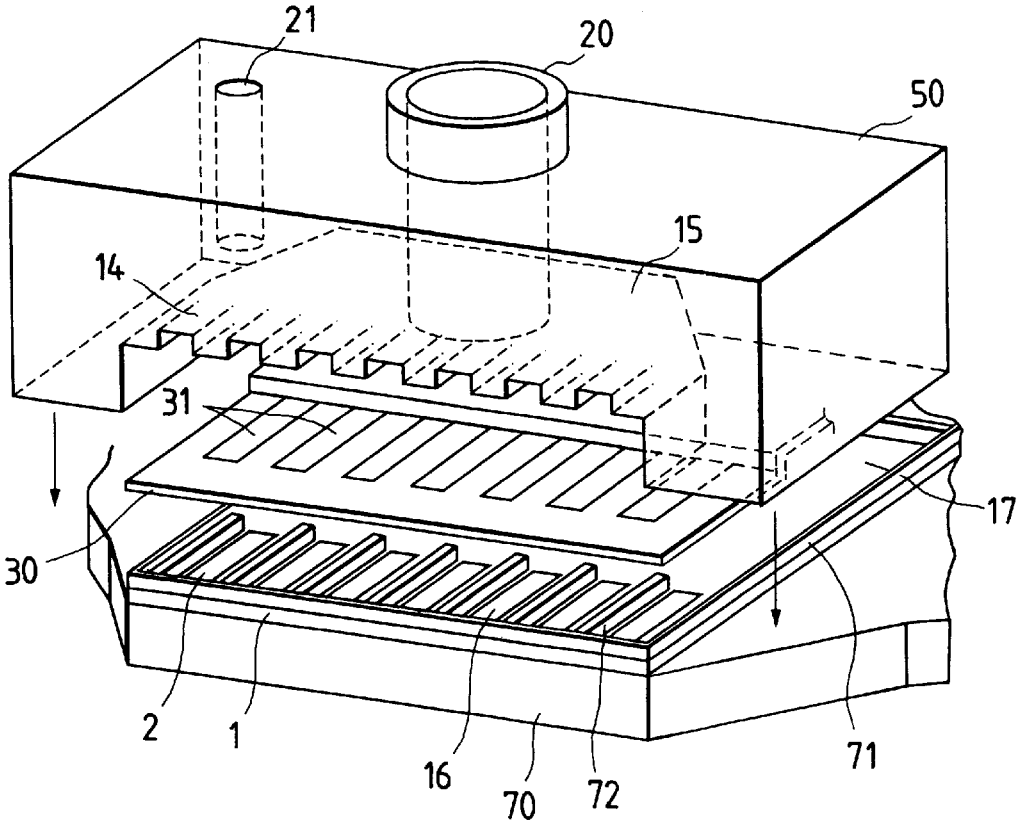
FIG. 29 is an exploded, perspective view of a head according to the present invention.

Next described is a fabrication process of the liquid discharging head of the two-flow-path structure as shown in FIG. 9 and FIG. 29.

FIG. 29 is an exploded, perspective view of the head according to the present invention.

Briefly explaining, the walls of second liquid flow paths 16 were formed on the element substrate 1, the partition wall 30 having the bent portion or the slant portion was attached thereonto so that the space to the element substrate 1 was greater on the common liquid chamber side, and the grooved member 50 in which the grooves for forming the first liquid flow paths 14 etc. were formed was attached further thereonto. Alternatively, the head was fabricated by forming the walls of the second liquid flow paths 16 and thereafter bonding the grooved member 50 to which the partition wall 30 was already attached, onto the walls.

The fabrication process of the second liquid flow paths will be described in further detail.

FIGS. 30A to 30E are step diagrams for explaining the fabrication process of the liquid discharging head according to the present invention.

Figure 30A:
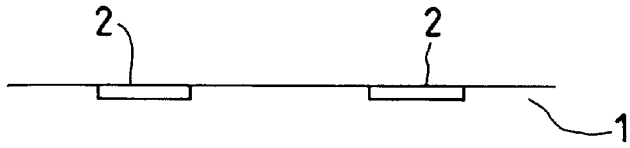
FIGS. 30A, 30B, 30C, 30D and 30E are process diagrams for explaining a fabrication process of liquid discharging head according to the present invention.

In the present embodiment, as shown in FIG. 30A, elements for electrothermal conversion of hafnium boride or tantalum nitride or the like having heat generating members 2 were formed on the element substrate (silicon wafer) 1 by use of a fabrication system similar to that used in the semiconductor fabrication process, and thereafter the surface of the element substrate 1 was cleaned for the purpose of improving adherence thereof with a photosensitive resin in the next step. A further improvement in adherence can be achieved in such a way that the surface of the element substrate is subjected to surface modification by ultraviolet-ozone or the like and thereafter the thus modified surface is coated by spin coating, for example, with a diluted solution containing 1% by weight of silane coupling agent [A189 (trade name) available from Nihon Unicar] in ethyl alcohol.

Figure 30B:
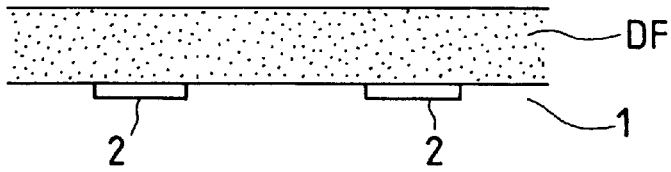

Then an ultraviolet-sensitive resin film DF [dry film Ohdil SY-318 (trade name) available from Tokyo Ohka Sha] was laminated on the substrate 1 with improved adherence after the surface cleaning, as shown in FIG. 30B.

Figure 30C:
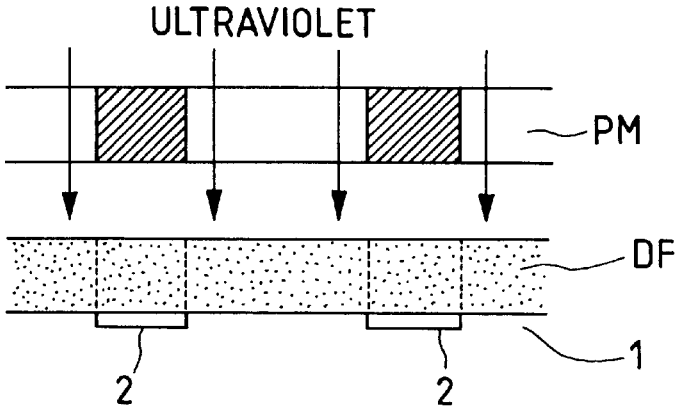

Then, as shown in FIG. 30C, photomask PM was placed above the dry film DF and portions to be left as the second liquid flow path walls in the dry film DF were subjected to ultraviolet radiation with intervention of this photomask PM. This exposure step was carried out under an exposure dose of about 600 mJ/cm$^2$ by use of MPA-600 (trade name) available from CANON INC.

Figure 30D:
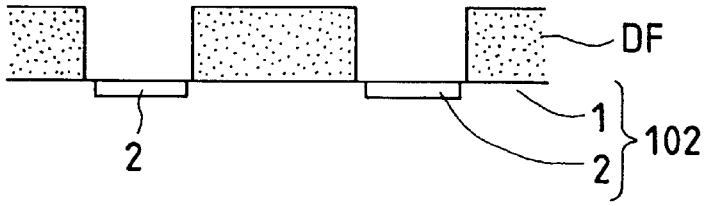

Next, as shown in FIG. 30D, the dry film DF was developed with a developer [BMRC-3 (trade name) available from Tokyo Ohka Sha] comprised of a mixture of xylene and butyl Cellosolve acetate, thereby dissolving unexposed portions and forming exposed and cured portions as the wall portions of the second liquid flow paths 16. Further, the residue remaining on the surface of element substrate 1 was removed as processing it for about 90 seconds by an oxygen plasma ashing apparatus [MAS-800 (trade name) available from Alkantec Inc.] and then the substrate was subjected to further ultraviolet radiation under 100 mJ/cm$^2$ at 150° C. for two hours, thereby completely curing the exposed portions.

The above process permits the second liquid flow paths to be formed uniformly and accurately in a plurality of heater boards (element substrates) obtained by dividing the above silicon substrate. The silicon substrate was cut and divided into heater boards 1 by a dicing machine [AWD-4000 (trade name) available from Tokyo Seimitsu] to which a diamond blade 0.05 mm thick was attached. The heater board 1 thus separated was fixed onto aluminum base plate 70 with an adhesive [SE4400 (trade name) available from TORAY INDUSTRIES, INC.] (see FIG. 33). Then the heater board 1 was connected to printed-wiring board 71, preliminarily bonded onto the aluminum base plate 70, by aluminum wires (not illustrated) of the diameter 0.05 mm.

Figure 30E:
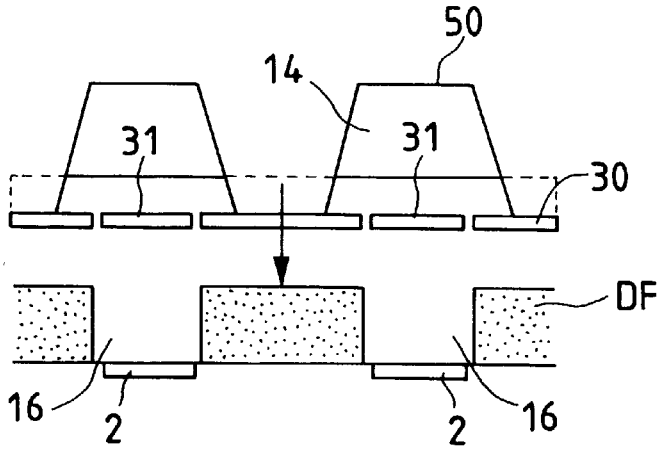

Next, by the aforementioned method a joint body of the grooved member 50 and the partition wall 30 was positioned and bonded to the heater board 1 thus obtained, as shown in FIG. 30E. Specifically, the heater board 1 was positioned relative to the grooved member having the partition wall 30, then they were engaged and fixed by presser bar spring 78, thereafter supply member 80 for ink and bubble generation liquid is joined with and fixed on the aluminum base plate 70, and gaps between the aluminum wires, between the grooved member 50, the heater board 1, and the supply member 80 for ink and bubble generation liquid were sealed with silicone sealant [TSE399 (trade name) available from Toshiba Silicone], thus concluding the process.

By forming the second liquid flow paths by the above fabrication process, the accurate flow paths can be obtained without positional deviation relative to the heaters of each heater board. Especially, by preliminarily joining the grooved member 50 with the partition wall 30 in a preceding step, the positional accuracy can be enhanced between the first liquid flow path 14 and the movable member 31.

These highly accurate fabrication techniques improve stability of discharge and quality of printing. Since the second liquid flow paths can be formed en bloc on the wafer, the liquid discharging heads can be fabricated in volume and at low cost.

The present embodiment used the ultraviolet-curing dry film for forming the second liquid flow paths, but it is also possible to obtain the second liquid flow paths in such a way that a resin having an absorption band in the ultraviolet region, especially near 248 nm, is used, it is laminated on the element substrate, then it is cured, and the resin in the portions to become the second liquid flow paths is removed directly by excimer laser.

There are other fabrication processes than the above.

FIGS. 31A to 31D are step diagrams for explaining another fabrication process of the liquid discharging head according to the present invention.

Figure 31A:
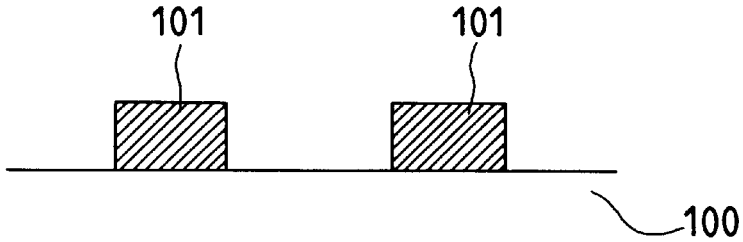
FIGS. 31A, 31B, 31C and 31D are process diagrams for explaining a fabrication process of liquid discharging head according to the present invention.

In the present embodiment, as shown in FIG. 31A, resist 101 of 15 $\mu$m thick was patterned in the shape of the second liquid flow paths on SUS substrate 100.

Figure 31B:
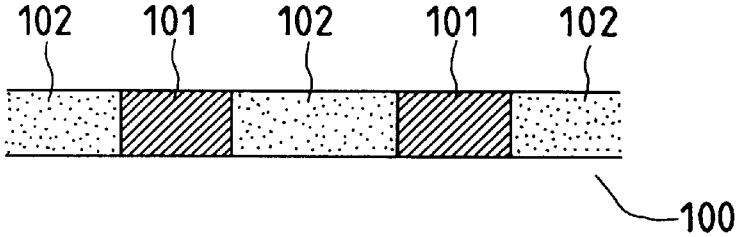

Then, as shown in FIG. 31B, nickel layer 102 was deposited in the same thickness of 15 $\mu$m on the SUS substrate 100 by effecting electroplating on the SUS substrate 100. A plating solution employed was one containing nickel sulfamate, a stress reducer [Zeroall (trade name) available from World Metal Inc.], boric acid, a pit prevention agent [NP-APS (trade name) available from World Metal Inc.], and nickel chloride. The electric field upon electroplating was applied with the electrode attached to the anode and with the patterned SUS substrate 100 attached to the cathode at the temperature of plating solution of 50° and in the current density of 5 A/cm$^2$.

Figure 31C:
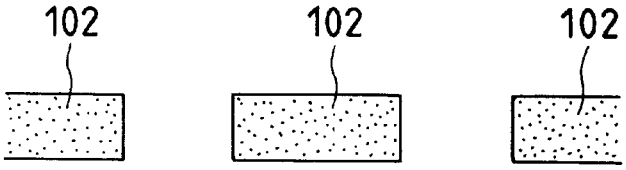

Next, as shown in FIG. 31C, ultrasonic vibration is applied to the thus plated SUS substrate 100 to peel the portions of nickel layer 102 off from the SUS substrate 100, thus obtaining the desired second liquid flow paths.

Figure 31D:
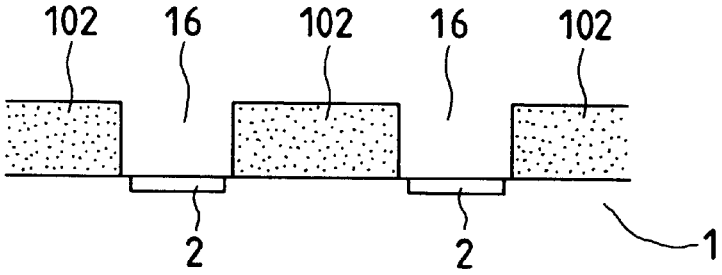

On the other hand, heater boards with the elements for electrothermal conversion disposed therein were formed in a silicon wafer by the fabrication system similar to the semiconductor fabrication system. This wafer was cut into the respective heater boards by the dicing machine in the same manner as in the preceding embodiment. This heater board 1 is joined with the aluminum base plate 70 to which the printed board 104 was preliminarily bonded, and electrical connection was made by connecting the heater board 1 with the printed board 71 by aluminum wires (not illustrated). The second liquid flow paths obtained in the preceding process were positioned and fixed on the heater board 1 in this state, as shown in FIG. 31D. In this fixing, since in the subsequent step they will be engaged with and adhered to the top plate with the partition wall fixed thereto by the presser bar spring, such fixing as not to cause positional deviation upon joint with the top plate is sufficient.

In the present embodiment, the above positioning fixing was done by forming a coating of ultraviolet-curing adhesive [Amicon UV-300 (trade name) available from Grace Japan] and then exposing it to ultraviolet radiation under the exposure dose of 100 mJ/cm$^2$ for about three seconds by use of an ultraviolet radiation system.

The fabrication process of the present embodiment can obtain the highly accurate second liquid flow paths without positional deviation relative to the heat generating members, and in addition, since the flow path walls are made of nickel, the present embodiment can provide the head with high reliability strong against alkaline solutions.

There is still another fabrication process.

FIGS. 32A to 32D are step diagrams for explaining another fabrication process of the liquid discharging head according to the present invention.

Figure 32A:
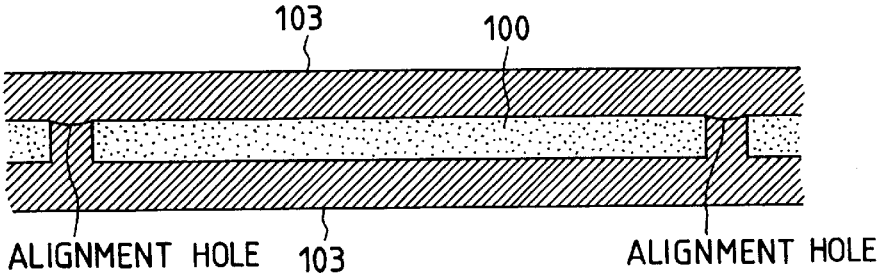
FIGS. 32A, 32B, 32C and 32D are process diagrams for explaining a fabrication process of liquid discharging head according to the present invention.

In the present embodiment, as shown in FIG. 32A, resist 103 was applied onto the both surfaces of SUS substrate 100 of 15 $\mu$m thick having alignment holes or marks. Here, the resist used was PMERP-AR900 available from Tokyo Ohka Sha.

Figure 32B:
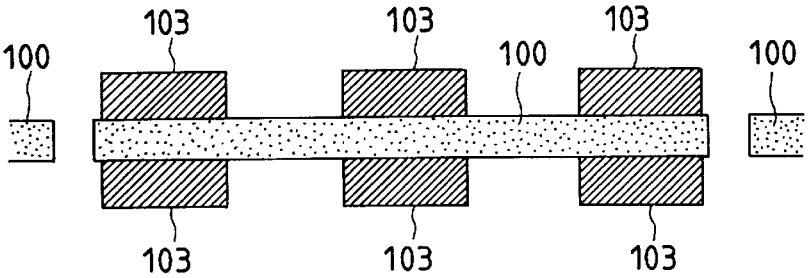

After this, as shown in FIG. 32B, exposure was carried out in correspondence to the alignment holes of the element substrate 100 by use of the exposure apparatus [MPA-600 (trade name) available from CANON INC.] and the resist 103 was removed in the portions where the second liquid flow paths were to be formed. Exposure was carried out under the exposure dose of 800 mJ/cm$^2$.

Figure 32C:
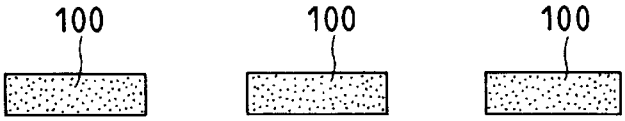

Next, as shown in FIG. 32C, the SUS substrate 100 with the patterned resist 103 on the both surfaces was immersed in an etchant (an aqueous solution of ferric chloride or cupric chloride) to etch the exposed portions from the resist 103 and thereafter the resist was peeled off.

Figure 32D:
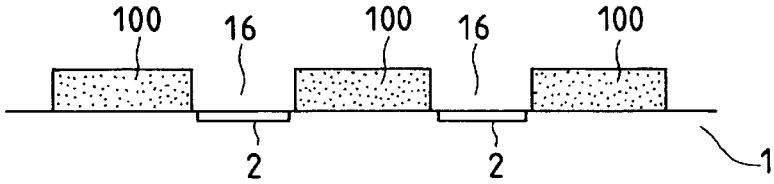

Then, as shown in FIG. 32D, the SUS substrate 100 thus etched was positioned and fixed onto the heater board 1 in the same manner as in the previous embodiment of the fabrication process to assemble the liquid discharging head having the second liquid flow paths 16.

The fabrication process of the present embodiment can obtain the highly accurate second liquid flow paths 16 without positional deviation relative to the heaters and in addition, since the flow paths are made of SUS, the fabrication process of the present embodiment can provide the liquid discharging head with high reliability strong against acid and alkaline liquids.

As described above, the fabrication process of the present embodiment permits the second liquid flow paths to be positioned at high accuracy relative to the electrothermal transducers by preliminarily mounting the walls of the second liquid flow paths on the element substrate. Since the second liquid flow paths can be formed simultaneously in the many element substrates in the wafer before cutting and separation, the liquid discharging heads can be provided in volume and at low cost.

In the liquid discharging head obtained by carrying out the fabrication process of liquid discharging head according to the fabrication process of the present embodiment, the heat generating members and the second liquid flow paths are positioned relative to each other at high accuracy, whereby the liquid discharging head can efficiently receive the pressure of bubble generation caused by heating of electrothermal transducer, thus being excellent in the discharge efficiency.

<Liquid discharging head cartridge>

Next explained schematically is a liquid discharging head cartridge incorporating the liquid discharging head according to the above embodiment.

Figure 33:
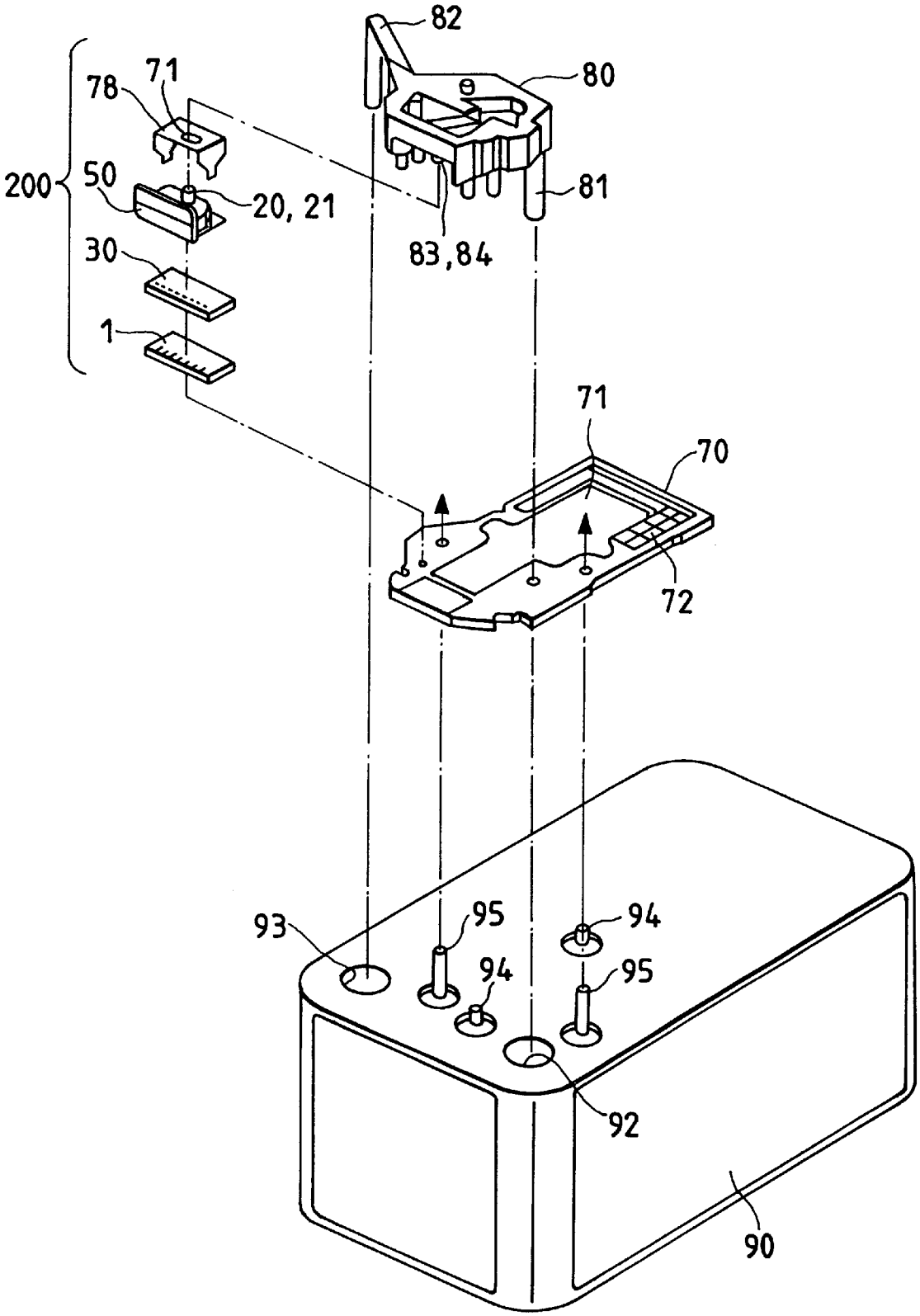
FIG. 33 is an exploded, perspective view of a liquid discharging head cartridge.

FIG. 33 is a exploded, perspective view of the liquid discharging head cartridge.

The liquid discharging head cartridge is generally composed mainly of a liquid discharging head portion 200 and a liquid container 90, as shown in FIG. 33.

The liquid discharging head portion 200 comprises an element substrate 1, a partition wall 30, a grooved member 50, a presser bar spring 78, a liquid supply member 80, and a support member 70. The element substrate 1 is provided with a plurality of arrayed heat generating resistors for supplying heat to the bubble generation liquid, as described previously. Further, the substrate 1 is provided with a plurality of function elements for selectively driving the heat generating resistors. Bubble generation liquid paths are formed between the element substrate 1 and the aforementioned partition wall 30 having the movable walls, thereby allowing the bubble generation liquid to flow therein. This partition wall 30 is joined with the grooved top plate 50 to form discharge flow paths (not shown) through which the discharge liquid to be discharged flows.

The presser bar spring 78 is a member which acts to exert an urging force toward the element substrate 1 on the grooved member 50, and this urging force properly combines the element substrate 1, the partition wall 30, the grooved member 50, and the support member 70 detailed below in an incorporated form.

The support member 70 is a member for supporting the element substrate 1 etc. Mounted on this support member 70 are a circuit board 71 connected to the element substrate 1 to supply an electric signal thereto, and contact pads 72 connected to the apparatus side to transmit electric signals to and from the apparatus side.

The liquid container 90 separately contains the discharge liquid such as ink and the bubble generation liquid for generation of bubble, which are to be supplied to the liquid discharging head. Outside the liquid container 90 there are positioning portions 94 for positioning a connecting member for connecting the liquid discharging head with the liquid container, and fixing shafts 95 for fixing the connecting member. The discharge liquid is supplied from a discharge liquid supply path 92 of the liquid container through a supply path 84 of the connecting member to a discharge liquid supply path 81 of the liquid supply member 80 and then is supplied through discharge liquid supply paths 83, 71, 21 of the respective members to the first common liquid chamber. The bubble generation liquid is similarly supplied from a supply path 93 of the liquid container through a supply path of the connecting member to a bubble generation liquid supply path 82 of the liquid supply member 80 and then is supplied through bubble generation liquid supply paths 84, 71, 22 of the respective members to the second liquid chamber.

The above liquid discharging head cartridge was explained with the supply mode and liquid container also permitting supply of different liquids of the bubble generation liquid and the discharge liquid, but, in the case wherein the discharge liquid and the bubble generation liquid are the same liquid, there is no need to separate the supply paths and container for the bubble generation liquid from those for the discharge liquid.

This liquid container may be refilled with a liquid after either liquid is used up. For this purpose, the liquid container is desirably provided with a liquid injection port. The liquid discharging head may be arranged as integral with or separable from the liquid container.

<Liquid discharging device>

Figure 34:
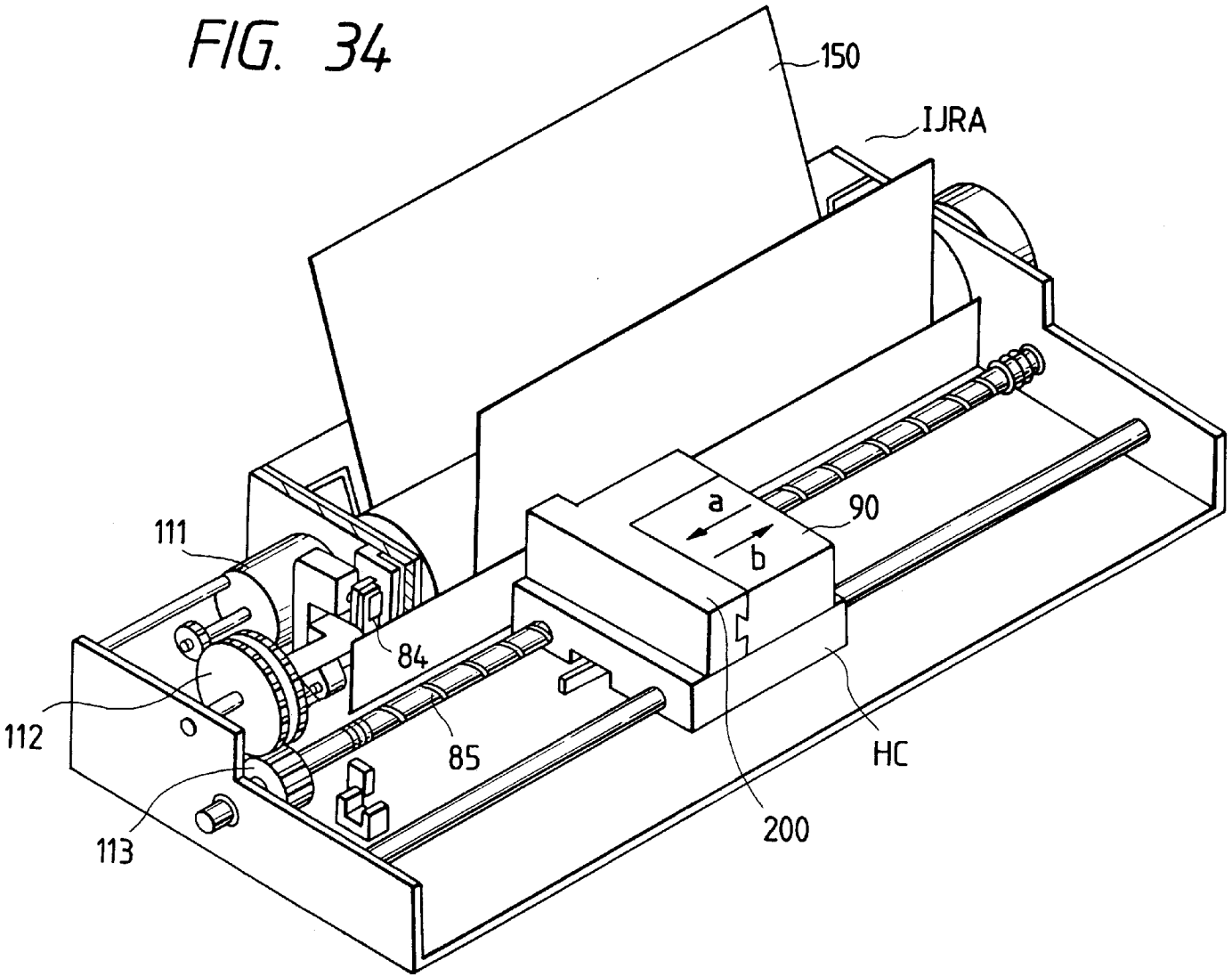
FIG. 34 is a schematic, structural drawing of a liquid discharging device.

FIG. 34 shows the schematic structure of a liquid discharging device.

The present embodiment will be explained especially with the ink discharge recording apparatus using the ink as the discharge liquid. A carriage HC of the liquid discharging device carries a head cartridge in which liquid tank portion 90 containing the ink and liquid discharging head portion 200 are detachable, and reciprocally moves widthwise of recorded medium 150 such as a recording sheet conveyed by a recorded medium conveying means.

When a driving signal is supplied from a driving signal supply means not shown to the liquid discharging means on the carriage, the recording liquid is discharged from the liquid discharging head to the recorded medium in response to this signal.

The liquid discharging device of the present embodiment has a motor 111 as a driving source for driving the recorded medium conveying means and the carriage, and gears 112, 113 and a carriage shaft 115 for transmitting the power from the driving source to the carriage. By this recording device and the liquid discharging method carried out therewith, recorded articles with good images were able to be attained by discharging the liquid to various recording media.

Figure 35:
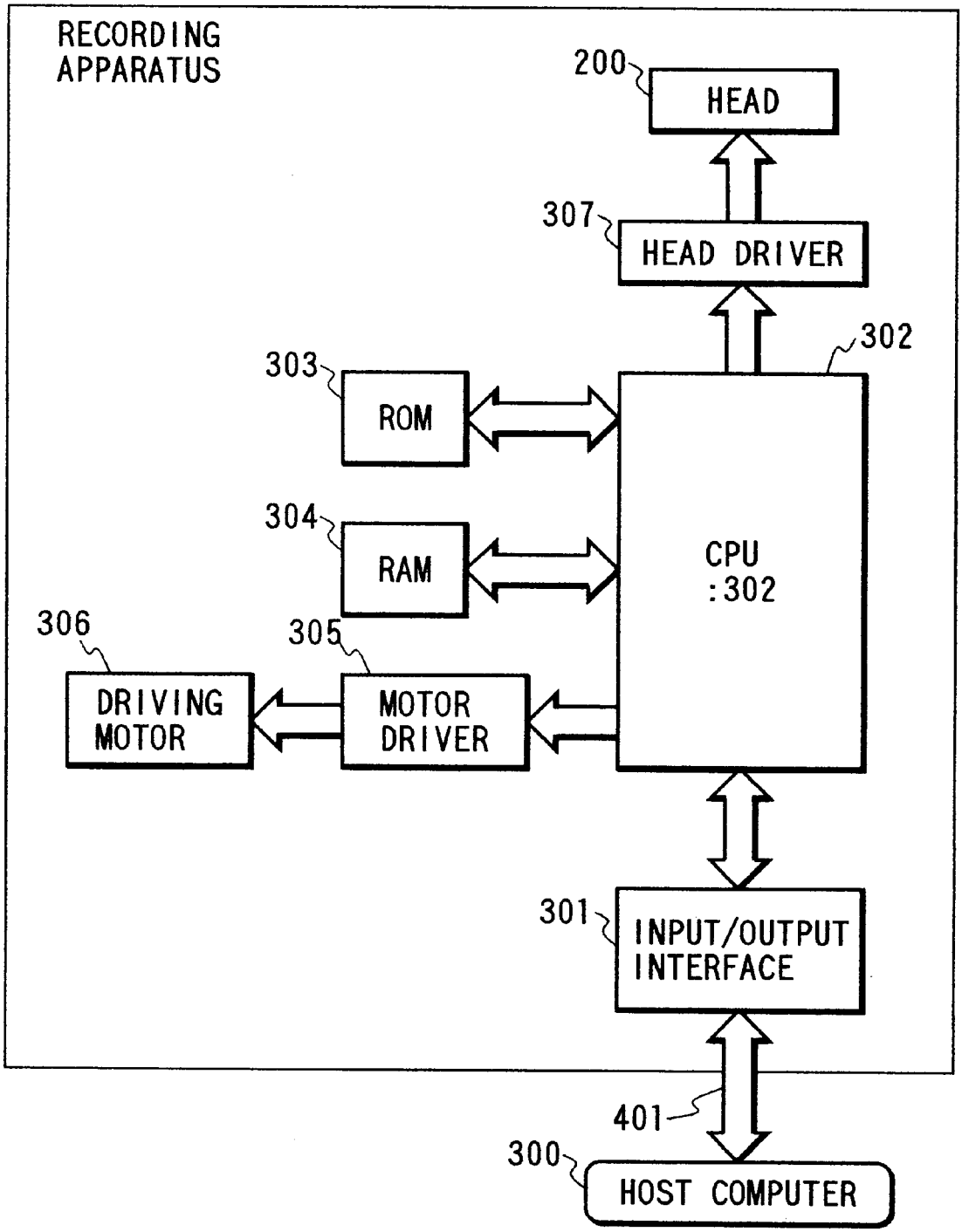
FIG. 35 is a device block diagram.

FIG. 35 is a block diagram of the whole of an apparatus for operating the ink discharging device to which the liquid discharging method and the liquid discharging head of the present invention are applied.

The recording apparatus receives printing information as a control signal from a host computer 300. The printing information is temporarily stored in an input interface 301 inside the printing apparatus, and, at the same time, is converted into data processable in the recording apparatus. This data is input to a CPU 302 also serving as a head driving signal supply means. The CPU 302 processes the data thus received, using peripheral units such as RAM 304, based on a control program stored in ROM 303 in order to convert the data into printing data (image data).

In order to record the image data at an appropriate position on a recording sheet, the CPU 302 generates driving data for driving the driving motor for moving the recording sheet and the recording head in synchronization with the image data. The image data or the motor driving data is transmitted each through a head driver 307 or through a motor driver 305 to the head 200 or to the driving motor 306, respectively, which is driven at each controlled timing to form an image.

Examples of the recorded media applicable to the above recording apparatus and capable of being recorded with the liquid such as ink include the following: various types of paper; OHP sheets; plastics used for compact disks, ornamental plates, or the like; fabrics; metals such as aluminum and copper; leather materials such as cowhide, pigskin, and synthetic leather; lumber materials such as solid wood and plywood; bamboo material; ceramics such as tile; and three-dimensional structures such as sponge.

The aforementioned recording apparatus includes a printer apparatus for recording on various types of paper and OHP sheet, a plastic recording apparatus for recording on a plastic material such as a compact disk, a metal recording apparatus for recording on a metal plate, a leather recording apparatus for recording on a leather material, a wood recording apparatus for recording on wood, a ceramic recording apparatus for recording on a ceramic material, a recording apparatus for recording on a three-dimensional network structure such as sponge, a textile printing apparatus for recording on a fabric, and so on.

The discharge liquid used in these liquid discharging apparatus may be properly selected as a liquid matching with the recorded medium and recording conditions employed.

<Recording system>

Next explained is an example of an ink jet recording system using the liquid discharging head of the present invention as a recording head, for performing recording on a recorded medium.

Figure 36:
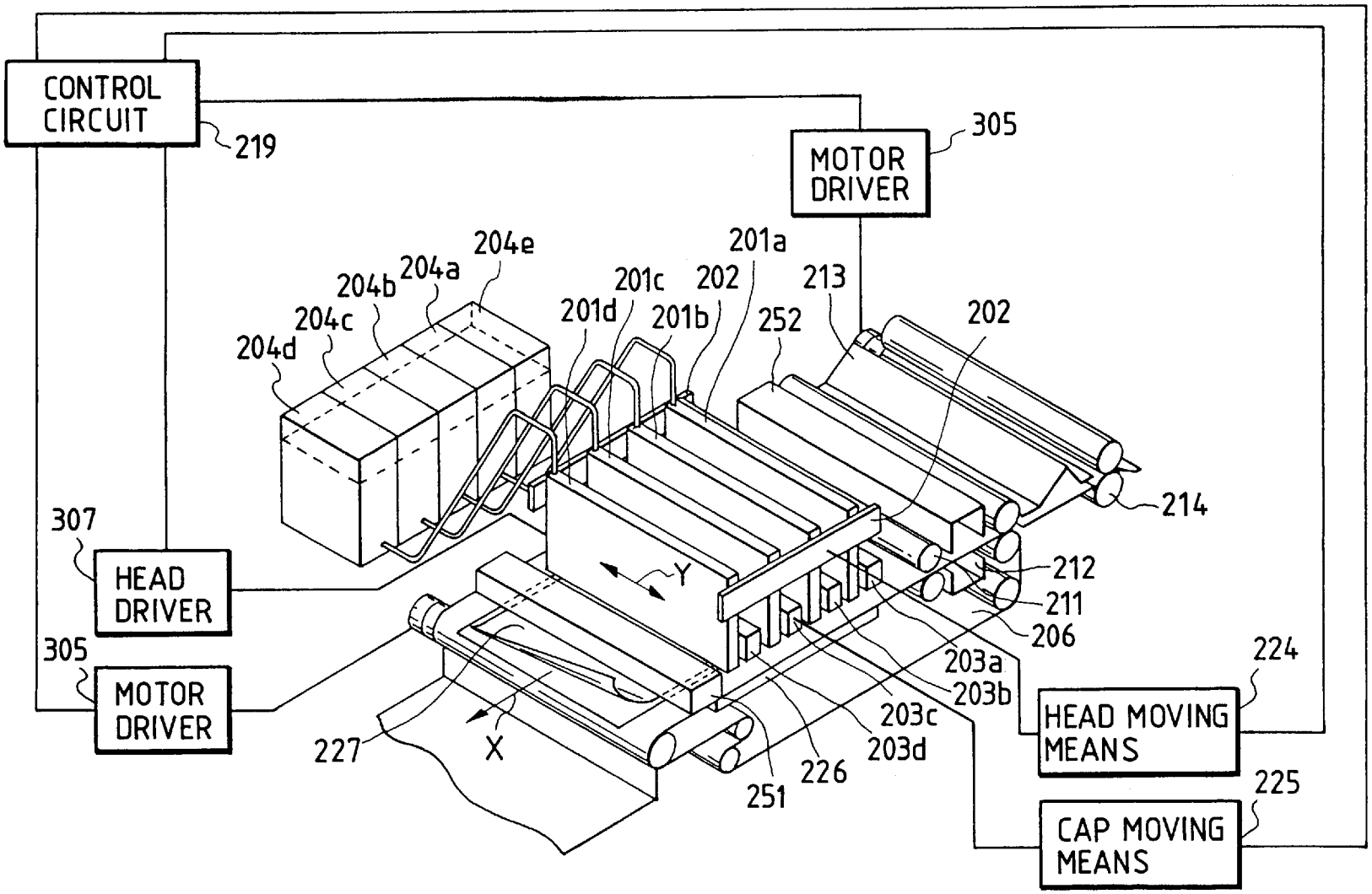
FIG. 36 is a drawing to show a liquid discharge recording system.

FIG. 36 is a schematic drawing for explaining the structure of the ink jet recording system using the liquid discharging head 201 of the present invention described above.

The liquid discharging head in the present embodiment is a full-line head having a plurality of discharge openings aligned in the density of 360 dpi so as to cover the entire recordable range of the recorded medium 150. The liquid discharging head comprises four head units corresponding to four colors of yellow (Y), magenta (M), cyan (C), and black (Bk), which are fixedly supported by holder 202 in parallel with each other and at predetermined intervals in the X-direction.

A head driver 307 constituting the driving signal supply means supplies a signal to each of these head units to drive each head unit, based on this signal.

The four color inks of Y, M, C, and Bk are supplied as the discharge liquid to the associated heads from corresponding ink containers 204*a*–204*d*. Reference symbol 204*e* designates a bubble generation liquid container containing the bubble generation liquid, from which the bubble generation liquid is supplied to each head unit.

Disposed below each head is a head cap 203*a*, 203*b*, 203*c*, or 203*d* containing an ink absorbing member comprised of sponge or the like inside. The head caps cover the discharge openings of the respective heads during non-recording periods so as to protect and maintain the head units.

Reference numeral 206 denotes a conveyer belt constituting a conveying means for conveying a recorded medium selected from the various types of media as explained in the preceding embodiments. The conveyor belt 206 is routed in a predetermined path via various rollers and is driven by a driving roller connected to a motor driver 305.

The ink jet recording system of this embodiment comprises a pre-process apparatus 251 and a post-process apparatus 252, disposed upstream and downstream, respectively, of the recorded medium conveying path, for effecting various processes on the recorded medium before and after recording.

The pre-process and post-process may include different process contents depending upon the type of recorded medium and the type of ink used in recording. For example, when the recorded medium is one selected from metals, plastics, and ceramics, the pre-process may be exposure to ultraviolet radiation and ozone to activate the surface thereof, thereby improving adhesion of ink. If the recorded medium is one likely to have static electricity such as plastics, dust will be easy to attach to the surface because of the static electricity, and this dust would sometimes hinder good recording. In that case, the pre-process may be elimination of static electricity in the recorded medium using an ionizer, thereby removing the dust from the recorded medium. If the recorded medium is a fabric, the pre-process may be a treatment to apply a material selected from alkaline substances, water-soluble substances, synthetic polymers, water-soluble metal salts, urea, and thiourea to the fabric in order to prevent blot and to improve the deposition rate. The pre-process does not have to be limited to these, but may be any process, for example a process to adjust the temperature of the recorded medium to a temperature suitable for recording.

On the other hand, the post-process may be, for example, a heat treatment of the recorded medium with the ink deposited, a fixing process for promoting fixation of the ink by ultraviolet radiation or the like, a process for washing away a treatment agent given in the pre-process and remaining without reacting.

The present embodiment was explained using the full-line head as the head, but, without having to be limited to this, the head may be a compact head for effecting recording as moving in the widthwise direction of the recorded medium, as described previously.

<Head kit>

Next explained is a head kit having the liquid discharging head of the present invention.

Figure 37:
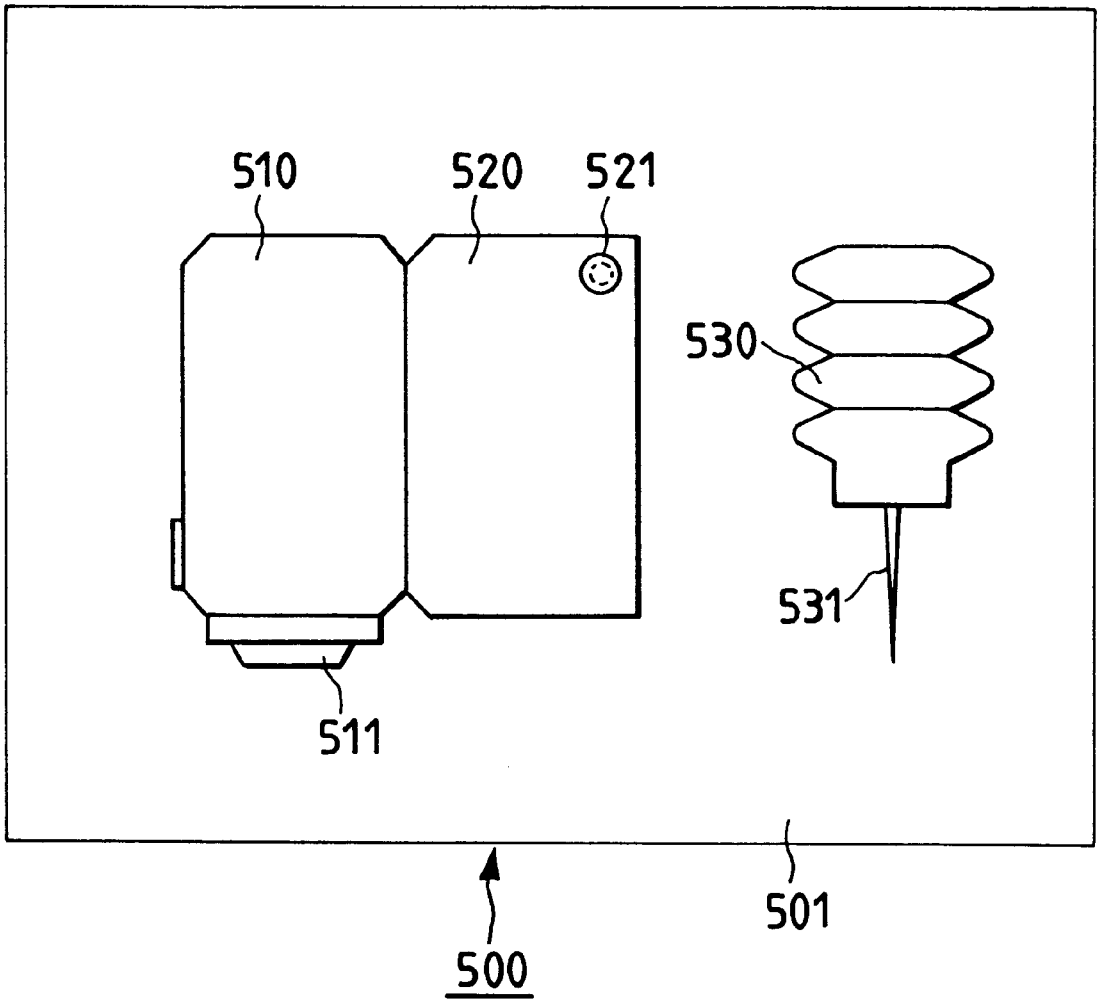
FIG. 37 is a schematic diagram of a head kit.
Figure 38A:
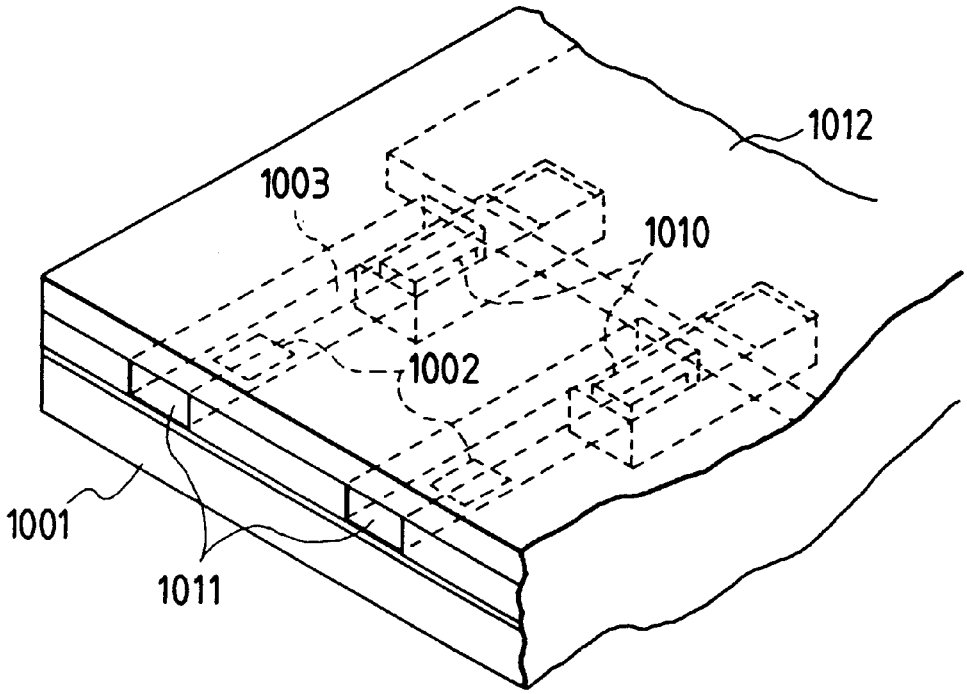
FIG. 38A PRIOR ART
FIGS. 38A and 38B are drawings for explaining the liquid flow path structure of the conventional liquid discharging head.
Figure 38B:
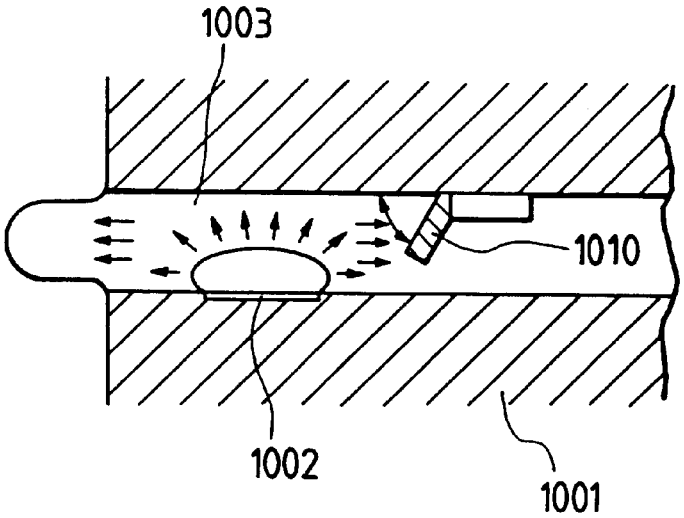
FIG. 38B PRIOR ART

FIG. 37 is a schematic drawing of the head kit.

This head kit shown in FIG. 37 is composed of a head 510 of the present invention having an ink discharge portion 511 for discharging the ink, an ink container 520 as a liquid container integral with or separable from the head, and an ink charging means 530 containing the ink, for charging the ink into the ink container, which are housed in a kit container 501.

After the ink is used up, a part of an injection portion (injector needle or the like) 531 of the ink charging means 530 is inserted into an air vent 521 of the ink container, a connecting portion to the head, or a hole bored in an wall of the ink container, and the ink in the ink charging means is charged into the ink container through the injection portion.

Employing the arrangement of the kit as housing the liquid discharging head of the present invention and the ink container and ink charging means etc. in the single kit container in this manner, the ink can be readily charged into the ink container soon after the ink is used up, and recording is restarted quickly.

Although the head kit of the present embodiment was explained as a head kit including the ink charging means, it may be constructed without the ink charging means in such an arrangement that the head and the ink container of the separable type, filled with ink, are housed in the kit container 510.

FIG. 37 shows only the ink charging means for charging the ink into the ink container, but another head kit may also have a bubble generation liquid charging means for charging the bubble generation liquid into the bubble generation liquid container, in the kit container, as well as the ink container.

As described above, since the present invention employs such an arrangement that the spaces between the element substrate and the movable member or the partition wall having the movable member vary with respect to the plane including the heat generating member and that the space in the bubble generation region is narrowest, the flow resistance becomes small without lowering the discharge force when the liquid flows into the bubble generation region upon collapse of bubble; and in the case of high-speed drive, the liquid can be supplied quickly to the bubble generation region, thereby enabling the high-speed drive without causing insufficient refilling.

Also in the case wherein it is difficult to provide a plurality of supply sources of the bubble generation liquid in one head in the structure of so-called full line head with many nozzles of the two-liquid-flow type, the arrangement wherein the space to the substrate in the common liquid chamber portion of the bubble generation liquid is greater can secure the volume and prevent the flow of liquid from being impeded, thereby enabling to perform stable discharge continuously.

In addition, by applying the invention, based on the novel discharge principle using the movable member to the head of the above structure, the synergistic effect can be achieved of the bubble generated and the movable member displaced thereby, so that the liquid near the discharge opening can be discharged efficiently, thereby improving the discharge efficiency as compared with the conventional heads etc. of the bubble jet method.

With the characteristic liquid path structure of the present invention, discharge failure can be prevented even after long-term storage at low temperature or at low humidity, or, even if discharge failure occurs, the head can be advantageously returned instantly into the normal condition only with a recovery process such as preliminary discharge or suction recovery. With this advantage, the invention can reduce the recovery time and losses of the liquid due to recovery, and thus can greatly decrease the running cost.

Especially, the structure of the present invention improving the refilling characteristics attained improvements in responsivity during continuous discharge, stable growth of bubble, and stability of liquid droplet, thereby enabling high-speed recording or high-quality recording based on high-speed liquid discharge.

In the head of the two-flow-path structure the freedom of selection of the discharge liquid was raised by use of a liquid likely to generate a bubble or a liquid unlikely to form the deposits (scorching or the like) on the heat generating member, as the bubble generation liquid, and the head of the two-flow-path structure was able to well discharge even the liquid that the conventional heads failed to discharge in the conventional bubble jet discharge method, for example, the high-viscosity liquid unlikely to generate a bubble, the liquid likely to form the deposits on the heat generating member, or the like.

Further, it was confirmed that the head of the two-flow-path structure was able to discharge even the liquid weak against heat or the like without posing a negative effect due to the heat on the discharge liquid.

When the liquid discharging head of the present invention was used as a liquid discharge recording head for recording, higher-quality recording was achieved.

What is claimed is:

1. A liquid discharging head comprising a discharge opening for discharging a liquid, a bubble generation region for generating a bubble in a liquid, and a movable member disposed so as to face the bubble generation region and arranged as displaceable between a first position and a second position more distant from the bubble generation region than the first position, wherein the movable member forms a narrower space in the bubble generation region than in a region upstream of the bubble generation region and is displaced from the first position to the second position by pressure based on generation of the bubble in the bubble generation region, and wherein the bubble is made to expand greater downstream than upstream with respect to a direction toward the discharge opening, by displacement of the movable member.

2. A liquid discharging head according to claim 1, wherein by the displacement of the movable member, a downstream portion of the bubble grows to downstream of the movable member.

3. A liquid discharging head according to claim 1, wherein the movable member has a fulcrum and a free end located downstream of the fulcrum.

4. A liquid discharging head comprising a discharge opening for discharging a liquid, a liquid flow path having a heat generating member for generating a bubble in a liquid by applying heat to the liquid and a supply path for supplying the liquid to above the heat generating member from upstream of the heat generating member along the heat generating member, and a movable member disposed so as to face the heat generating member, having a free end on the discharge opening side, and arranged to displace the free end, based on pressure resulting from generation of the bubble, thereby guiding the pressure to the discharge opening side, wherein the movable member is supported so as to have varying spaces to a plane including the heat generating member and the movable member forms a narrower space in the bubble generation region than in a region upstream of a generation region of the bubble generated by the heat generating member.

5. A liquid discharging head comprising a discharge opening for discharging a liquid, a heat generating member for generating a bubble in a liquid by applying heat to the liquid, a movable member disposed so as to face the heat generating member, having a free end on the discharge opening side, and arranged to displace the free end, based on pressure resulting from generation of the bubble, thereby guiding the pressure to the discharge opening side, and a supply path for supplying the liquid to above the heat generating member from upstream along a surface of the movable member closer to the heat generating member, wherein the movable member is supported so as to have varying spaces to a plane including the heat generating member and the movable member forms a narrower space in the bubble generation region than in a region upstream of a generation region of the bubble generated by the heat generating member.

6. A liquid discharging head comprising:

a first liquid flow path in fluid communication with a discharge opening;

a second liquid flow path having a bubble generation region for generating a bubble in a liquid by applying heat to the liquid; and a movable member disposed between the first liquid flow path and the bubble generation region, having a free end on the discharge opening side, and arranged to displace the free end into the first liquid flow path side, based on pressure resulting from generation of the bubble in the bubble generation region, thereby guiding the pressure to the discharge opening side of the first liquid flow path, wherein the movable member is supported so as to have varying spaces to a plane including a heat generating member and the movable member forms a narrower space in the bubble generation region than in a region upstream of the generation region of the bubble generated by the heat generating member.

7. A liquid discharging head according to claim 1 or claim 6, wherein the heat generating member is located at a position to face the movable member and the bubble generation region is defined between the movable member and the heat generating member.

8. A liquid discharging head according to claim 4 or claim 5, wherein the free end of the movable member is located downstream of a center of an area of the heat generating member.

9. A liquid discharging head according to claim 7, comprising a supply path for supplying the liquid to above the heat generating member from upstream of the heat generating member along the heat generating member.

10. A liquid discharging head according to claim 9, wherein the supply path is a supply path having a substantially flat or gently sloping, internal wall upstream of the heat generating member, the supply path supplying the liquid to above the heat generating member along the internal wall.

11. A liquid discharging head according to claim 9, wherein the bubble is a bubble generated by causing film boiling in the liquid by heat generated by the heat generating member.

12. A liquid discharging head according to claim 9, wherein the movable member is of a plate shape.

13. A liquid discharging head according to claim 12, wherein the whole of an effective bubbling region of the heat generating member faces the movable member.

14. A liquid discharging head according to claim 12, wherein the entire surface of the heat generating member faces the movable member.

15. A liquid discharging head according to claim 12, wherein a total area of the movable member is larger than a total area of the heat generating member.

16. A liquid discharging head according to claim 12, wherein the fulcrum of the movable member is located at a position offset from immediately above the heat generating member.

17. A liquid discharging head according to claim 16, wherein a portion of the movable member becoming the fulcrum is higher than a portion thereof facing the bubble generation region.

18. A liquid discharging head according to claim 17, wherein a slant portion is defined between the portion of the movable member facing the bubble generation region and the portion of the movable member becoming the fulcrum.

19. A liquid discharging head according to claim 16, wherein the movable member is supported so that an upstream side thereof is higher than a flow path area including the bubble generation region.

20. A liquid discharging head according to claim 12, wherein the free end of the movable member has a shape substantially perpendicularly crossing a liquid flow path in which the heat generating member is disposed.

21. A liquid discharging head according to claim 12, wherein the free end of the movable member is located on the discharge opening side of the heat generating member.

22. A liquid discharging head according to claim 6, wherein the movable member is constructed as a part of a partition wall disposed between the first liquid flow path and the second liquid flow path.

23. A liquid discharging head according to claim 22, wherein the partition wall is made of a metal material.

24. A liquid discharging head according to claim 23, wherein the metal material is nickel or gold.

25. A liquid discharging head according to claim 22, wherein the partition wall is made of a resin material.

26. A liquid discharging head according to claim 22, wherein the partition wall is made of a ceramic material.

27. A liquid discharging head according to claim 6, comprising a first common liquid chamber for supplying a first liquid to a plurality of the first liquid flow paths and a second common liquid chamber for supplying a second liquid to a plurality of the second liquid flow paths.

28. A liquid discharging head according to claim 27, wherein the movable member is supported so that a portion thereof on the second common liquid chamber side is higher than a flow path area including the bubble generation region.

29. A liquid discharging head comprising:

a grooved member integrally having a plurality of discharge openings for discharging a liquid, a plurality of grooves for forming a plurality of first liquid flow paths in direct communication with and in correspondence to the respective discharge openings, and a recess portion for forming a first common liquid chamber for supplying the liquid to the plurality of first liquid flow paths;

a smooth element substrate in which a plurality of heat generating members for generating a bubble in a liquid by applying heat to the liquid are provided; and a partition wall disposed between the grooved member and the element substrate, forming parts of walls of second liquid flow paths corresponding to the heat generating members, and having movable members at positions to face the respective heat generating members, each movable member being displaced into the first liquid flow path side by pressure based on generation of the bubble;

wherein the partition wall is supported so as to have varying spaces to the element substrate and the partition wall forms a narrower space in the bubble generation region than in a region upstream of generation regions of bubbles generated by the heat generating members.

30. A liquid discharging head according to claim 29, wherein the free end of the movable member is located downstream of a center of an area of the heat generating member.

31. A liquid discharging head according to claim 30, wherein the grooved member has a first supply path for supplying a liquid to the first common liquid chamber and a second supply path for supplying a liquid to a second common liquid chamber in fluid communication with the second liquid flow paths.

32. A liquid discharging head according to claim 31, wherein the grooved member is provided with a plurality of the second supply paths.

33. A liquid discharging head according to claim 31, wherein a ratio of a cross-sectional area of the first supply path and a cross-sectional area of the second supply path is proportional to supply amounts of the respective liquids.

34. A liquid discharging head according to claim 31, wherein the second supply path is an introducing path penetrating the partition wall and supplying the liquid to the second common liquid chamber.

35. A liquid discharging head according to claim 6 or claim 29, wherein the liquid supplied to the first liquid flow path and the liquid supplied to the second liquid flow path are a same liquid.

36. A liquid discharging head according to claim 6 or claim 29, wherein the liquid supplied to the first liquid flow path and the liquid supplied to the second liquid flow path are different liquids.

37. A liquid discharging head according to claim 32, wherein the liquid supplied to the second liquid flow paths is a liquid more excellent in at least one property of a low-viscosity property, a bubble-generating property, and thermal stability than the liquid supplied to the first liquid flow paths.

38. A liquid discharging head according to claim 29, wherein each of the heat generating members is an electrothermal transducer having a heating resistor member for generating heat with reception of an electric signal.

39. A liquid discharging head according to claim 38, wherein the electrothermal transducer is one obtained by placing a protecting film on the heating resistor member.

40. A liquid discharging head according to claim 38, wherein on the element substrate there are provided wires for supplying the electric signal to the electrothermal transducers and functional elements for selectively supplying the electric signal to the electrothermal transducers.

41. A liquid discharging head according to claim 6 or claim 29, wherein a shape of the second liquid flow path in a portion where the bubble generation region or the heat generating member is disposed is a chamber shape.

42. A liquid discharging head according to claim 6 or claim 29, wherein a shape of the second liquid flow path is a shape having a throat portion upstream of the bubble generation region or the heat generating member.

43. A liquid discharging head according to claim 29, wherein a distance from a surface of the heat generating member to the movable member is 30 $\mu$m or less.

44. A liquid discharging head according to claim 29, wherein the liquid discharged through the discharge openings is ink.

45. A head cartridge comprising the liquid discharging head as set forth in any of claim 1, claim 4, claim 5, claim 6, and claim 29, and a liquid container for reserving a liquid to be supplied to the liquid discharging head.

46. A head cartridge according to claim 45, wherein the liquid discharging head and the liquid container can be separated from each other.

47. A head cartridge according to claim 45, wherein the liquid container is refilled with the liquid.

48. A head cartridge according to claim 45, wherein the liquid container comprises a liquid injection port for refilling of the liquid.

49. A head cartridge comprising the liquid discharging head as set forth in claim 6 or claim 29, and a liquid container for reserving a first liquid to be supplied to the first liquid flow path and a second liquid to be supplied to the second liquid flow path.

50. A liquid discharging device comprising:

the liquid discharging head as set forth in any of claim 1, claim 4, claim 5, claim 6, and claim 29; and driving signal supply means for supplying a driving signal for discharging the liquid from the liquid discharging head.

51. A liquid discharging device comprising:

the liquid discharging head as set forth in any of claim 1, claim 4, claim 5, claim 6, and claim 29; and recorded medium conveying means for conveying a recorded medium for receiving the liquid discharged from the liquid discharging head.

52. A liquid discharging device according to claim 51, wherein recording takes place by discharging ink from the liquid discharging head and depositing the ink on a recording sheet.

53. A liquid discharging device according to claim 51, wherein recording takes place by discharging a recording liquid from the liquid discharging head and depositing the recording liquid on a fabric.

54. A liquid discharging device according to claim 51, wherein recording takes place by discharging a recording liquid from the liquid discharging head and depositing the recording liquid on a plastic material.

55. A liquid discharging device according to claim 51, wherein recording takes place by discharging a recording liquid from the liquid discharging head and depositing the recording liquid on a metal material.

56. A liquid discharging device according to claim 51, wherein recording takes place by discharging a recording liquid from the liquid discharging head and depositing the recording liquid on a wood material.

57. A liquid discharging device according to claim 51, wherein recording takes place by discharging a recording liquid from the liquid discharging head and depositing the recording liquid on a leather material.

58. A liquid discharging device according to claim 51, wherein color recording takes place by discharging recording liquids of plural colors from the liquid discharging head and depositing the recording liquids of plural colors on the recorded medium.

59. A liquid discharging device according to claim 51, wherein a plurality of the discharge openings are arranged across the overall width of a recordable area of the recorded medium.

60. A recording system comprising the liquid discharging device as set forth in claim 51, and a post-process device for promoting fixation of the liquid to the recorded medium after recording.

61. A recording system comprising the liquid discharging device according to claim 51, and a pre-process device for enhancing fixation of the liquid to the recorded medium before recording.

62. A head kit comprising the liquid discharging head as set forth in any of claim 1, claim 4, claim 5, claim 6, and claim 29, and a liquid container for reserving a liquid to be supplied to the liquid discharging head.

63. A head kit according to claim 62, wherein the liquid is ink for recording.

64. A head kit comprising the liquid discharging head as set forth in any of claim 1, claim 4, claim 5, claim 6, and claim 29, a liquid container for reserving a liquid to be supplied to the liquid discharging head, and liquid charging means for charging the liquid into the liquid container.

65. A head kit according to claim 64, wherein the liquid is ink for recording.

66. A fabrication process of a liquid discharging head comprising a first recess portion for forming a first liquid flow path in fluid communication with a discharge opening, a movable member arranged as displaceable relative to the first recess portion, a second recess portion for forming a second liquid flow path for displacing the movable member, and discharge energy generating means disposed corresponding to the second recess portion, the fabrication process comprising the steps of forming walls for forming the second recess portion on an element substrate having the discharge energy generating means and thereafter successively joining members respectively comprising the movable member and the first recess portion with the second recess portion so that at least a space between the movable member and the discharge energy generating means becomes narrowest by providing the movable member with a bent portion or a slant portion, there being a narrower space in the bubble generation region than in a region upstream thereof.

67. A fabrication process of a liquid discharging head comprising a first recess portion for forming a first liquid flow path in fluid communication with a discharge opening, a partition wall having a movable member arranged as displaceable relative to the first recess portion, a second recess portion for forming a second liquid flow path for reserving a liquid for displacing the movable member of the partition wall, and discharge energy generating means disposed corresponding to the second recess portion, the fabrication process comprising the steps of forming walls for forming the second recess portion on an element substrate having the discharge energy generating means and thereafter successively joining members respectively comprising the movable member and the first recess portion with the second recess portion so that at least a space between the partition wall and the discharge energy generating means becomes narrowest by providing the partition wall with a bent portion or a slant portion so as to provide a narrower space in the bubble generation region than in a region upstream thereof.

68. A liquid discharging head,comprising:

a discharge opening for discharging a liquid;

a liquid flow path having a plane including a heat generating member for generating heat to discharge liquid from said discharge opening; and a movable member disposed in said liquid flow path so as to face said heat generating member, having a free end on a side of said discharge opening, wherein a space between the movable member and said plane is narrower above said heat generating member than in a region upstream of said heat generating member.

* * * * *

UNITED STATES PATENT AND TRADEMARK OFFICE

CERTIFICATE OF CORRECTION

PATENT NO. : 6,183,068 B1 
DATED : February 6, 2001
INVENTOR(S) : Toshio Kashino et al.

It is certified that error appears in the above-identified patent and that said Letters Patent is hereby corrected as shown below:

Title page,
Item [56], FOREIGN PATENT DOCUMENTS,
"4,292,949 10/1992 (JP)" should read -- 4-292949 10/1992 (JP) -- and
"61-59914 2/1980 (JP)" should read -- 55-59914 2/1980 (JP) --.

Column 7,
Line 51, "sixty" should read -- sixty- --.

Column 8,
Line 34, "1A, 1B, 1C and 1D" should read -- 1A to 1D --; and
Line 66, "13A, 13B and 13C" should read -- 13A to 13C --.

Column 9,
Line 1, "14A, 14B and 14C" should read -- 14A to 14C --;
Line 15, "19A, 19B and 19C" should read -- 19A to 19C --;
Line 19, "20A, 20B and 20C" should read -- 20A to 20C --;
Line 31, "23A, 23B, 23C and 23D" should read -- 23A to 23D --;
Line 35, "24A, 24B, 24C and 24D" should read -- 24A to 24D --;
Line 38, "25A, 25B, 25C, 25D, 25E and 25F" should read -- 25A to 25F --;
Line 53, "30A, 30B, 30C, 30D and 30E" should read -- 30A to 30E --;
Line 56, "31A, 31B, 31C and 31D" should read -- 31A to 31D --; and
Line 59, "32A, 32B, 32C and 32D" should read -- 32A to 32D --.

Column 11,
Line 4, "convenience'" should read -- convenience's --; and
Line 31, "after" should read -- after being --.

Column 16,
Line 20, "2" boldface.

Column 22,
Line 57, "14A, 14B and 14C" should read -- 14A to 14C --.

Column 26,
Line 46, "furthermore" should read -- further --.

Column 31,
Line 24, "compactified" should read -- compacted --.

UNITED STATES PATENT AND TRADEMARK OFFICE

CERTIFICATE OF CORRECTION

PATENT NO. : 6,183,068 B1
DATED : February 6, 2001
INVENTOR(S) : Toshio Kashino et al.

It is certified that error appears in the above-identified patent and that said Letters Patent is hereby corrected as shown below:

Column 36,
Line 58, "is a" should read -- is an --.

Column 37,
Line 67, "not shown" should read -- (not shown) --.

Column 40,
Line 15, "an wall" should read -- a wall --.

Column 46,
Line 53, "head,comprising:" should read -- head, comprising: --.

Signed and Sealed this

Twenty-third Day of July, 2002

*Attest:*

*Attesting Officer*

JAMES E. ROGAN
*Director of the United States Patent and Trademark Office*